US012655545B2

(12) United States Patent
Zhang et al.

(10) Patent No.: US 12,655,545 B2
(45) Date of Patent: Jun. 16, 2026

(54) METHOD OF MAKING LARGE SPRING INDEX ARTIFICIAL MUSCLES

(71) Applicant: Board of Regents, The University of Texas System, Austin, TX (US)

(72) Inventors: Mengmeng Zhang, Dallas, TX (US); Ray Baughman, Dallas, TX (US); Shaoli Fang, Richardson, TX (US); Jiyoung Oh, Fort Worth, TX (US); Zhong Wang, Dallas, TX (US); Fatma Göktepe, Istanbul (TR); Özer Göktepe, Istanbul (TR)

(73) Assignee: BOARD OF REGENTS, THE UNIVERSITY OF TEXAS SYSTEM, Austin, TX (US)

( * ) Notice: Subject to any disclaimer, the term of this patent is extended or adjusted under 35 U.S.C. 154(b) by 0 days.

(21) Appl. No.: 19/015,453

(22) Filed: Jan. 9, 2025

(65) Prior Publication Data

US 2025/0146188 A1 May 8, 2025

Related U.S. Application Data

(63) Continuation-in-part of application No. 18/431,022, filed on Feb. 2, 2024.
(Continued)

(51) Int. Cl.
*D02G 3/28* (2006.01)
*D02G 3/02* (2006.01)
(Continued)

(52) U.S. Cl.
CPC ..... *D02G 3/288* (2013.01); *D02G 3/02* (2013.01); *D02G 3/28* (2013.01); *D02G 3/36* (2013.01); *D02G 3/443* (2013.01)

(58) Field of Classification Search
CPC .. D02G 3/02; D02G 3/26; D02G 3/34; D02G 3/44; D02G 3/448; D02G 1/028;
(Continued)

(56) References Cited

U.S. PATENT DOCUMENTS 6,158,204 A * 12/2000 Talley ..... D02G 3/24 57/208
9,903,350 B2 * 2/2018 Li ..... F03G 7/0633
(Continued)

FOREIGN PATENT DOCUMENTS

EP 3333419 A2 * 6/2018 ..... F03G 7/06
WO WO-2020163228 A1 * 8/2020 ..... F03G 7/0121

*Primary Examiner* — Shaun R Hurley
(74) *Attorney, Agent, or Firm* — Dickinson Wright PLLC; Ross Spencer Garsson

(57) ABSTRACT

Methods for fabricating coiled polymer fibers and yarns (high-spring-index coiled fibers and yarns). Methods include inserting twist separately into individual fibers or yarns, plying the fibers or yarns by inserting plying twist, setting the ply structure without permanently binding together the fibers or yarns of different plies so that the ply structure is substantially stable against untwist when torsionally untethered, and then unwrapping the plied fibers or yarns so that a high-spring-index fiber or yarn can be obtained. In some embodiments, the unwrapped fibers or yarns are further set so that these are further stabilized. The methods can eliminate the need for a mandrel, and can be quickly applied for applications where high-spring-index thermally-driven artificial muscles are presently employed, such as for presently commercialized comfort-adjusting jackets.

19 Claims, 59 Drawing Sheets

Related U.S. Application Data

(60) Provisional application No. 63/482,858, filed on Feb. 2, 2023.

(51) Int. Cl.
*D02G 3/36* (2006.01)
*D02G 3/44* (2006.01)

(58) Field of Classification Search
CPC ..... D02G 1/0286; D02G 3/28; D02G 3/288; D02G 3/36; D02G 3/443; D03D 15/283; D03D 15/41; D03D 15/49; F03G 7/06114; F03G 7/06143; F03G 7/06145; D10B 2101/122; D10B 2331/02; D10B 2331/10; D10B 2505/00; B25J 9/1075
See application file for complete search history.

(56) References Cited

U.S. PATENT DOCUMENTS

| | | | | |
|---|---|---|---|---|
| 10,815,976 | B2 * | 10/2020 | Kaneko | F03G 7/06 |
| 11,519,106 | B2 * | 12/2022 | Ridley | D06M 11/05 |
| 2018/0291535 | A1 * | 10/2018 | Ridley | D02G 1/0286 |
| 2020/0003189 | A1 * | 1/2020 | Allen | F03G 7/0616 |
| 2021/0116152 | A1 * | 4/2021 | Liu | F03G 7/06143 |
| 2021/0198817 | A1 * | 7/2021 | Göktepe | D03D 15/567 |
| 2024/0263361 | A1 * | 8/2024 | Zhang | F03G 7/06143 |

* cited by examiner 2-ply polymer yarn 2-ply polymer yarn 3-ply polymer yarn

After 1st thermal annealing

After 2nd thermal annealing

ITAP-treated, 3-ply CNT yarn

Slightly untwist

Extracted high-spring-index coiled CNT yarn

Plying twist density
10.0 turns/cm

Plying twist density
7.1 turns/cm

Scale bar:
1 mm

METHOD OF MAKING LARGE SPRING INDEX ARTIFICIAL MUSCLES

CROSS-REFERENCE TO RELATED PATENT APPLICATIONS

This application is a continuation-in-part application of U.S. patent application Ser. No. 18/431,022, filed Feb. 2, 2024, entitled "Method of Making Large Spring Index Artificial Muscles, which claims priority to U.S. Patent Appl. Ser. No. 63/482,858, filed Feb. 2, 2023, entitled "Large Spring Index Artificial Muscles." These patent applications are commonly owned by the owner of the present invention. These patent applications are incorporated herein in their entirety.

STATEMENT OF GOVERNMENT INTEREST

This invention was made with government support under grant ONR/STTR N68335-18-C-0368, ONR N00014-22-1-2569, and ONR N00014-23-1-2183 from the Department of Defense (Navy) ONR/STTR and under grant FA9550-21-1-0455 from the Air Force Office of Scientific Research. The United States government has certain rights in the invention.

FIELD OF THE INVENTION

The mandrel-free fabrication of high-spring-index yarns and fibers.

BACKGROUND OF INVENTION

Very large spring index coiled artificial muscles are needed for many applications, because a large spring index increases muscle stroke. The coiled muscles can optionally be made from either a single fiber or a yarn that potentially comprises many fibers. Hence, when the term "yarn" or "fiber" is referenced, this reference can be applied to either yarns or fibers, unless otherwise indicated. The known method for making these large spring index coiled polymer muscles is by coiling twisted fibers around a large cylindrical or quasi-cylindrical mandrel, since increasing the mandrel's diameter to substantially above the yarn's diameter increases the spring index of the muscle. However, this method of coiling around a mandrel is expensive to realize and can introduce imperfections. This is because it involves either obtaining a high-spring-index product fiber by rotating a precursor fiber around a stationary cylindrical mandrel or rotating the mandrel as the input fiber is translated along the mandrel's length. Thereafter, a large spring index mandrel-free fiber can be obtained by removing the coiled fiber from the mandrel. However, there are important problems. First, the need to remove the coiled fiber from the mandrel by withdrawing the mandrel limits the length of mandrel and correspondingly limits the length of the coiled fiber that can be produced. Second, the described use of a rotating mandrel and a translating fiber input can introduce defects in the coiled yarn because of imprecise control of mandrel rotation versus input fiber translation.

It is known in the prior-art that high-spring-index yarns or fibers can be thermally set by thermal annealing the mandrel-coiled yarn while it is on the mandrel. This mandrel-wrapped yarn or fiber can then be completely freed from the mandrel by using a liquid to dissolve the mandrel [Ridley '979 Patent] or exposing the mandrel-wrapped yarn or fiber to thermal or chemical reaction conditions that eliminates the mandrel without adversely affecting the initially surrounding polymer fiber or yarn. However, such processes for eliminating the mandrel are wasteful, since they waste the material used for the mandrel and unnecessarily create a corresponding waste stream. Thus, improved large spring index artificial muscles and methods of making same are needed.

SUMMARY OF INVENTION

In general, in one embodiment, the invention features a method for making a high-spring-index coiled fiber or yarn without using a sacrificial core material whose diameter approximately defines the inner-coil diameter. The method includes inserting twist separately into two or more individual fibers and/or yarns. The method further includes plying the two or more individual fibers and/or yarns by inserting plying twist to form a multi-ply structure. The method further includes setting the multi-ply structure without permanently binding together the two or more individual fibers and/or yarns of different plies in the multi-ply structure so that the multi-ply structure is substantially stable against untwist when torsionally untethered. The method further includes, after the step of setting, unwrapping the two or more individual fibers and/or yarns of different plies in the multi-ply structure to obtain the high-spring-index fiber or yarn.

Implementations of the invention can include one or more of the following features:

The step of setting can include a process selected from the group consisting of thermal annealing, exposure to actinic radiation, exposure of the two or more individual fibers and/or yarns to an absorbed liquid, infiltration of a binding agent into the two or more individual fibers and/or yarns, and combinations thereof.

The step of setting can include a thermal annealing process.

The two or more individual fibers and/or yarns can include a carbon nanotube yarn. The step of setting can include thermal setting comprising an incandescent tensile annealing process.

The two or more individual fibers and/or yarns can include an individual fiber and an individual yarn. At least one of the individual fiber and the individual yarn can be selected from the group consisting of elastomeric polymers, non-elastomeric polymers, metal wires, metal yarns, carbon fibers, carbon yarns, carbon nanotube yarns, and combinations thereof.

The two or more individual fibers and/or yarns can include at least one individual fiber or yarn that has a different characteristic to at least one other individual fiber or yarn. The different characteristic can be selected from the group consisting of a different diameter, a different amount of twist, an opposite chirality of twist, and combinations thereof.

All of the two or more individual fibers and/or yarns can have a same diameter, a same amount of twist, and a same chirality of twist to each of the other two or more individual fibers.

The two or more individual fibers and/or yarns can include a metal wire or yarn.

The metal wire can be a shape-memory metal wire or yarn.

The step of unwrapping the two or more individual fibers and/or yarns can obtain two or more high-spring-index fibers and/or yarns. The two or more individual fibers and/or yarns used in the method can become the two or more high-spring-index fibers and/or yarns extracted from the multi-ply structure.

The two or more individual fibers and/or yarns can include at least one polymer fiber or polymer yarn. The at least one polymer fiber or polymer yarn can include a polymer. The step of setting can include subjecting the at least one polymer fiber or yarn to a first thermal annealing process. The thermal annealing process can be conducted at a temperature above glass transition temperature of the polymer and below melting point of the polymer. The thermal annealing process can be conducted while the multi-plied structure is tethered.

The method can further include, after the step of unwrapping, performing a second thermal annealing process in which the high-spring-index coiled fiber is thermally annealed when not torsionally or positionally tethered.

The second thermal annealing process can be performed at a temperature that is above the glass transition temperature of the polymer, below the melting point of the polymer, and above the temperature of the first thermal anneal process.

Each of the two or more individual fibers and/or yarns can include polymers. Each of two or more individual fibers and/or yarns can be unwrapped from the multi-ply structure as high-spring-index fibers and/or yarns.

The two or more individual fibers and/or yarns can include three or more individual fibers and/or yarns. The step of unwrapping can include that at least two, but not all, of the three or more individual fibers and/or yarns are unwrapped from the multi-ply structure without unwrapping them from one another to obtain the high-spring-index fiber or yarn.

The setting of the multi-ply structure can be region specific, such that different regions of the multi-ply structure are differently set.

The setting can include a region-selected thermal treatment process.

The high-spring-index fiber and/or yarn can have a spring index of at least 2.

The spring index can be at least 2.5.

In general, in another embodiment, the invention features a method that includes selecting a plurality of high-spring-index coiled fibers and/or yarns. Each high-spring-index coiled fiber and/or yarn in the plurality is made by one of the above-described methods. The method further includes fabricating a two-layer textile by incorporating the plurality of high-spring-index coiled fibers and/or yarns into the two-layer textile. The two-layer textile changes insulation when ambient temperature changes.

Implementations of the invention can include one or more of the following features:

The two-layer textile can have a first layer and a second layer. The first layer can have a first-layer inner face and a first-layer outer face. The second layer can have a second-layer inner face and a second-layer outer face. The first-layer inner face and the second-layer inner face can be facing toward one another. The first-layer outer face and the second-layer outer face can be facing away from one another. The incorporating of the plurality of high-spring-index coiled fibers and/or yarns into the two-layer textile can include a tailoring process selected from the group consisting of sewing, stitching, embroidering, weaving, and combinations thereof. A first portion of the high-spring-index coiled fibers and/or yarns can be on or outside the first-layer outer face and a second portion of the high-spring-index coiled fibers and/or yarns can be on or outside the second-layer outer face, such that the high-spring-index coiled fibers and/or yarns can be incorporated as artificial muscles on or outside the first layer and the second layer. The artificial muscles can be either (i) homochiral to increase the insulation of the two-layer textile when the ambient temperature gets colder than a desired temperature or (ii) heterochiral to increase the insulation of the two-layer textile when the ambient temperature gets warmer than the desired temperature.

The two-layer textile can have a first layer and a second layer. The first layer can have a first-layer inner face and a first-layer outer face. The second layer can have a second-layer inner face and a second-layer outer face. The first-layer inner face and the second-layer inner face can be facing toward one another. The first-layer outer face and the second-layer outer face can be facing away from one another. A first portion of the high-spring-index coiled fibers and/or yarns can be on or inside the first-layer inner face and a second portion of the high-spring-index coiled fibers and/or yarns can be on or inside the second-layer inner face, such that the high-spring-index coiled fibers and/or yarns can be incorporated as artificial muscles on or between the first layer and the second layer. The artificial muscles can be either (i) homochiral to increase the insulation of the two-layer textile when the ambient temperature gets warmer than a desired temperature or (ii) heterochiral to increase the insulation when the ambient temperature gets colder than the desired temperature.

In general, in another embodiment, the invention features a method including selecting a first plurality of first two-layer textiles and a second plurality of second two-layer textiles. Each first two-layer textile in the first plurality of two-layer textiles is made by a first method of the above-described methods. Each second two-layer textile in the second plurality of two-layer textiles is made by a second method of the above-described methods. The method further includes fabricating an assembly by incorporating the first plurality of two-layer textiles and the second plurality of two-layer textiles into the assembly. One of the first plurality of two-layer textiles of the assembly and the second plurality of two-layer textiles of the assembly increases insulation of the assembly when ambient temperature gets colder than a desired lower temperature. The other of the first plurality of two-layer textiles of the assembly and second plurality of two-layer textiles of the assembly increases insulation of the assembly when ambient temperature gets warmer than a desired upper temperature.

Implementations of the invention can include one or more of the following features:

The first plurality of two-layer textiles of the assembly can increase insulation of the assembly when ambient temperature gets colder than a desired lower temperature. The second portion of plurality of two-layer textiles of the assembly can increase insulation of the assembly when ambient temperature gets warmer than a desired upper temperature.

In general, in another embodiment, the invention features a method that includes making a high-spring-index coiled fiber or yarn. The method makes the high-spring-index coiled fiber or yarn without using a sacrificial core material whose diameter approximately defines the inner-coil diameter. The method to make the high-spring-index coiled fiber or yarn includes inserting twist separately into two or more individual fibers and/or yarns. The method to make the high-spring-index coiled fiber or yarn further includes plying the two or more individual fibers and/or yarns by inserting plying twist to form a multi-ply structure. The method to make the high-spring-index coiled fiber or yarn includes setting the multi-ply structure without permanently binding together the two or more individual fibers and/or yarns of different plies in the multi-ply structure so that the multi-ply structure is substantially stable against untwist when torsionally untethered. The method to make the high-spring-index coiled fiber or yarn includes, after the step of setting, unwrapping the two or more individual fibers and/or yarns of different plies in the multi-ply structure to obtain the high-spring-index fiber or yarn.

Implementations of the invention can include one or more of the following features:

The two or more individual fibers and/or yarns can include an individual fiber and an individual yarn. At least one of the individual fiber and the individual yarn can be selected from the group consisting of elastomeric polymers, non-elastomeric polymers, metal wires, metal yarns, carbon fibers, carbon yarns, carbon nanotube yarns, and combinations thereof.

The individual yarn in the plied structure can be a carbon nanotube yarn.

The method can further include using the high-spring-index coiled fiber or yarn in a use selected from the group consisting of electrochemical artificial muscles, solvent-driven artificial muscles, mechanical energy harvesters, and self-powered strain sensors.

At least one of the two or more individual fibers and/or yarns of different plies in the multi-ply structure can be a sheath-core fiber or yarn.

The sheath-core fiber or yarn can include a sheath that is electrically conductive.

The sheath can be selected from a group consisting of carbon nanotube sheets, wrapped metal films, and conductive powder coatings.

Plying twist density can be used to vary the spring index of the high-spring-index fiber or yarn.

Plying twist density can be varied along length of the multi-ply structure, so that a high-spring-index coiled fiber or yarn having multiple spring indexes along its length can be obtained.

The spring index can be varied so that a first coil having a first spring index can pass through adjacent second coil having a second spring index in which the first spring index is less than the second spring index.

Essentially all adjacent coils to the first coil can have a spring index greater than the first spring index, such that coil chirality of an actuated coil muscle including the high-spring-index fiber or yarn can transform between homochiral and heterochiral during actuation.

In general, in another embodiment, the invention features a method that includes making a high-spring-index coiled fiber or yarn. The method makes the high-spring-index coiled fiber or yarn without using a sacrificial core material whose diameter approximately defines the inner-coil diameter. The method to make the high-spring-index coiled fiber or yarn includes inserting twist separately into two or more individual fibers and/or yarns. The amount of the twist insert is below a level of twist that results in the coiling of the two or more individual fibers and/or yarns. The method to make the high-spring-index coiled fiber or yarn further includes plying the two or more individual fibers and/or yarns by inserting plying twist to form a multi-ply structure. The amount of plying twist inserted creates coils in the two or more individual fibers and/or yarns of the multi-ply structure. The method to make the high-spring-index coiled fiber or yarn further includes performing a first setting process upon the multi-ply structure to set the coils in the two or more individual fibers and/or yarns of the a multi-ply structure without permanently binding together the two or more individual fibers and/or yarns in the multi-ply structure so that the multi-ply structure is substantially stable against untwist when torsionally untethered. The method to make the high-spring-index coiled fiber or yarn further includes, after the step of setting, unwrapping the two or more individual fibers and/or yarns in the multi-ply structure to obtain the high-spring-index fiber or yarn. The method to make the high-spring-index coiled fiber or yarn further includes, after the step of unwrapping, performing a second setting process in which the high-spring-index coiled fiber is set when not torsionally or positionally tethered.

Implementations of the invention can include one or more of the following features:

The first setting process can include a first annealing process. The second setting process can include a second annealing process.

The high-spring-index coiled fiber or yarn can be a high-spring-index homochiral fiber or yarn.

The high-spring-index coiled fiber or yarn can be a high-spring-index fiber or yarn with multiple twist levels. At least one of the twist levels of the multiple twist levels can have a first spring index. At least a different one of the twist levels of the multiple twist levels can have a second spring index. The first spring index level and the second spring index level can be different spring index levels.

The high-spring-index coiled fiber or yarn can be a high-spring-index homochiral CNT fiber or yarn.

In general, in another embodiment, the invention features a method that includes selecting a high-spring-index coiled fiber or yarn made by one of the above-described methods. The method further includes incorporating the high-spring-index coiled fiber or yarn in a textile.

Implementations of the invention can include one or more of the following features:

The textile can be a comfort adjusting textile that can be used in cold temperatures, hot temperatures, or both.

The high-spring-index coiled fiber or yarn can be a high-spring-index coiled PEC fiber or yarn.

BRIEF DESCRIPTION OF THE DRAWINGS

FIG. 3A shows the 3-ply polymer yarn immediately before the onset of plied yarn buckling or snarling. FIG. 3B shows an individual polymer fiber from the 3-ply polymer yarn shown in FIG. 3A after stabilizing by a first thermal annealing and unplying. FIG. 3C shows the unplied individual polymer fiber of FIG. 3B after a second thermal annealing (the high-spring-index polymer fiber).

FIG. 4 shows the dependence of the contractile stroke and gravimetric work capacity on the tensile stress for the high-spring-index polymer fiber.

FIG. 5A shows the 4-ply polymer yarn immediately before the onset of plied yarn buckling or snarling. FIG. 5B shows the 4-ply polymer yarn after stabilizing by a first thermal annealing with partial unplying. FIG. 5C shows a magnified view of an individual polymer fiber from the 4-ply polymer yarn shown in FIG. 5B. FIG. 5D shows the unplied individual polymer fiber of FIG. 5C after a second thermal annealing (the high-spring-index polymer fiber).

FIG. 6A shows the muscle length change of the high-spring-index polymer fiber. FIG. 6B shows that the high-spring-index polymer fiber provides a contractile stroke when the temperature is increased and an elongational stroke when the temperature is decreased.

FIG. 7 shows the dependence of the contractile stroke and gravimetric work capacity on the actuation temperature for an applied tensile load of 1.13 MPa for the high-spring-index polymer fiber.

FIG. 8A shows the dependence of the contractile stroke on the tensile stress for the high-spring-index polymer fibers derived using different stresses during plying. FIG. 8B shows the dependence of the work capacity on the tensile stress for the high-spring-index polymer fibers derived using different stresses during plying.

FIG. 10A shows the dependence of the contractile stroke on the tensile stress for the high-spring-index polymer fibers. FIG. 10B shows the dependence of the work capacity on the tensile stress for the high-spring-index polymer fibers.

FIG. 11A shows the magnitude of the contractile stroke and elongational stroke for different twist densities of the initial twist. FIG. 11B shows the dependence of the contractile stroke and elongational stroke when the twist density of the initial twist was increased.

FIG. 15A shows incandescent tension anneal process (ITAP) treated 3-ply CNT yarn immediately before the onset of plied yarn coiling. FIG. 15B shows the ITAP-treated, 3-ply CNT yarn of FIG. 15A after anneal with a slight untwist (beginning of unplying). FIG. 15C shows the three unplied individual CNT yarn of FIG. 15B after being unplied (the extracted high-spring-index coiled CNT yarn).

FIG. 17A shows the stress-free contractile stroke of the ply-extracted CNT yarn muscle for increasing applied inter-electrode voltage. FIG. 17B shows the dependence of the contractile stroke and gravimetric work capacity on the tensile stress.

FIG. 18A shows the 2-ply polyurethane yarn after thermal anneal when partially unplied. FIG. 18B shows one of the individual coiled fibers after thermal anneal and extraction.

FIG. 20 shows the dependence of the tensile stroke and gravimetric work capacity on the tensile stress.

FIGS. 21A-21B show tensile stroke and work capacity, respectively, by applying a second anneal for durations of 0, 0.5, 1, 2, 3.4, and 5 hours to ply-extracted fibers. FIG. 21C shows the change in length by applying the second anneal for durations of 0, 0.5, 1, 2, 3.4, and 5 hours to the ply-extracted fibers. FIG. 21D shows a comparison of the work capacity of the ply-extracted fibers after the second anneal to the ply-extracted fibers before the second anneal.

FIG. 25 shows the dependence of the contractile stroke and gravimetric work capacity on the tensile stress.

FIGS. 32A-32B show the dependence of contractile stroke and work capacity, respectively, of coiled fibers with different spring indices on the applied tensile stress during actuation. FIG. 32C shows comparison of maximum contractile strokes and maximum contractile work capacities for the present PEC fibers and self-coiled fibers. FIGS. 32D-32E show the dependencies of the non-loaded tensile strokes of PEC fibers, respectively, on the plying twist density and the product of plying twist density and precursor fiber diameter. FIG. 32F shows the dependence of the non-loaded tensile stroke on the spring index of PEC fibers having different precursor fiber diameters. The actuation temperatures for muscle contraction and expansion in FIGS. 32D-32G were from 25 to 105° C. and from 25 to ~15° C., respectively. FIG. 32G shows the dependencies of contractile stroke and contractile work capacity on the applied tensile stress for different-fiber-diameter PEC muscles having about the same spring index.

FIG. 34A shows a homochiral ply-extracted high-spring-index coiled muscle. FIGS. 34B-34C show the morphing of a bilayer textile as the temperature decreases. FIG. 34D shows the cross-sectional area of the buckling of the bilayer textile as a function of temperature. FIG. 34E is a photograph showing the textile of FIG. 34B-34C that was incorporated between the layers of a comfort adjusting coat.

FIGS. 36A-36G show mandrel-free fabrication of high-spring-index homochiral polyurethane fibers. FIG. 36A is, on the left, a photograph of a partially unplied 2-ply yarn after first thermal annealing at 160° C. for 90 minutes (scale bar 5 mm long) and, on the right, a photograph of the derived ply-extracted polyurethane fiber after the second thermal annealing at 200° C. for 5 minutes (scale bar 1 mm long). FIG. 36B is, on the left, a photograph of a partially unplied 3-ply yarn after first thermal annealing at 160° C. for 90 minutes (scale bar 5 mm long) and, on the right, a photograph of the derived ply-extracted polyurethane fiber after the second thermal annealing at 200° C. for 5 minutes (scale bar 1 mm long). FIG. 36C is, on the left, a photograph of a partially unplied 4-ply yarn after first thermal annealing at 160° C. for 90 minutes (scale bar 5 mm long) and, on the right, a photograph of the derived ply-extracted polyurethane fiber after the second thermal annealing at 200° C. for 5 minutes (scale bar 1 mm long). FIG. 36D is, on the left, a photograph of a partially unplied 5-ply yarn after first thermal annealing at 160° C. for 90 minutes (scale bar 5 mm long) and, on the right, a photograph of the derived ply-extracted polyurethane fiber after the second thermal annealing at 200° C. for 5 minutes (scale bar 1 mm long). FIG. 36E shows dependence of spring index of ply-extracted polyurethane fiber on ply number before and after the second thermal annealing. FIG. 36F shows dependence of contractile stroke of ply-extracted polyurethane fibers (after the second thermal annealing) on the applied tensile stress for a temperature change from −30 to 25° C.

FIG. 37A shows dependence of fiber bias angle on fiber twist density for a 0.28-mm-diameter nylon fiber that was twisted until just before the onset of coiling. FIG. 37B shows dependence of the spring index of 2-ply extracted fibers on the tensile load applied during fiber twist, when measured before and after the second thermal anneal. FIGS. 37C-37D show, respectively, dependencies of the spring index and the coil bias angle of pre-PEC and corresponding PEC fibers on the fiber twist density.

FIG. 38A shows the spring index on the plying twist density. FIG. 38B shows the spring index on the plying twist density multiplied by the precursor fiber diameter. FIG. 38C shows the temperature dependencies of the tensile strokes of 2-ply-extracted PEC muscles having spring indexes of 2.2, 4.6, and 9.9, when the temperature change rate was 1° C./min. The tensile loads applied to these increasing spring index fibers were 4.6 kPa, 0.25 kPa and 0.25 kPa, respectively. FIG. 38D shows the tensile stroke of a 2-ply-extracted PEC muscle having a spring index of ~5.2 during 1800 heating-cooling cycles when under a 0.5 MPa load.

FIGS. 39A-39B are images of single-fiber of 2-ply and 4-ply fibers, respectively, with plying twist densities of 4.5 and 4.0 turns/cm, respectively. FIGS. 39C-39F are images of PEC fibers having spring indexes of: (FIG. 39C) 7.7, (FIG. 39D) 45.2, and (FIG. 39E) 2.6 at the ends and 9.6 in the middle, and (FIG. 39F) which monotonically increase from 2.4 to 18.1.

FIG. 40A shows a fiber-region-separated twist method that was utilized. FIG. 40B shows single fiber has different twist densities in two different fiber regions both before and after removal of the midpoint torsional tether. FIG. 40C shows 2-ply yarn that has different twist densities in two different fiber regions both before and after removal of the midpoint torsional tether.

FIG. 41A shows SEM images of untreated 2-ply CNT yarn, plied yarn after ITAP, and a yarn extracted from the ITAP-treated plied yarn. FIG. 41B shows SEM images of 2-ply yarn after solvent (ethanol) treatment and a yarn extracted from this plied yarn. The scale bars in these SEM images are 100 μm long.

FIG. 42A shows dependence of generated open circuit voltage and resulting capacitance decrease on the tensile strain for self-powered CNT yarn strain sensors. FIG. 42B shows dependence of contractile stroke and work capacity on the tensile stress for methanol-adsorption-driven actuation. FIG. 42C shows dependence of contractile stroke and work capacity on the tensile stress for electrochemically-driven actuation in 0.2 M tetrabutylammonium hexafluorophosphate (TBA·PF6) in propylene carbonate. The applied square-wave voltage between the CNT muscle working electrode and the counter electrode (a Pt-mesh-wrapped buckypaper) was −3.25 V. The 2-ply-extracted CNT yarns used in FIGS. 42A-42B were fabricated by using the ITAP method for setting the 2-ply yarn.)

FIGS. 47A-47C show, respectively, a twisted nylon fiber, a 2-ply fiber, and a sheath core CNT@nylon muscle. Scale bars were 1 mm. FIG. 47D shows contractile stroke on the applied voltage per fiber length for the sheath-core CNT@nylon PEC muscle. FIG. 47E are infrared thermal images during actuation of the sheath-core CNT@nylon PEC muscle.

DETAILED DESCRIPTION

Figure 1:
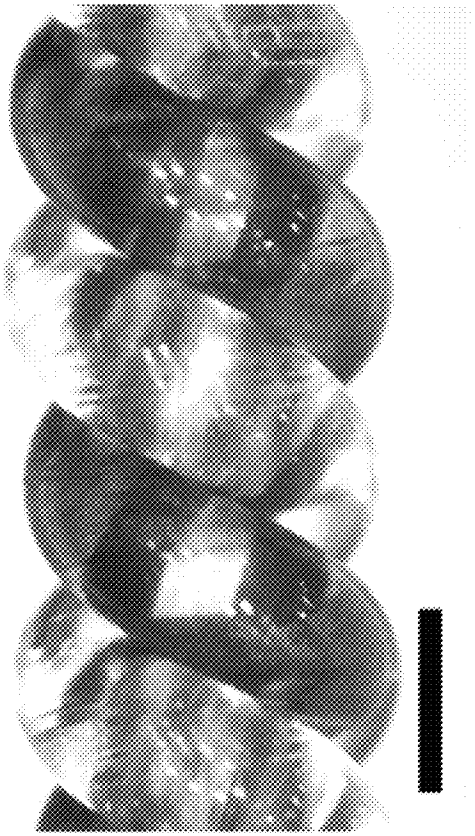
FIG. 1 shows a 2-ply polymer yarn immediately before the onset of plied yarn coiling. The scale bar shown here is 1 mm long.

A method for fabricating coiled polymer fibers that is less expensive to practice, results in a higher perfection product, and can equally well be extended to coiled nanotube fiber yarns that need not include an agent that adhesively binds together the nanofibers in the yarn, so that the yarn does not untwist or uncoil when removed from the mandrel and untethered. This improved method, which eliminates the need for a mandrel, can be quickly applied for applications where high-spring-index thermally-driven artificial muscles are presently employed, such as for presently commercialized comfort-adjusting jackets. [Ralph Lauren January 2022; Bolder Creative 2022].

Instead of using a mandrel to produce high-spring-index fiber muscles, a method for producing these high-spring-index fiber muscles has been discovered that involves fiber or yarn plying and thermal annealing while in the plied state and demonstrate that a related plying method can be used to make large spring index carbon nanotube yarns that either contain a guest or are guest-free. Additionally, this mandrel-free method can be used to provide high-spring-index yarns and fibers of other materials, such as nickel titanium shape-memory wires.

The methods of embodiments of the present invention for fabricating large-spring-index coiled fiber muscles without use of a mandrel can be applied for any of the many polymers that have sufficiently large volume expansion during actuation for use as a fiber muscle. In addition, the fabrication method for embodiments of the present invention can be used for obtaining large spring index fiber muscles for various electrochemically-driven muscles that need not contain a guest. One good example of this is a carbon nanotube (CNT) yarn that is operated electrochemically by using the volume expansion resulting from electrochemical charge insertion in the electrochemical double layers that form upon applying a potential to a coiled CNT yarn. While small spring index CNT yarns can be conveniently made by inserting sufficient twist to produce coiling in a CNT yarn, this will result in a low spring index yarn whose low spring index limits muscle stroke. On the other hand, twist inserted CNT yarns can be conveniently fabricated as plied yarns. While this is a convenient way to obtain coiled yarns having a high-spring-index because of plying, there are no previously known methods for unplying these yarns without collapse of the high-spring-index coiled structure.

Herein, mandrel-free fabrication of high-spring-index polymer fiber yarns are first described and taught, whether or not these yarns contain a single fiber or a multiplicity of fibers. Before plying, each individual polymer fiber or polymer fiber yarn can optionally be twisted to a desired twist density. Unless otherwise mentioned herein, tensile stresses are normalized to the fiber's or yarn's cross-sectional area at the end of twist insertion, or to N-times this area when N fibers or yarns are plied. During the process of plying together N twisted yarns (or N twisted fibers), these typically one-end-tethered yarns (or fibers) are twisted together by adding plying twist. During the practice of this invention, it is typically very useful to thermally anneal the plied yarn before pulling the individual coiled fibers from the plied yarn.

In some embodiments, this thermal annealing can have import for CNT yarns, in order to avoid the collapse of the high-spring-index structure by causing a degree of binding between individual coiled fibers within the plied yarn, but without causing high binding between different coiled yarns within the plied structure. This thermal annealing process for thermally setting plied CNT yarns can use the incandescent tension anneal process (ITAP) that has previously been deployed for twisted and for coiled CNT yarns. [Di 2016; Di '130 Patent]. For some yarn compositions and fabrication methods, it is useful to thermally anneal the ply-extracted yarns one or more times while either non-tethered, tethered torsionally, or tethered both torsionally and in the length direction.

The yarns plied together need not have the same diameter before plying or even contain the same component polymer or nanofiber compositions. In fact, some of the jointly plied yarns can be nanofiber yarns and others can be polymer yarns that need not be nanofiber yarns. Also, the yarns that are plied together can either have the same chirality of inserted twist as the chirality of plying (so they are homochiral) or an opposite chirality of twist (so they are heterochiral). This chirality of plying is identical to the chirality of coiling of the ply-extracted yarn. Also, instead of using thermal setting to retain the coiled structure within the plied structure after yarn extraction from the plied yarn, alternatively, an overcoating structure can be used on the yarns within the ply to retain the coiled structure. Further, alternatively, a combination of an overcoating structure and thermal annealing can be used on the yarns.

Additionally, instead of extracting individual coiled yarns from the plied yarn, more than one yarn can be alternatively extracted from the plied structure, which can have either the same composition and chirality or a different composition or chirality. This use of more than one type of yarn in the plied yarn can enable the simultaneous fabrication of different coiled fiber yarns. Also, extracting two or more neighboring yarns from the plied yarn can provide otherwise unobtainable structures in which polymer coils are well separated by the space originally occupied by presently unextracted yarns.

These coiled yarns that are produced by extraction from the plied yarns can be used for diverse purposes, including as thermally, electrochemically, or material absorption based artificial muscles, as twistocaloric coolers [Wang 2019], and as twistron [Kim 2017] mechanical energy harvesters. These twistocaloric coolers use mechanically-induced entropy changes for refrigeration and these twistron mechanical energy harvesters use stretch-induced, torsionally-induced, or lateral compression-induced changes in the capacitance of conducting nanofibers for converting mechanical energy to electricity.

Again, herein, the discussions and teaching regarding "yarns" and "fibers" related to the present invention can be applied to either yarns or fibers, unless otherwise indicated. When the yarn or fiber is made from a polymer, these can be referred to as a "polymer yarn" or a "polymer fiber."

As for the term "sacrificial core material" (also referred to as a "sacrificial mandrel"), that is a fiber or other material whose only function is to enable the coiling of another yarn/fiber so that it is usually sacrificial in the sense that it is typically removed by such processes, such as by dissolution in a solvent or thermal depolymerization. [Ridley '979 Patent]. This includes that the sacrificial core material/sacrificial mandrel is as a material/mandrel for coiled fiber wrapping that substantially defines the size of the hole within the coiled fiber, but which is sacrificial in the sense that it is not used in the high-spring-index product and is typically removed. In the normal fabrication of a high-spring-index fiber, called mandrel-coiling, the central fiber is usually non-twisted or has a different twist than the fibers being plied.

When the term "tethered" is used, this refers to that both ends of the yarn/fiber are both positionally and torsionally tethered. The term "torsionally tethered" means that opposite fiber ends cannot rotate with respect to each other. The term "positionally tethered" means that opposite fiber ends cannot change their relative position.

The term "spring index" refers to the tightness of the spring's coils. The way to calculate spring index is by dividing (a) the mean diameter of the coils in the spring (outer diameter of the spring minus fiber/yarn diameter or inner diameter of the spring plus fiber/yarn diameter) by (b) the diameter of the fiber/yarn of the spring. A spring with a "high-spring-index" can be more open, with a larger diameter, while a spring with a "low-spring-index" can more closely resemble a tight coil with a small diameter. Generally, having a high-spring-index indicates that the spring index obtained is higher than can obtained by the usual self-coil process wherein a coiled fiber or yarn is produced by inserting twist under a fixed load until the fiber or yarn becomes completely coiled. High-spring-index fibers or yarns generally have a high-spring-index of at least 2, and can have high-spring-index of at least 2.5.

In embodiments of the present invention, the method is for making a high-spring-index fiber or yarn without using a sacrificial core material whose diameter approximately defines the inner-coil diameter. This method includes inserting twist separately into individual fibers or yarns, plying the fibers or yarns by inserting plying twist, setting the ply structure without permanently binding together the fibers or yarns of different plies so that the ply structure is substantially stable against untwist when torsionally untethered, and then unwrapping the plied fibers or yarns so that a high-spring-index fiber or yarn can be obtained. In some embodiments, the unwrapped fibers or yarns are further set so that these are further stabilized.

Improved methods for fabricating coiled polymer fibers and yarns (high-spring-index coiled fiber or yarn) of the present invention are less expensive to practice, result in a higher perfection product, and can equally well be extended to coiled nanotube fiber yarns that need not include an agent that adhesively binds together nanofibers in a yarn, so that the yarn does not untwist or uncoil when removed from the mandrel and untethered. Embodiments of the invention can eliminate the need for a mandrel, and can be quickly applied for applications where high-spring-index thermally-driven artificial muscles are presently employed, such as for presently commercialized comfort-adjusting jackets.

The methods of the present invention are inexpensive mandrel-free processes that provide a new and novel way to address applications where large strokes are required, but the delivered work can be small. For most of the described applications, the input energy is free, since it comes from the environment. This is the case for applications in comfort adjusting clothing and adjustable thermal insulation for buildings that minimize the need for refrigeration and heating by enabling equilibration with outside temperatures only when these temperatures help realize the desired room temperature. Embodiments of the present invention enable the muscle's spring index, and corresponding tensile stroke, to be continuously varied in any desired manner over the entire muscle length, merely by changing the plying twist density during manufacture. Using this method, continuously varied spring index muscles have been made whose segments can contract to zero length when heated and then pass through the coiled structure to invert a homochiral fiber segment to make it heterochiral, and then reverse this chirality transition during fiber cooling, so the original segment length is obtained.

Other key robotic applications require precisely controllable muscle strokes depending upon the input electricity, either for thermally or electrochemically driven actuation. CNT-wrapped polymer fibers were used to manufacture high-spring-index electrically-driven sheath-core CNT@nylon muscles to provide this capability, although other conductor-coated fibers could also be used. The present mandrel-free process can minimize energy use in robots, since the energy supplied need only be sufficient for realizing the required muscle stroke and the delivered mechanical energy. While representative embodiments have focused on nylon-6 fibers and CNT yarns, the mandrel-free process can be applicable to diverse fibers and yarns, as long as the needed mechanical strength, torsional deformability, and structural set-ability can be obtained. Mandrel-free-fabricated high-spring-index CNT yarns were demonstrated for mechanical energy harvesters, self-powered strain sensors, and both solvent-driven and electrochemically-driven artificial muscles that can be used in robotics.

EXAMPLES

The examples provided herein are to illustrate more fully some of the embodiments of the present invention. It should be appreciated by those of skill in the art that the techniques disclosed in the examples which follow represent techniques discovered by the Applicant to function well in the practice of the invention, and thus can be considered to constitute exemplary modes for its practice. However, those of skill in the art should, in light of the present disclosure, appreciate that many changes can be made in the specific embodiments that are disclosed and still obtain a like or similar result without departing from the spirit and scope of the invention.

Example 1

EXAMPLE 1 describes the fabrication of a two-ply polymer yarn in which two fibers have the same diameter and the same chirality. The diameter for these two polymer fibers (nylon-6, fishing line, Eagle Claw Fishing Tackle, Inc.) is 0.28 mm. Unless otherwise mentioned in the examples, the used polymer fiber is nylon-6. Initially, each individual polymer fiber was twist inserted under a tensile load of 18.5 MPa until just below the twist that initiates fiber coiling. These two individual fibers (having the same twist density of 4.4 turns/cm) were torsionally tethered before plying. Here and elsewhere, except when referring to the twist of plying (which is normalized to the twisted fiber's length before plying), the normalizing length corresponds to the length of the non-twisted, non-plied fiber. These fibers were then plied together in the same twist direction as the initial twist to make a 2-ply yarn by using the same tensile load (18.5 MPa), until immediately before the onset of plied yarn coiling (FIG. 1, scale bar: 0.3 mm). To stabilize the plied configuration, this two-end-tethered, 2-ply polymer yarn (having a plying twist density of 4.0 turns/cm) was thermally annealed at ~160° C. in inert atmosphere or vacuum for 2 hours while fully tethered (positionally and torsionally). By unplying the individual polymer fibers through their end rotation from the opposite-end-tethered two-ply thermally annealed polymer yarn, two individual high-spring-index coiled polymer fibers were obtained. Each polymer fiber had a spring index of 1.52 and a coil bias angle of 59.2° and provided a maximum non-loaded contractile stroke of 7.7% when the temperature was increased from room temperature (22° C.) to 98° C., while the coiled fibers were solely torsionally-tethered. For many samples, the size of this contractile stroke can be dramatically increased by actuating at loads that separates the coils of the high-spring-index yarn, so that coil-coil interference does not prematurely interfere with contraction.

Example 2

Figure 2:
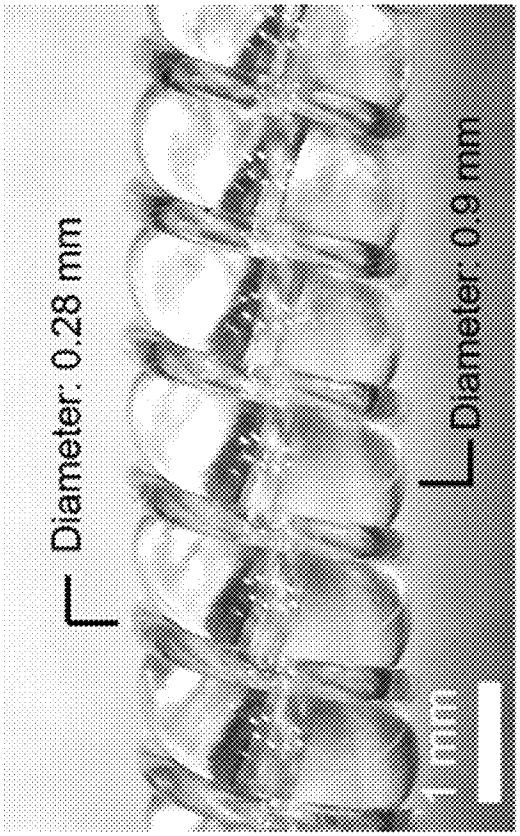
FIG. 2 shows a 2-ply polymer yarn immediately before the onset of plied yarn buckling.

EXAMPLE 2 describes the fabrication of a two-ply nylon-6 yarn in which the two fibers have different diameters. Initially, both the thin fiber (diameter: 0.28 mm) and the thick fiber (diameter: 0.90 mm) were twisted in the same direction until just below the twist that initiates fiber coiling. The applied load during pre-plying twisting for the thin and thick polymer fibers were 18.5 MPa and 7.7 MPa, respectively, and the corresponding twist densities were 4.4 turns/cm and 2.4 turns/cm, respectively. For plying, the applied tensile load for each polymer fiber was the same as that for initial twist. In this case, they were plied together in the same twist direction as initial twist until immediately before the onset of plied yarn buckling (FIG. 2). After thermal annealing at ~160° C. in inert atmosphere or vacuum for 2 hours, the tethering was completely removed, and the individual coiled fibers were extracted from the stabilized 2-ply polymer yarn. This unplying of the individual polymer fibers was through the end rotation of the individual fibers from the opposite-end-tethered two-ply thermally annealed polymer yarn, so two individual high-spring-index coiled polymer fibers were obtained. The thin polymer fiber had a high-spring-index of 7.46 and a coil bias angle of 77.8°, and provides a maximum non-loaded contractile stroke of 57.4% when the temperature was increased from room temperature (22° C.) to 70° C. The thick polymer fiber had a spring index of 2.2 and a coil bias angle of 74.6°, and provides a maximum non-loaded contractile stroke of 10% when the temperature was increased from room temperature (22° C.) to 70° C.

Example 3

Figures 3A, 3B, 3C:
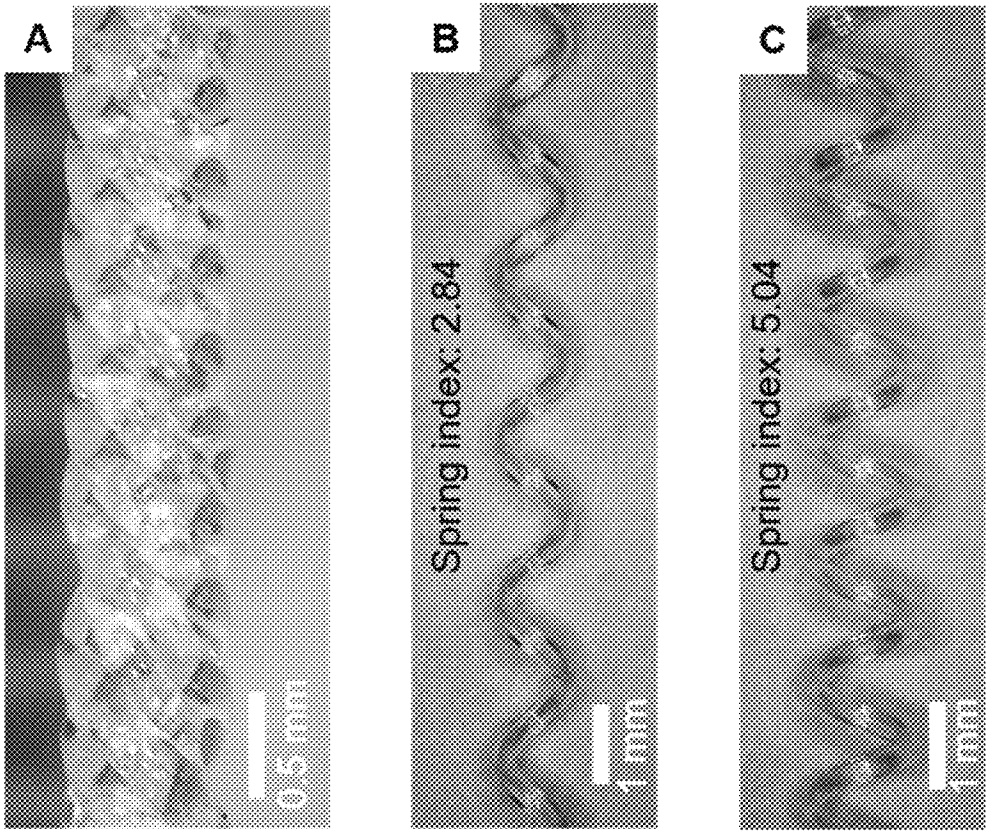
FIGS. 3A-3C show fabrication of a high-spring-index polymer fiber from a 3-ply polymer yarn.

EXAMPLE 3 describes the fabrication of a three-ply nylon-6 yarn in which all fibers have the same diameter (0.28 mm) and the same chirality as the chirality of plying. Prior to plying, each of these fibers were isobarically twisted, meaning twisted under the same load, until just below the twist that initiates fiber coiling. The tensile load and twist density for each individual polymer fiber were 18.5 MPa and 4.4 turns/cm. Then, they were plied together under a tensile load of 47.8 MPa in the same twist direction as the initial twist until immediately before the onset of plied yarn buckling or snarling (FIG. 3A). The two-end-tethered plied polymer yarn (having a plying twist density of 6.2 turn/cm) was stabilized by thermal annealing at ~110° C. in vacuum for 1.5 hours (FIG. 3B). By unplying the individual polymer fibers through their end rotation from the opposite-end-tethered three-ply thermally annealed polymer yarn, three individual high-spring-index coiled polymer fibers were obtained, which were free-standing since they were neither torsionally nor positionally tethered. Since a large ply number typically increases the separation between coils in an individual fiber, a second thermal annealing step was applied while the plied yarn or fiber was non-tethered to decrease this coil separation and enable the fiber to provide reversable muscle actuation. After the first thermal annealing, the non-tethered ply-extracted fibers were annealed at 115° C. in air for 20 seconds (FIG. 3C). The room-temperature length of each of the final ply-extracted fibers decreased by about 60% (relative to the coiled fiber length before the second thermal annealing). Each individual fiber had a high-spring-index of 5.04 and a coil bias angle of 65.7°, and provided a maximum non-loaded contractile stroke of 26.2% when the temperature was increased from room temperature (22° C.) to 105° C.

Example 4

Figure 4:
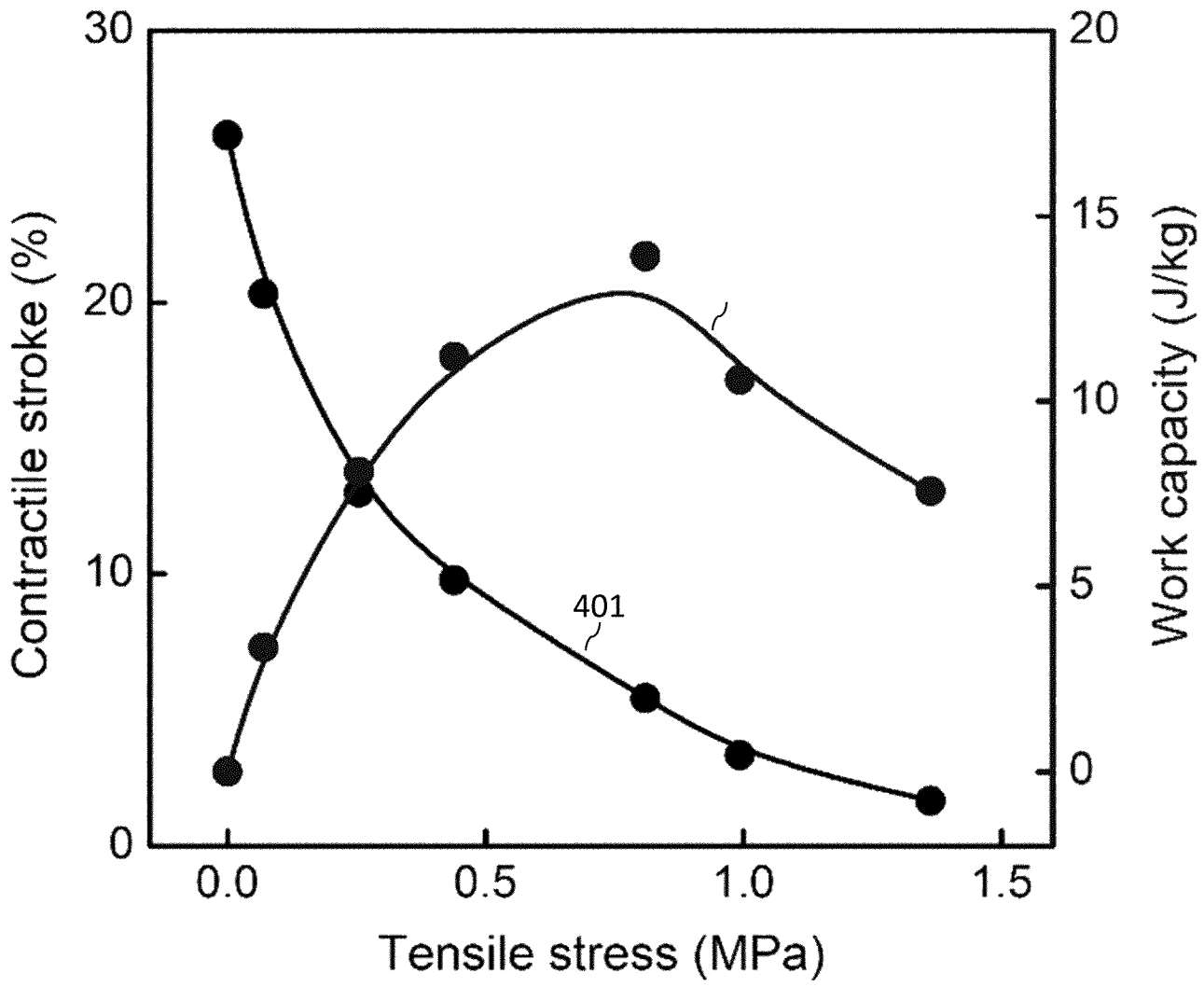
FIG. 4 shows the performance of the high-spring-index polymer fiber shown in FIG. 3C as a thermally driven artificial muscle.

EXAMPLE 4 shows that the performance of a high-spring-index polymer fiber of EXAMPLE 3 as a thermally driven artificial muscle. FIG. 4 shows the dependence of the contractile stroke and gravimetric work capacity on the tensile stress when the temperature was increased from 22 to 105° C. While the contractile stroke of the high-spring-index polymer fiber monotonically decreases with increasing tensile stress (plot 401), the contractile work capacity reached a peak of 13.9 J/kg when a tensile stress of 0.81 MPa was applied during actuation (plot 402).

Example 5

Figures 5A, 5B, 5C, 5D:
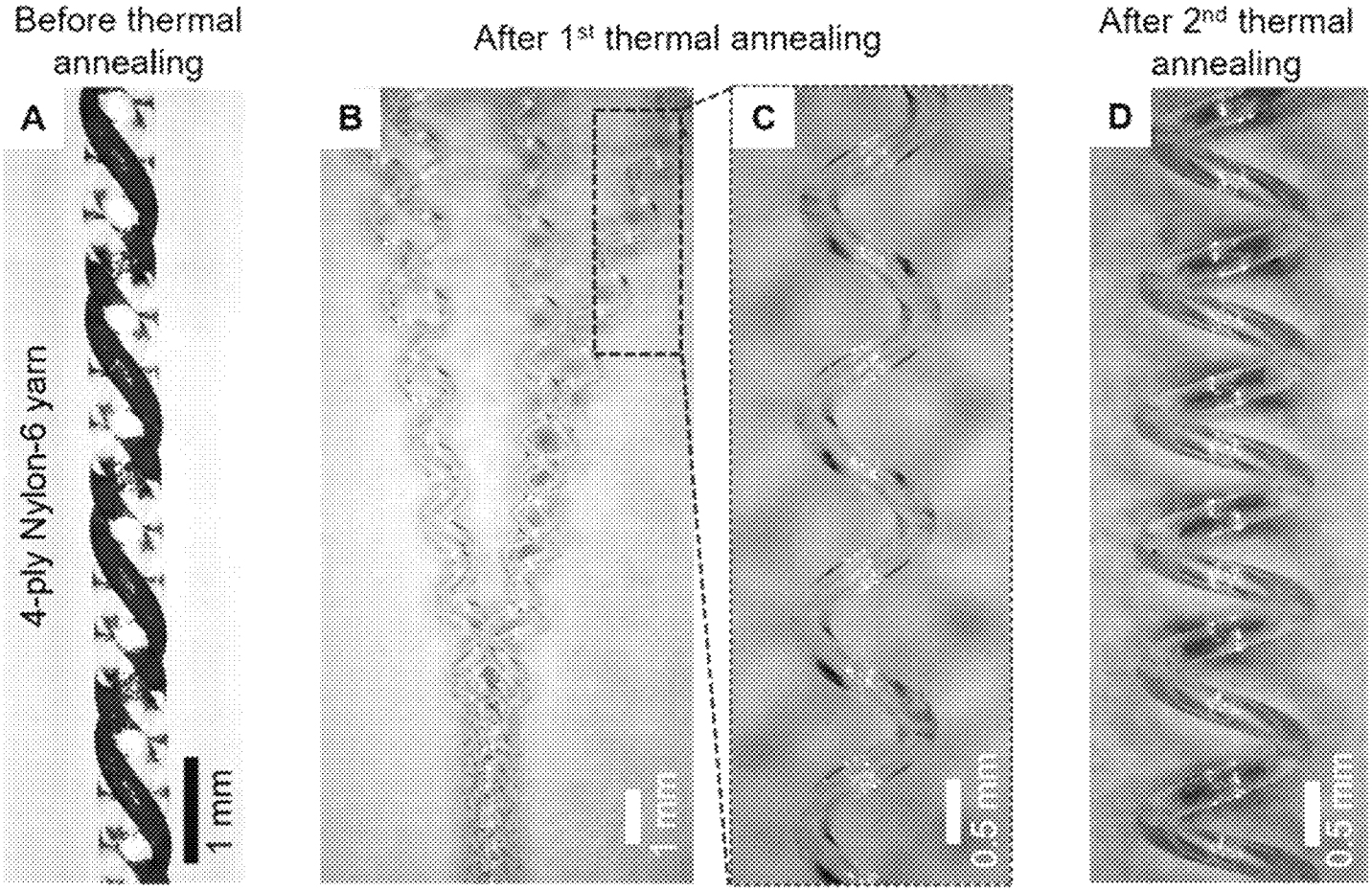
FIGS. 5A-5D show fabrication of a high-spring-index polymer fiber from a 4-ply polymer yarn.

EXAMPLE 5 describes the fabrication of a four-ply nylon-6 yarn in which all fibers have the same diameter (0.28 mm) and the same chirality as the chirality of plying, as well as the use of this 4-ply yarn for making 4 high-spring-index coiled fibers that are not plied. Prior to plying, each of these fibers were isobarically twisted until just below the twist that initiates fiber coiling. The tensile load and twist density for each individual polymer fiber were 18.5 MPa and 4.4 turns/cm. Then, these fibers were plied together under a tensile load of 46.2 MPa in the same twist direction as their initial twist until immediately before the onset of plied yarn buckling or snarling (FIG. 5A). The two-end-tethered plied polymer yarn (having a plying twist density of 4.0 turn/cm) was stabilized by a thermal anneal in vacuum at ~110° C. for 1.5 hours (FIG. 5B-5C). After this first thermal anneal, the non-tethered ply-extracted fibers were annealed at 115° C. in air for 20 seconds. The room-temperature-length of each of the final ply-extracted fibers decreased by about 60% (relative to the coiled fiber length before the second thermal annealing) (FIG. 5D). Each individual fiber had a high-spring-index of 6.96 and a coil bias angle of 74.2°.

Example 6

Figure 6B:
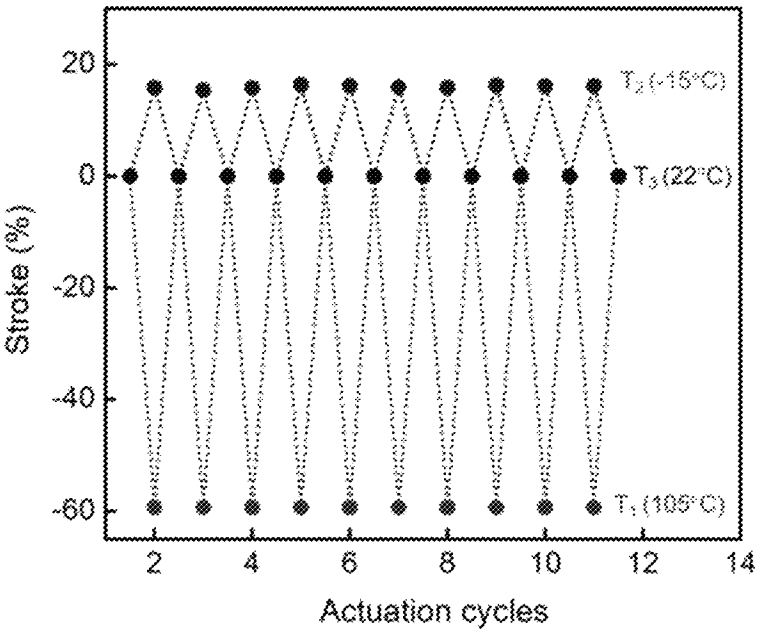
FIGS. 6A-6B show the performance of the high-spring-index polymer fiber shown in FIG. 5D as a thermally-driven artificial muscle.
Figure 6A:
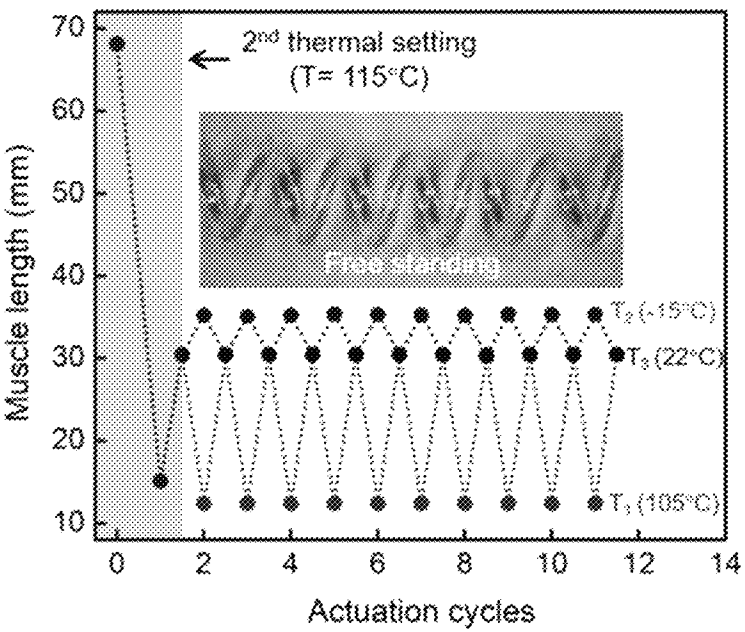

EXAMPLE 6 shows the performance of a high-spring-index polymer fiber of EXAMPLE 5 as a thermally-driven artificial muscle. FIG. 6A shows the muscle length change of a coiled fiber that had been extracted from a thermally annealed 4-ply yarn, during a process that first involves a second annealing process at 115° C. in air for 20 seconds and then involves reversible actuation between-15 and 22° C. and between 22 and 105° C. for 10 cycles. The length of the ply-extracted fiber decreased from 68.1 to 18.0 mm during the second thermal annealing, and then elongated to 30.4 mm when the temperature fell to room temperature (22° C.). This thermally-annealed, ply-extracted fiber is a torsionally-stable free-standing muscle, which undergoes reversible tensile thermal actuation without the need for torsional tethering. FIG. 6B shows that the non-loaded, thermally-annealed, ply-extracted fiber provides a contractile stroke of 59.3% when the temperature increased from 22° C. to 105° C., and provides an elongational stroke of 16.1% when the temperature decreased from 22° C. to −15° C.

Example 7

Figure 7:
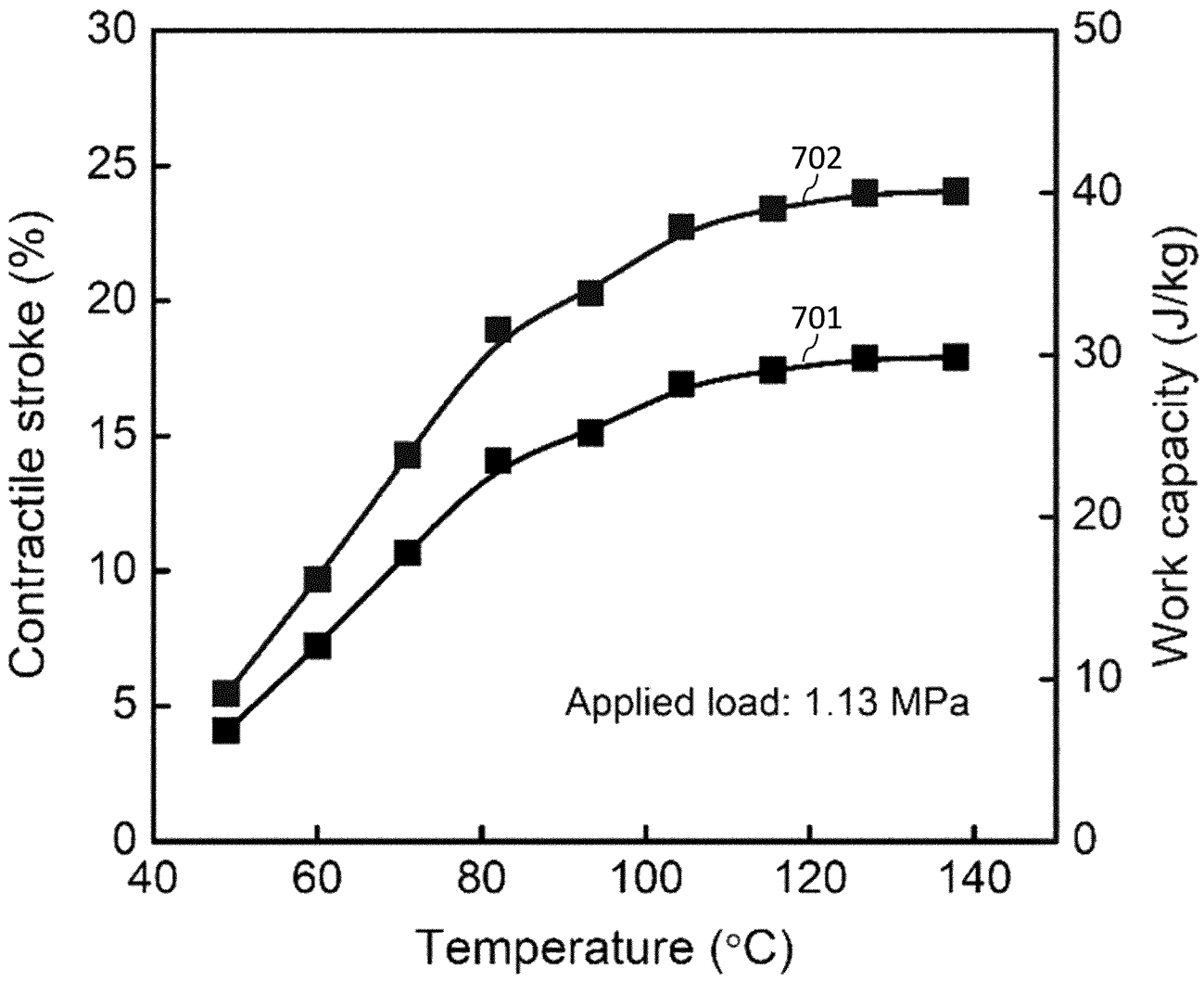
FIG. 7 shows the performance of the high-spring-index polymer fiber shown in FIG. 5D as a thermally driven artificial muscle.

EXAMPLE 7 shows the performance of a high-spring-index polymer fiber of EXAMPLE 5 as a thermally-driven artificial muscle. FIG. 7 shows that both the contractile stroke (plot 701) and the work capacity (plot 702) of the thermally-annealed, ply-extracted fiber of EXAMPLE 5 increases with increasing actuation temperature, and approach plateaus when the actuation temperature exceeds 100° C., due to inter-coil contact. For these tests, a tensile stress of 1.13 MPa was applied to this fiber muscle during actuation. The maximum contractile work capacity of this high-spring-index fiber muscle was about 30 J/kg.

Example 8

EXAMPLE 8 describes the fabrication of four-ply polymer yarns by applying different tensile loads for plying. The diameter for each individual polymer fiber is 0.28 mm. Before plying, all polymer fibers had the same diameter, the same twist density, and the same chirality, and were fabricated by using the method of EXAMPLE 5. Here, a tensile load of either 18.5, 32.3, 46.2, or 60.0 MPa was applied to the polymer yarns during plying. Then, the same first thermal annealing for the plied yarns (which had the same plying twist density of 4.0 turns/cm) and the same second thermal annealing for the ply-extracted fibers of EXAMPLE 5 was used for these polymer yarns. The spring indices (and coil bias angles) for these thermally-annealed ply-extracted fiber muscles were 6.46 (74.6°), 6.73 (74.8°), 6.96 (74.2°) and 8.02 (74.8°), when the plying twist load was 18.5, 32.3, 46.2 and 60.0 MPa, respectively.

Example 9

Figure 8B:
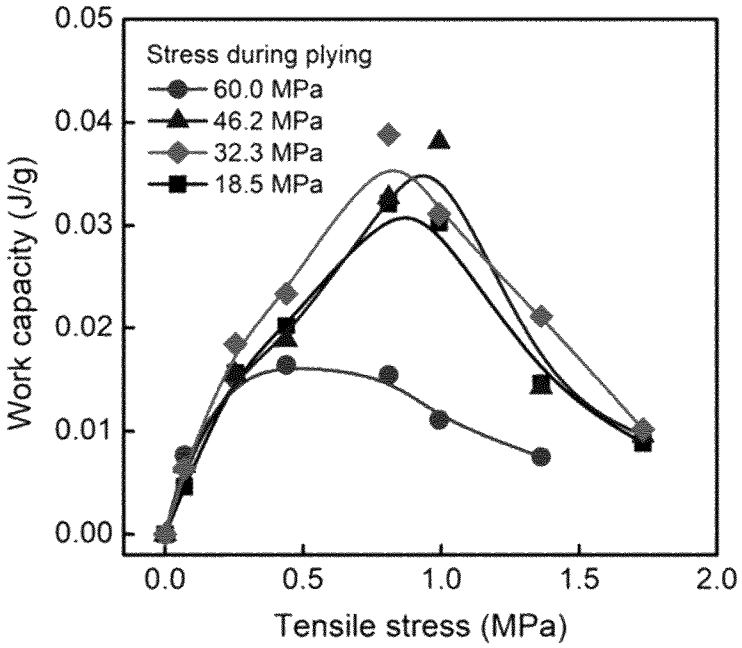
FIGS. 8A-8B shows the actuation performance of ply-extracted high-spring-index polymer fibers when the temperature was increased from room temperature to 105° C.
Figure 8A:
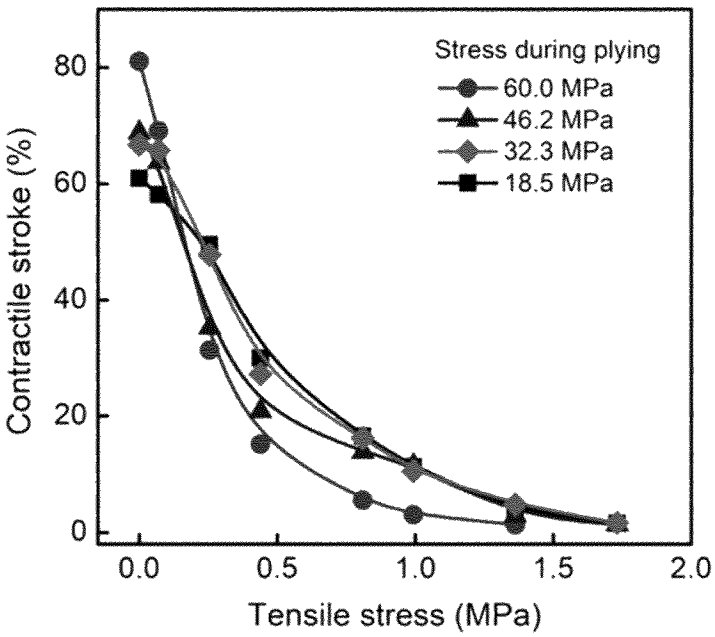

EXAMPLE 9 shows the actuation performance of the ply-extracted high-spring-index polymer fibers of EXAMPLE 5 and EXAMPLE 8 when the temperature was increased from room temperature (22° C.) to 105° C. FIG. 8A shows that the magnitude of the contractile stroke of these polymer fiber muscles decreases monotonically when the tensile stress during actuation increases from 0 to 1.4 MPa, and approaches zero when the tensile stress exceeds 1.5 MPa. Correspondingly, FIG. 8B shows the dependence of work capacity on tensile stress for the above investigated tensile stress range. When a tensile stress of 0.81 MPa was applied during actuation, the thermally-annealed ply-extracted fiber muscle fabricated using a plying load of 32.3 MPa provided the maximum contractile work capacity (38 J/kg).

Example 10

EXAMPLE 10 describes the fabrication of four-ply polymer yarns by applying different tensile loads for the initial pre-plying twist. The diameter for each individual polymer fiber before twisting was 0.28 mm. Here, tensile loads of 18.5, 36.9, 73.9, and 110.8 MPa were applied on the polymer fiber during this initial twist. All these polymer fibers had the same twist density of 4.4 turns/cm and the same chirality before plying. Then, the same method of EXAMPLE 10 was used for polymer fibers plying, thermal annealing of the plied yarns, and for extracting coiled polymer fibers from the plies. Before thermal annealing, these plied polymer yarns were plied to a twist density of 4.0 turns/cm under a plying tensile load of 32.3 MPa. The spring indices (and coil bias angles) for these thermally-annealed ply-extracted fiber muscles were 6.73 (74.8°), 6.31 (78.87°), 5.18 (81.05°) and 5.0 (85.3°), when the initial twist load was 18.5, 36.9, 73.9 and 110.8 MPa, respectively.

Example 11

Figure 9:
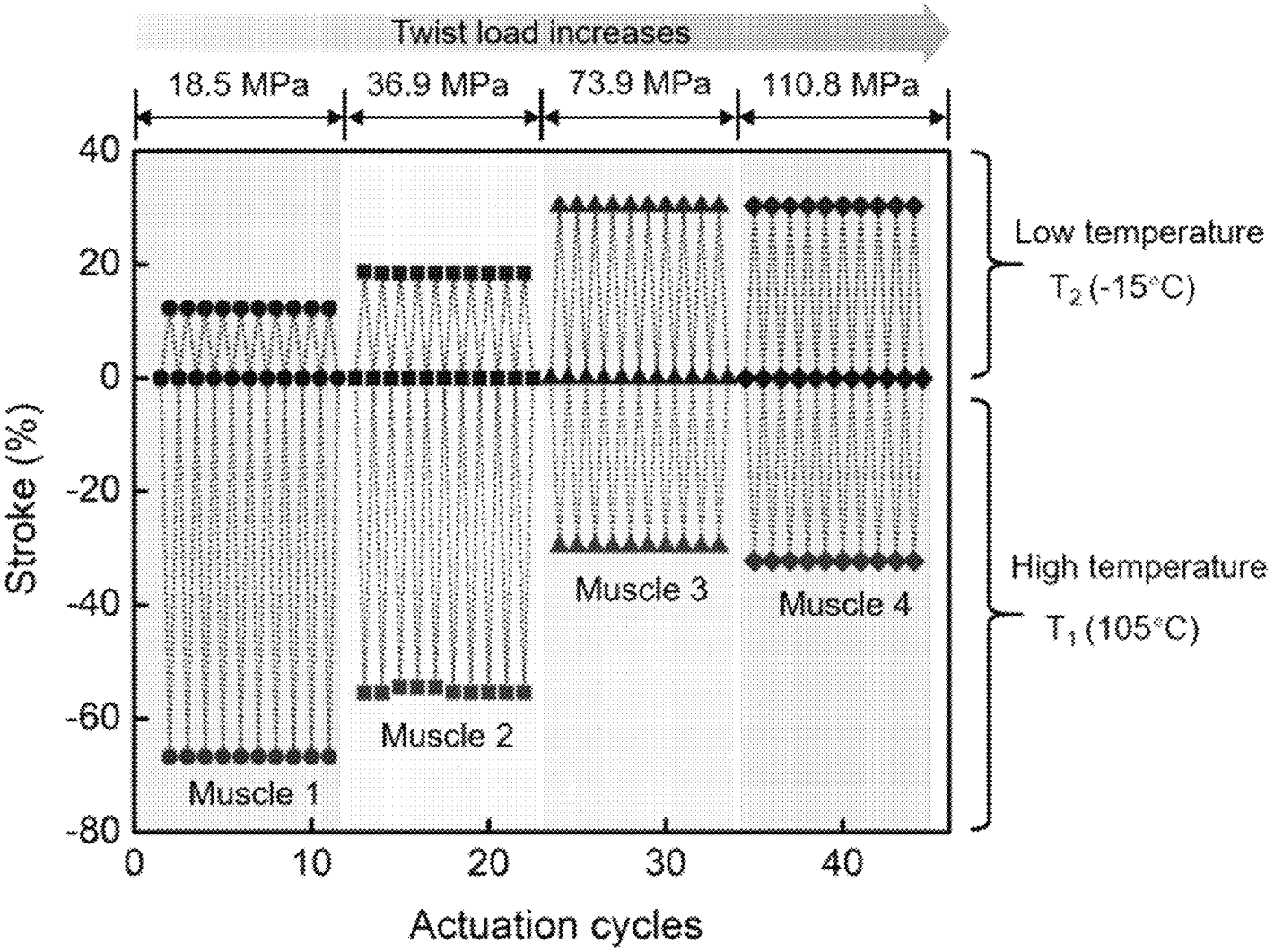
FIG. 9 shows actuation cycles for ply-extracted high-spring-index polymer fibers made using different applied fiber twist load during twist insertion when the temperature was increased from room temperature to 105° C. to provide a contraction and decreased from room temperature to −15° C. to provide an elongation.

EXAMPLE 11 shows the magnitude of actuation for the ply-extracted high-spring-index polymer fibers of EXAMPLE 10 when the temperature was increased from room temperature (22° C.) to 105° C. to provide a contraction and decreased from room temperature (22° C.) to −15° C. to provide an elongation. When the applied twist load for initial twist increased from 18.5 to 73.9 MPa, the elongational stroke of the ply-extracted muscles on going from 22° C. to −15° C. increased by a factor of 2.47, while the contractile stroke on going from 22° C. to 105° C. decreased by a factor of 2.25 (FIG. 9). Therefore, the applied twist load for initial twist can be used to control the maximum actuation strokes of the ply-extracted polymer muscles. However, when much higher tensile loads are used for twist insertion, the sensitivity of stroke to this load and on this temperature change become small. For a load during twist of 73.9 MPa, the ply-extracted muscle provided almost the same elongational stroke (30.4% for this 37° C. temperature decrease) as the contractile stroke (29.6% for this 83° C. temperature increase) for a much larger temperature change. Also, when using an even higher load during twist of 110.8 MPa, the elongational stroke (30.4% for this 37° C. temperature decrease) and the contractile stroke (32.2% for this 83° C. temperature increase) of the ply-extracted muscle were nearly the same as for a twist load of 73.9 MPa.

Example 12

Figure 10B:
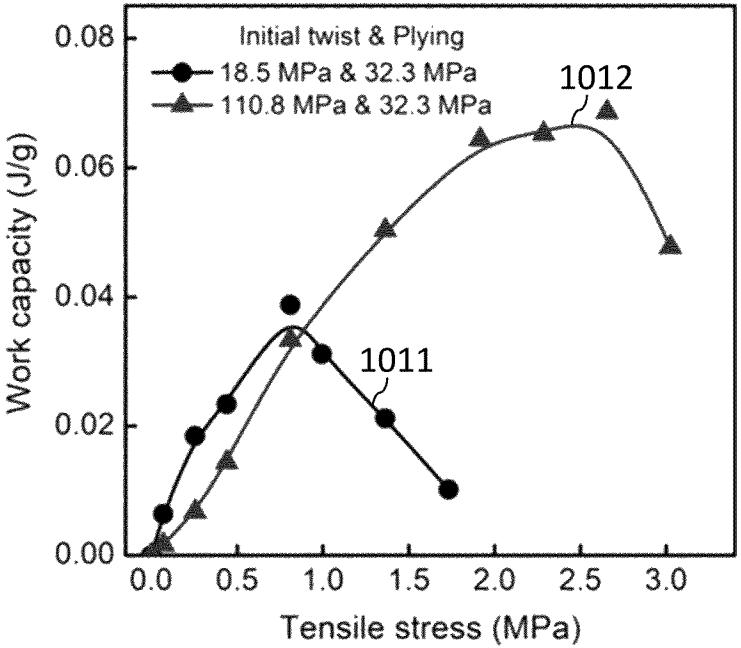
FIGS. 10A-10B shows the actuation performance of ply-extracted high-spring-index polymer fibers made from a 4-ply yarn in which different stresses were applied during twist insertion but the same stress was applied during plying. The temperature was increased from room temperature to 105° C. to provide a contraction.
Figure 10A:
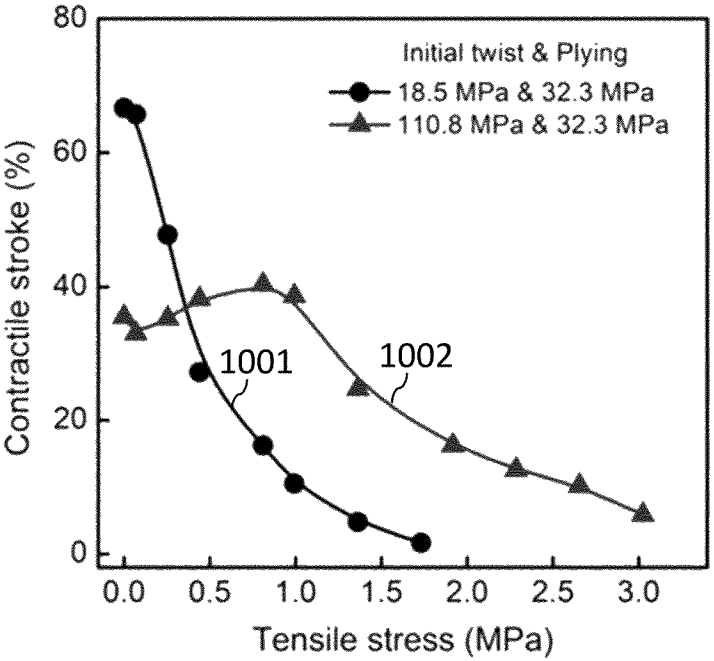

EXAMPLE 12 compares the tensile stress dependence of the actuator performance of the high-spring-index coiled muscles that were made in EXAMPLE 10 for a temperature change from 22 to 105° C. This comparison is for coiled polymer muscles that were made from 4-ply yarn that had the same stress applied during plying (32.3 MPa) and a quite different stress during twist insertion (18.5 and 110.8 MPa) (FIGS. 10A-10B). The muscle made from the 4-ply yarn that had an 18.5 MPa stress during twisting had a contractile stroke (plot 1001) that monotonically decreased with increasing tensile stress from 68% at zero stress to nearly 0% at 1.7 MPa and a maximum contractile work capacity (plot 1011) of 40 J/kg that peaked for a 0.85 MPa tensile stress during actuation. In contrast, the coiled polymer muscle that was made from the 4-ply yarn that had a 110.8 MPa stress during twisting had a maximum contractile stroke (plot 1002) of 41% that peaked at 0.85 MPa tensile stress during actuation and a maximum contractile work capacity (plot 1012) of 68.6 J/kg that peaked at 2.7 MPa tensile stress during actuation.

Example 13

EXAMPLE 13 describes the fabrication of four-ply polymer yarns by applying different twist densities for the initial pre-plying twist. The diameter for each individual polymer fiber before twisting was 0.28 mm. Here, twist densities of 0.16, 1.56, 3.12, 4.0, 4.40, 5.31, and 6.25 turns/cm were applied on the polymer fiber during this initial twist. All these polymer fibers had the same twist load of 110.8 MPa and the same chirality before plying. Then, these polymer yarns with the same twist density were plied to a plying twist density of 4.0 turns/cm under a plying tensile load of 32.3 MPa. Here, the method of EXAMPLE 5 was used for thermal annealing the plied yarns and for extracting coiled polymer fibers from the plies.

Example 14

Figure 11A:
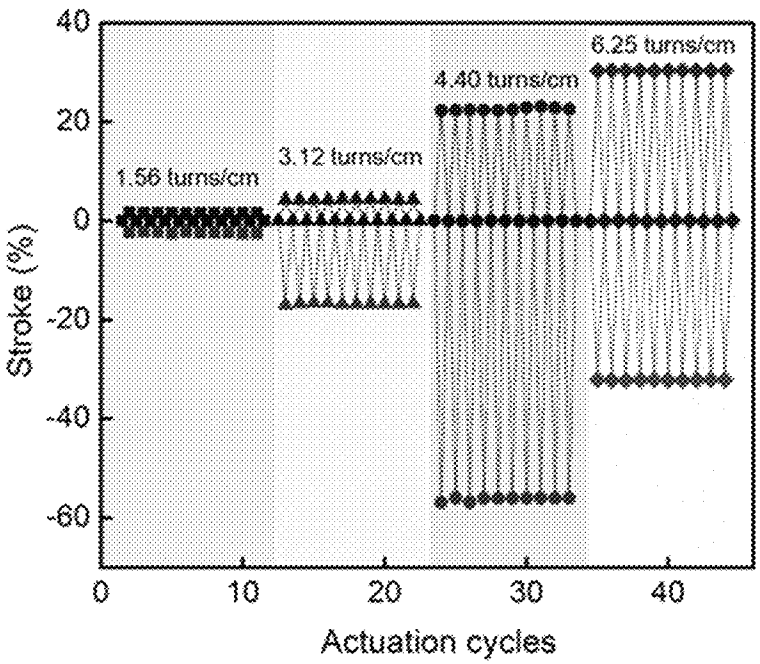
FIGS. 11A-11B shows actuation for ply-extracted high-spring-index polymer fibers at different twist densities of the initial twist.
Figure 11B:
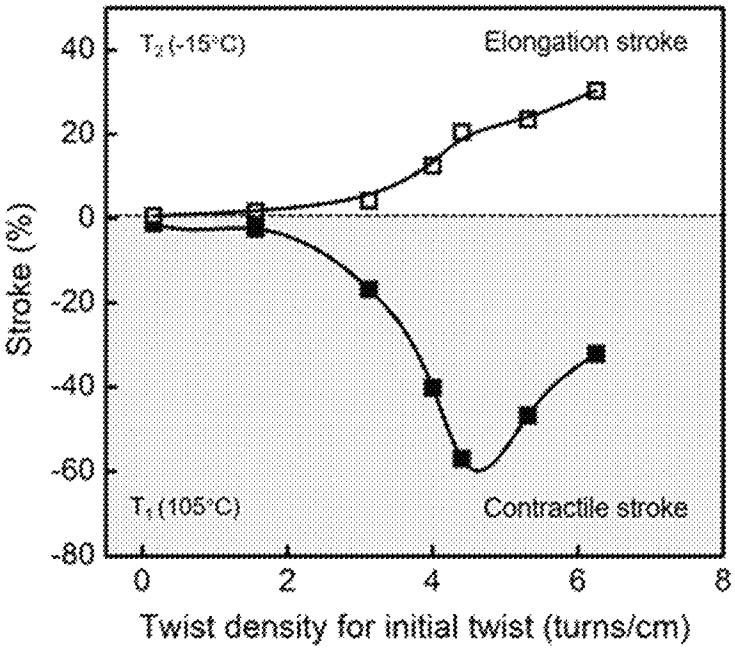

EXAMPLE 14 shows the magnitude of actuation (when no load was applied) for the ply-extracted high-spring-index polymer fibers of EXAMPLE 13 when the temperature was increased from room temperature (22° C.) to 105° C. to provide a contraction and decreased from room temperature (22° C.) to −15° C. to provide an elongation. When the twist density for initial twist was increased from 0.16 to 6.25 turns/cm, the elongational stroke of the ply-extracted muscles on going from 22° C. to −15° C. increased from 0.6 to 30.4%, while the contractile stroke on going from 22° C. to 105° C. reached a peak of 46.7% at a twist density of 5.31 turns/cm (FIGS. 11A-11B). Therefore, the applied twist density for initial twist can be used to maximize the actuation stroke of the ply-extracted polymer muscles. When much higher fiber twist densities (>6.25 turns/cm) were used for twist insertion, one or more individual highly twisted polymer fibers fractured during plying. Therefore, a twist density of 6.25 turns/cm was used as the maximum twist density during twist insertion for these polymer fibers under the fabrication conditions of EXAMPLE 13.

Example 15

EXAMPLE 15 describes the effect of varying the second annealing temperature on the performance of a four-ply-extracted coiled fiber. The diameter of each individual polymer fiber before twisting was 0.28 mm. For initial pre-plying twist insertion, each individual polymer fiber was twisted to a twist density of 3.12 turns/cm under a tensile load of 110.8 MPa. Then, these twisted polymer fibers were plied to a plying twist density of 4.0 turns/cm under a plying tensile load of 32.3 MPa. After the first thermal annealing in vacuum at ~110° C. for 1.5 hours, the tethering was completely removed, and the individual coiled fibers were extracted from the stabilized 4-ply polymer yarn. Then, the non-tethered ply-extracted fibers were divided into two parts, one part were annealed in air at 115° C. for 20 seconds and the other part were annealed in air at 150° C. for 20 seconds. The ply-extracted coiled fibers undergoing a second anneal at 115° C. had a high-spring-index of 6.31 and a coil bias angle of 62.0°, while the other ply-extracted coiled fibers undergoing a second anneal at 150° C. had a high-spring-index of 8.69 and a coil bias angle of 72.7°.

Example 16

Figure 12:
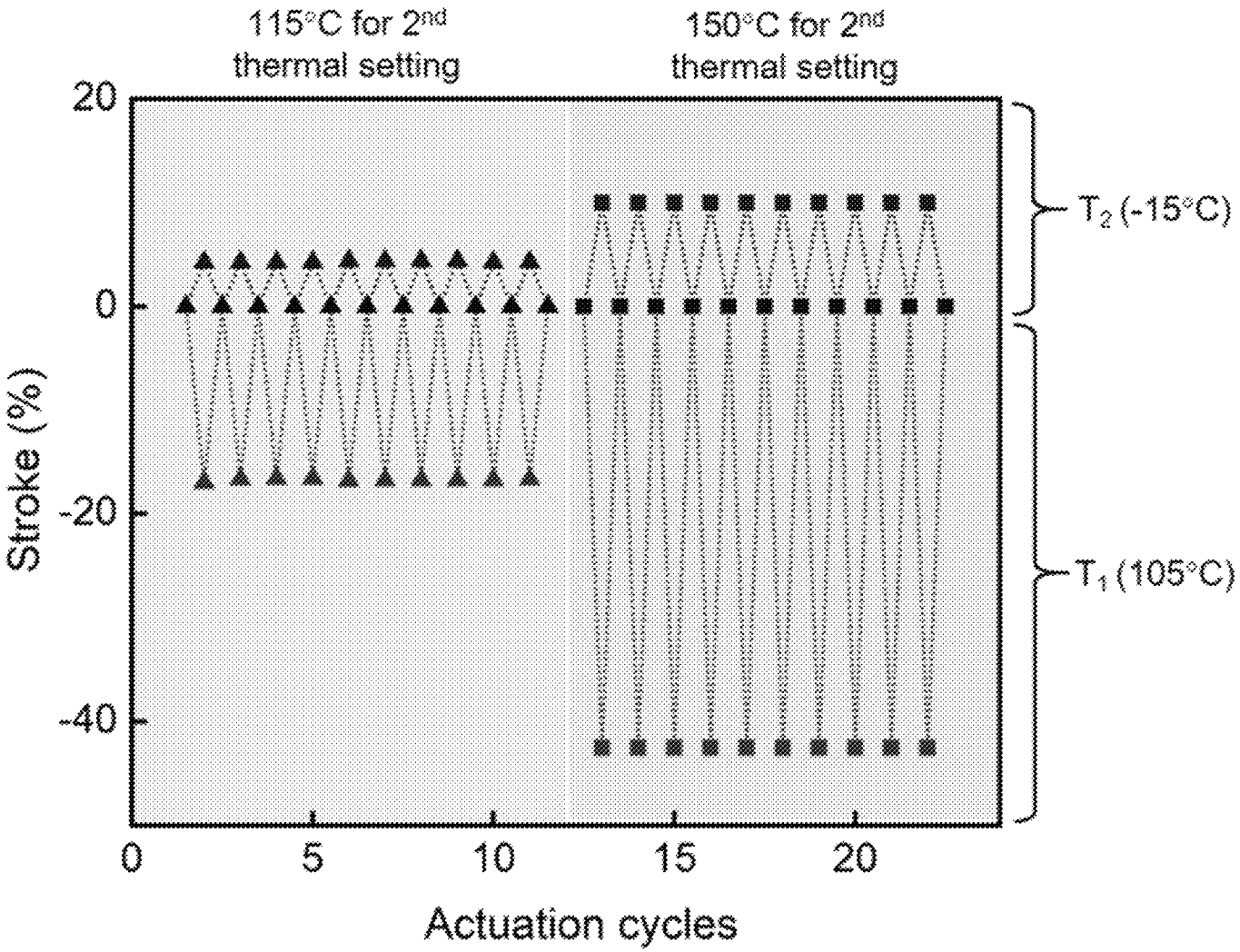
FIG. 12 shows actuation cycles for ply-extracted high-spring-index polymer fibers annealed at different second annealing temperatures.

EXAMPLE 16 shows the magnitude of actuation for the ply-extracted high-spring-index polymer fibers of EXAMPLE 15 when the temperature was increased from room temperature (22° C.) to 105° C. to provide a contraction and decreased from room temperature (22° C.) to −15° C. to provide an elongation. The ply-extracted coiled fiber undergoing a second anneal at 150° C. provided a reversible contractile stroke of 42.5% for a temperature increase from 22° C. to 105° C., which was 2.5 times that of ply-extracted coiled fibers undergoing a second anneal at 115° C. In addition, the maximum elongational stroke of the ply-extracted coiled fiber undergoing a second anneal at 150° C. was 10.0% for a temperature decrease from 22° C. to −15° C., while the maximum elongational stroke of the ply-extracted coiled fiber undergoing a second anneal at 115° C. was 4.4% (FIG. 12).

Example 17

Figure 13:
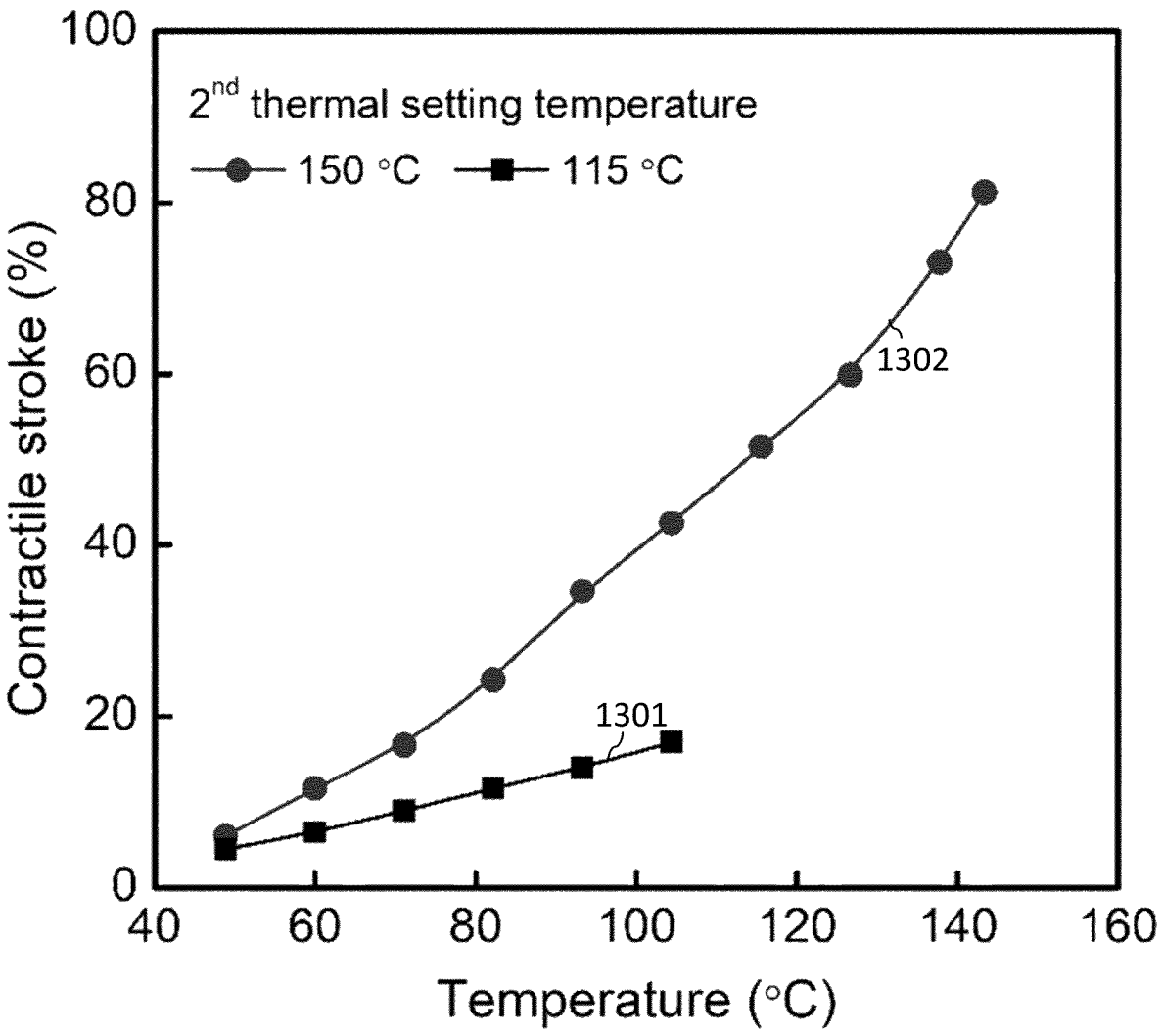
FIG. 13 shows actuation temperature dependence of the non-loaded contractile stroke of ply-extracted high-spring-index polymer fibers during actuation for fibers exposed to a second thermal setting temperature of either 115 or 150° C.

EXAMPLE 17 shows the temperature dependence of the non-loaded contractile stroke of the ply-extracted high-spring-index polymer fibers of EXAMPLE 15 during actuation. The contractile stroke of both coiled polymer fibers increased monotonically with increasing actuation temperature. The ply-extracted coiled fiber undergoing a second anneal at 115° C. (plot 1301) provided a maximum reversible contractile stroke of 17.0% at 105° C., while the ply-extracted coiled fiber undergoing a second anneal at 150° C. (plot 1302) provided a contractile stroke of 42.5% at the same actuation temperature and a maximum contractile stroke of 81.2% when temperature was increased from 22 to 143° C. (FIG. 13). This result indicates that an optimized temperature during thermal annealing can be used to maximize the actuation stroke of the ply-extracted polymer muscles.

Example 18

Figure 14A:
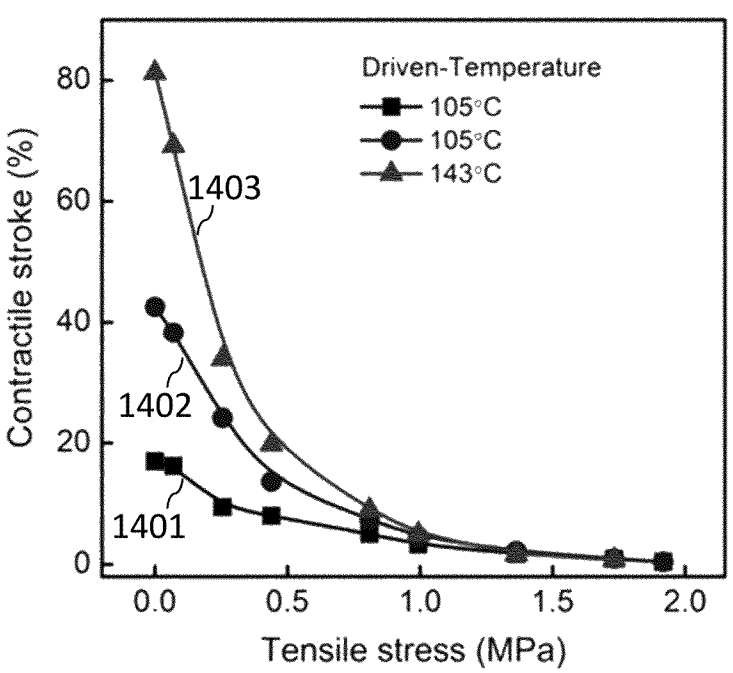
FIGS. 14A-14B show the tensile stress dependence of the contractile stroke and contractile work capacity, respectively, of ply-extracted high-spring-index polymer fibers during actuation for different second annealing temperatures or different driven temperatures.
Figure 14B:
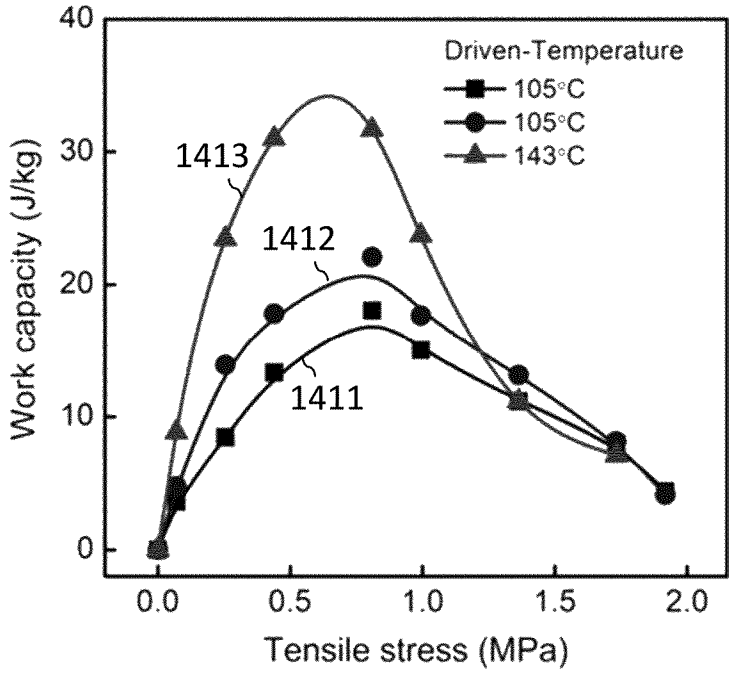

EXAMPLE 18 shows the tensile stress dependence of the contractile stroke and contractile work capacity of the ply-extracted high-spring-index polymer fibers of EXAMPLE 15 during actuation. The contractile stroke of these coiled polymer fibers which undergo either a second anneal at 115° C. or at 150° C. decreased monotonically with increasing tensile stress. In this case, the temperature was increased from 22 to 105° C. for the ply-extracted coiled fibers undergoing either a second anneal at 115° C. (plot 1401) or at 150° C. (plot 1402) (FIG. 14A). In addition, the temperature was increased from 22 to 143° C. for the ply-extracted coiled fiber undergoing a second anneal at 150° C. (plot 1403). When a tensile stress of 0.81 MPa was applied, the ply-extracted coiled fiber undergoing a second anneal at 115° C. provided a maximum contractile work capacity of 18.0 J/kg at 105° C. (plot 1411), while the ply-extracted coiled fiber undergoing a second anneal at 150° C. (plot 1412) provided a contractile work capacity of 22.1 J/kg for the same actuation temperature and a maximum contractile work capacity of 31.7 J/kg when temperature is increased from 22 to 143° C. (plot 1413) (FIG. 14B).

Example 19

Figure 15A:
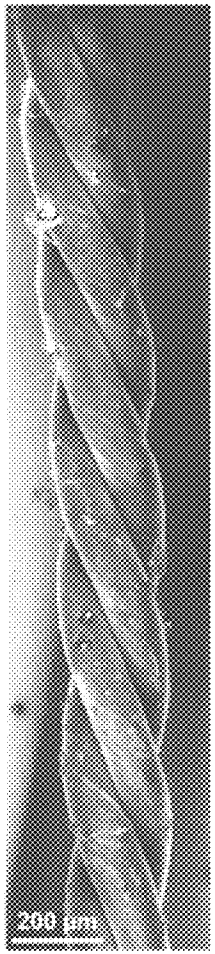
FIGS. 15A-15C show fabrication of a high-spring-index CNT yarn from a 3-ply CNT yarn.
Figure 15B:
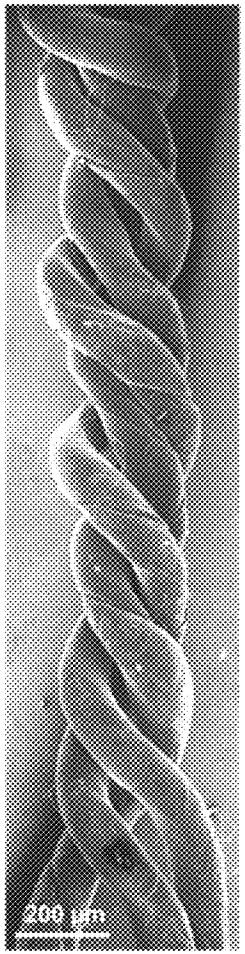
Figure 15C:
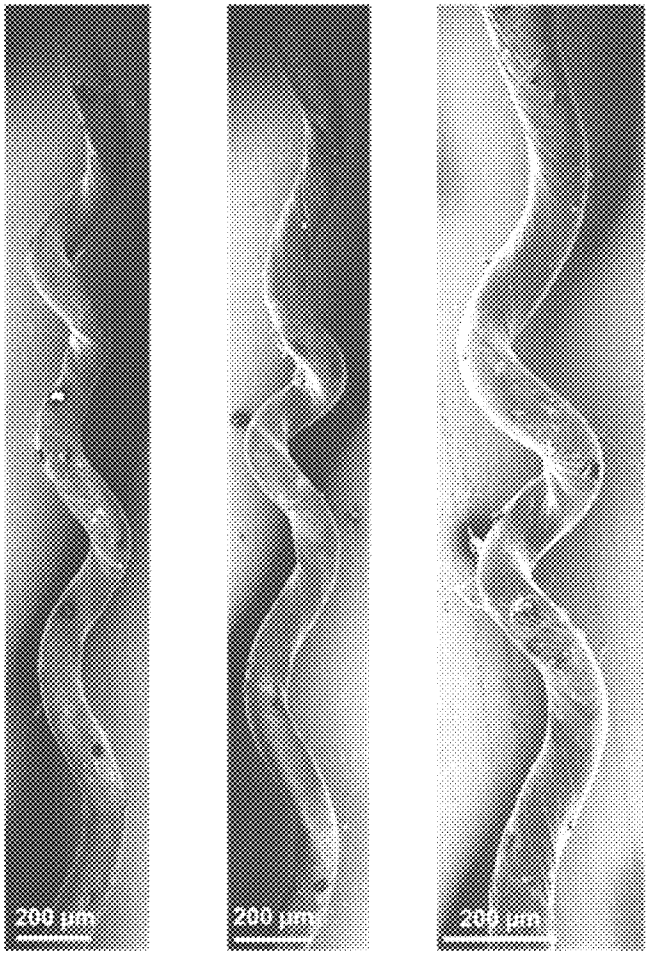

EXAMPLE 19 describes the fabrication of a three-ply CNT yarn in which all individual yarns have the same diameter (about 100 μm after twist insertion but before plying) and the same chirality as the chirality of plying. Prior to plying, each of these individual yarns were isobarically twisted until just below the twist that initiates yarn coiling. The tensile load and twist density for each individual CNT yarn was 38 MPa and 30 turns/cm. Then, these yarns were plied together under the same tensile load of 38 MPa in the same twist direction as the initial twist until immediately before the onset of plied yarn coiling (FIG. 15A). The two-end-tethered plied CNT yarn (having a plying twist density of 17 turn/cm) was stabilized by using the incandescent tension anneal process (ITAP) for electrothermal pulse annealing under tension (about 3000° C. for 120 s under 38 MPa). By unplying the individual CNT yarns, through their end rotation from the opposite-end-tethered three-ply ITAP annealed CNT yarn, three individual high-spring-index coiled CNT yarns were obtained, which were free-standing since they were neither torsionally nor positionally tethered (FIGS. 15B-15C). Each individual coiled yarn had a high-spring-index of 1.67.

Example 20

Figure 16:
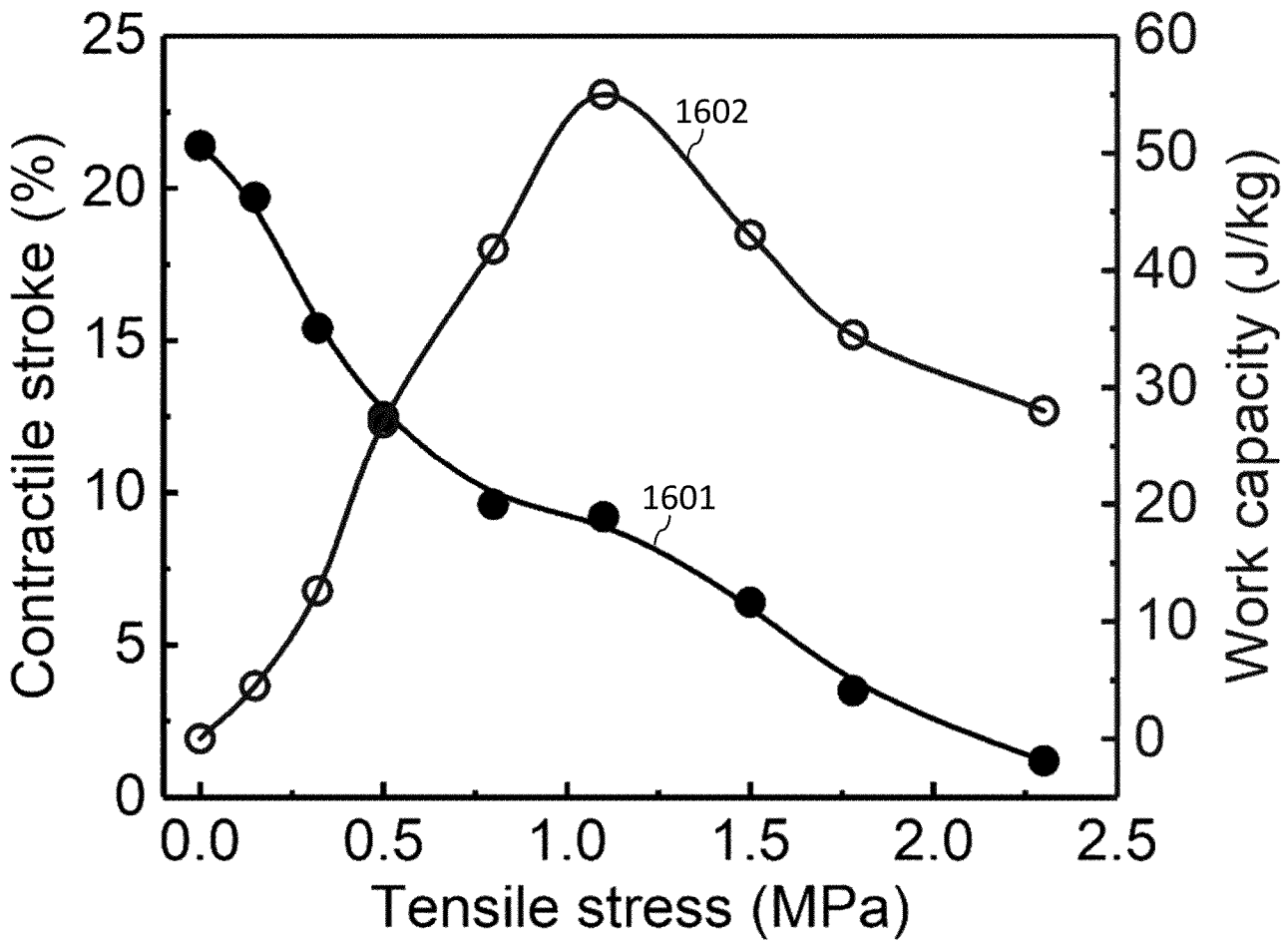
FIG. 16 shows the dependence of the contractile stroke and gravimetric work capacity on the tensile stress for adsorption-driven actuation performance of the ply-extracted high-spring-index CNT yarn shown in FIG. 15C when methanol was adsorbed and desorbed from the yarn during its use as a methanol-adsorption-powered muscle.

EXAMPLE 20 shows the adsorption-driven actuation performance of the ply-extracted high-spring-index CNT yarn of EXAMPLE 19 when methanol was adsorbed and desorbed from the yarn during its use as a methanol-adsorption-powered muscle. FIG. 16 shows the dependence of the contractile stroke (plot 1601) and gravimetric work capacity (plot 1602) on the tensile stress. While the magnitude of the contractile stroke of the CNT yarn muscle decreases monotonically from 21.4% to 1.2% when the tensile stress during actuation increased from 0 to 2.3 MPa, the contractile work capacity reached a peak of 55 J/kg when a tensile stress of 1.1 MPa was applied during actuation.

Example 21

Figure 17A:
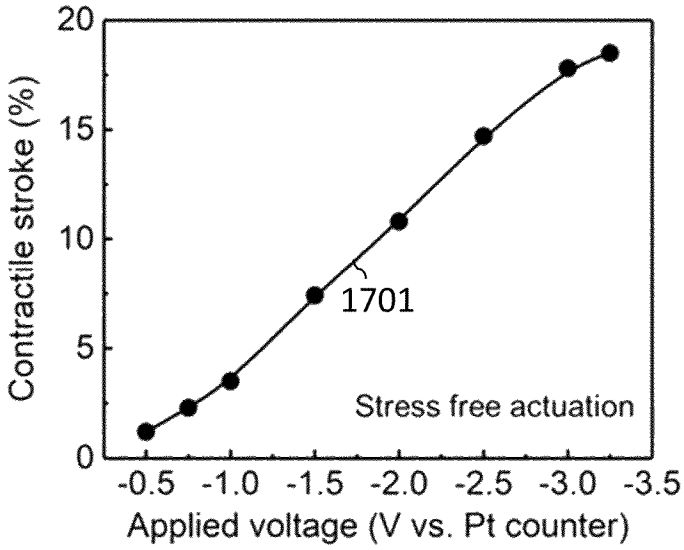
FIGS. 17A-17B show the performance of the high-spring-index CNT yarn shown in FIG. 15C as an electrochemical-driven artificial muscle in an electrolyte.
Figure 17B:
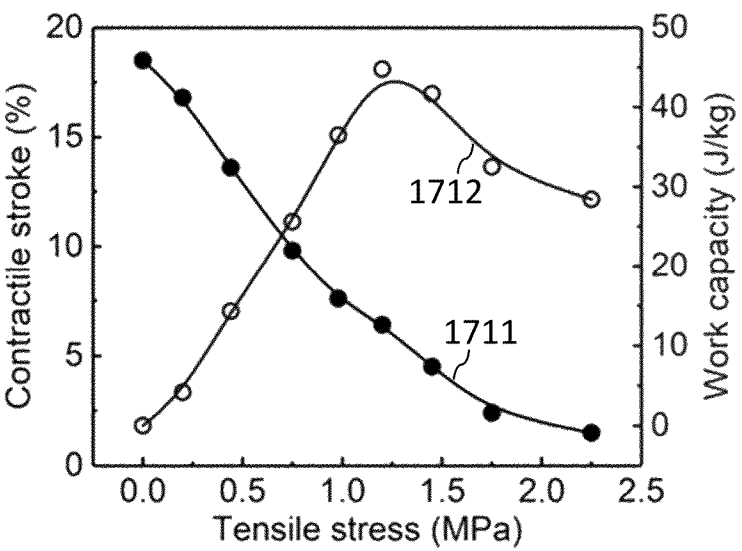

EXAMPLE 21 shows the performance of a high-spring-index CNT yarn of EXAMPLE 19 as an electrochemical-driven artificial muscle in an electrolyte of 0.2 M tetrabutylammonium hexafluorophosphate ($TBA{\cdot}PF_6$) in propylene carbonate (PC). FIG. 17A shows that the stress-free contractile stroke of the ply-extracted CNT yarn muscle increases with increasing applied inter-electrode voltage, and reaches a maximum stroke of 18.5% for an applied voltage of −3.25 V (plot 1701). FIG. 17B shows the dependence of the contractile stroke (plot 1711) and gravimetric work capacity (plot 1712) on the tensile stress when the applied inter-electrode voltage was −3.25 V. While the contractile stroke of the high-spring-index CNT yarn monotonically decreases with increasing tensile stress, the contractile work capacity reached a peak of 44.8 J/kg when a 1.2 MPa tensile stress was applied during actuation.

Example 22

Figure 18B:
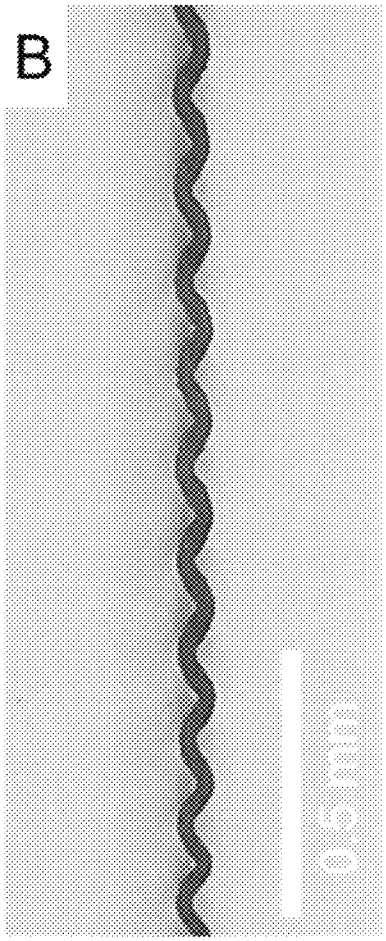
FIGS. 18A-18B show fabrication of a high-spring-index polymer fiber from a 2-ply polyurethane yarn.
Figure 18A:
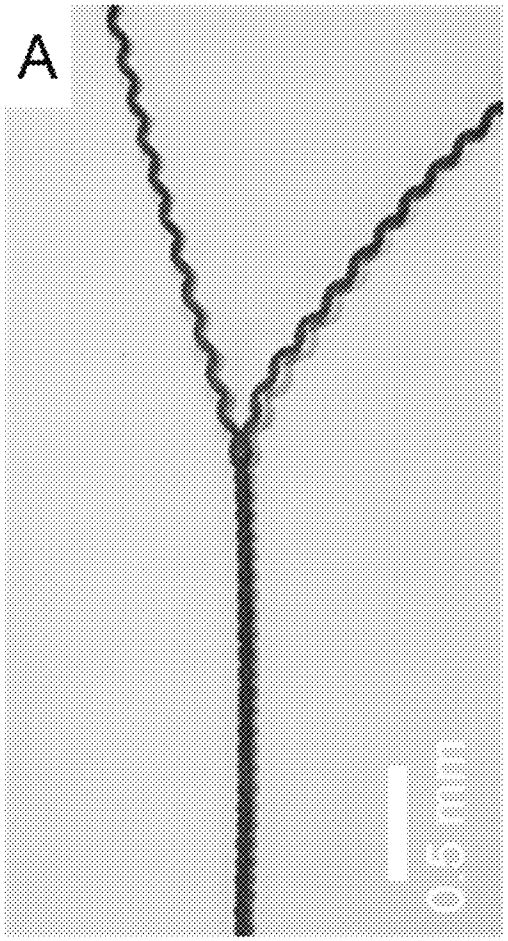

EXAMPLE 22 describes the fabrication of a 2-ply polyurethane yarn in which all individual yarns have the same diameter (about 398 μm after twist insertion but before plying) and the same chirality as the chirality of plying. Prior to plying, each of these individual yarns were isobarically twisted until just below the twist that initiates yarn coiling. The tensile load and twist density for each individual polyurethane yarn was 4.73 MPa and 9 turns/cm. Then, these fibers were plied together under a tensile load of 4.73 MPa in the same twist direction as their initial twist until immediately before the onset of plied yarn buckling or snarling. The two-end-tethered plied polymer yarn (having a plying twist density of 8 turns/cm) was stabilized by a thermal anneal in vacuum at ~160° C. for 1.5 hours (FIG. 18A). After this thermal anneal and extraction of the individual coiled fibers, each individual fiber had a spring index of 1.85 and a coil bias angle of 30.2° (FIG. 18B).

Example 23

Figure 19:
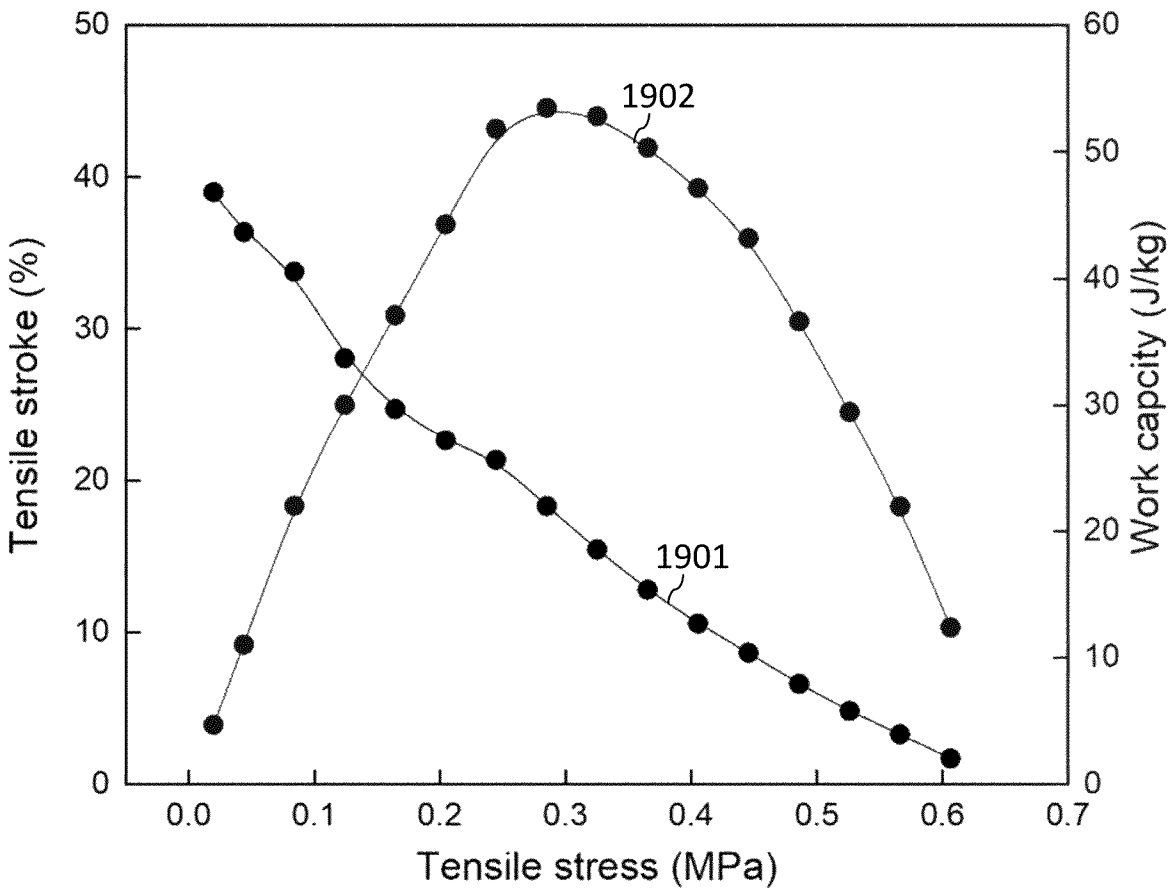
FIG. 19 shows the dependence of the contractile stroke and gravimetric work capacity on the tensile stress for the high-spring-index polymer fiber shown in FIG. 18B as a thermally driven artificial muscle.

EXAMPLE 23 shows the performance of a coiled fiber of EXAMPLE 22 as a thermally driven artificial muscle. FIG. 19 shows the dependence of the tensile stroke (plot 1901) and gravimetric work capacity (plot 1902) on the applied tensile stress when the temperature was decreased from 25 to −30° C. While the tensile stroke of the polymer fiber monotonically decreases with increasing tensile stress, from a maximum value of 39%, the tensile work capacity reached a peak of 53.48 J/kg when a tensile stress of 0.29 MPa was applied during actuation.

Example 24

Figure 20:
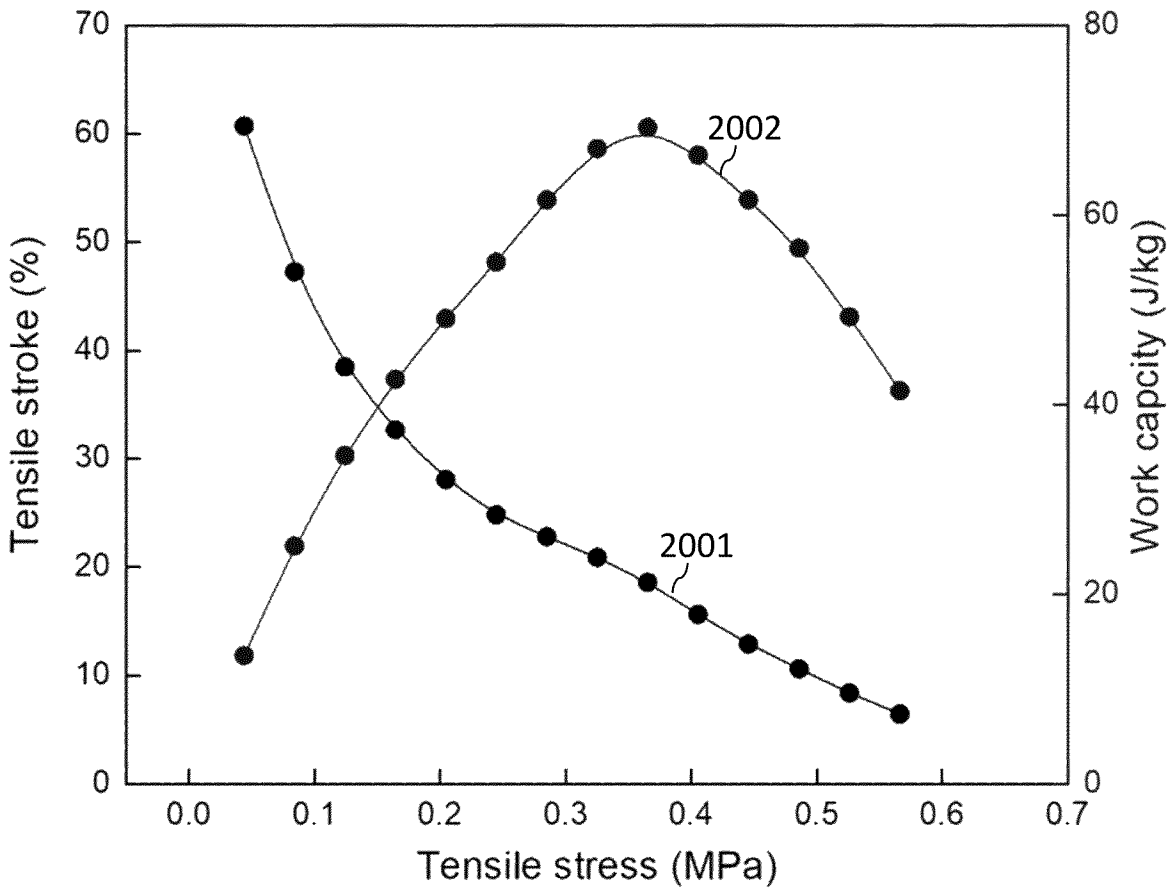
FIG. 20 shows the effect of a second high-temperature thermal annealing time on the performance of the polymer fiber shown in FIG. 18B.

EXAMPLE 24 describes the effect of a second high-temperature thermal annealing time on the performance of the polymer fiber prepared in EXAMPLE 22. After the first thermal annealing in vacuum at ~160° C. for 1.5 hours, the tethering was completely removed, and the individual coiled fibers were extracted from the thereby stabilized 2-ply polymer yarn. Then, the retethered ply-extracted fiber was annealed in air at 160° C. for 0.5 to 5 hours. FIG. 20 shows the dependence of the tensile stroke (plot 2001) and gravimetric work capacity (plot 2002) on the tensile stress when the temperature was decreased from 25 to −30° C. after a second annealing of 1 hour. While the tensile stroke of the polymer fiber monotonically decreases with increasing tensile stress, from a maximum value of 61%, the tensile work capacity reached a peak of 69.22 J/kg when a tensile stress of 0.37 MPa was applied during actuation.

Example 25

Figure 21A:
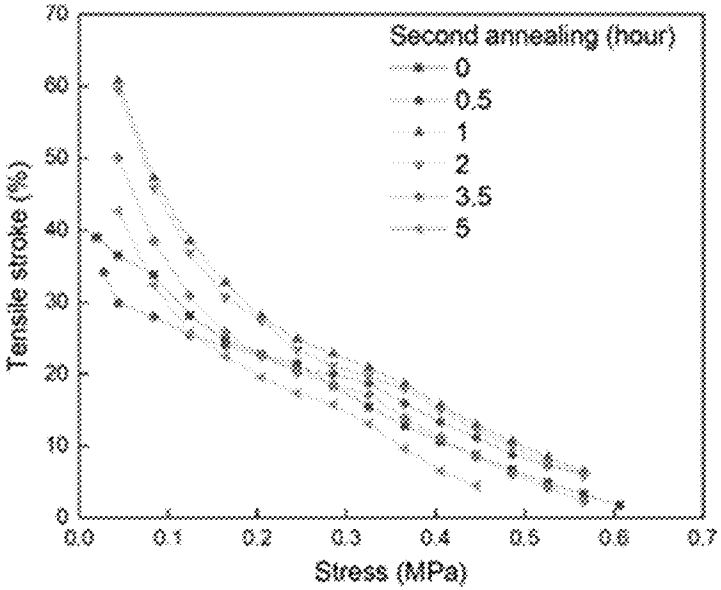
FIGS. 21A-21D show the dependence of actuation on the length of the second high-temperature thermal annealing time.
Figure 21B:
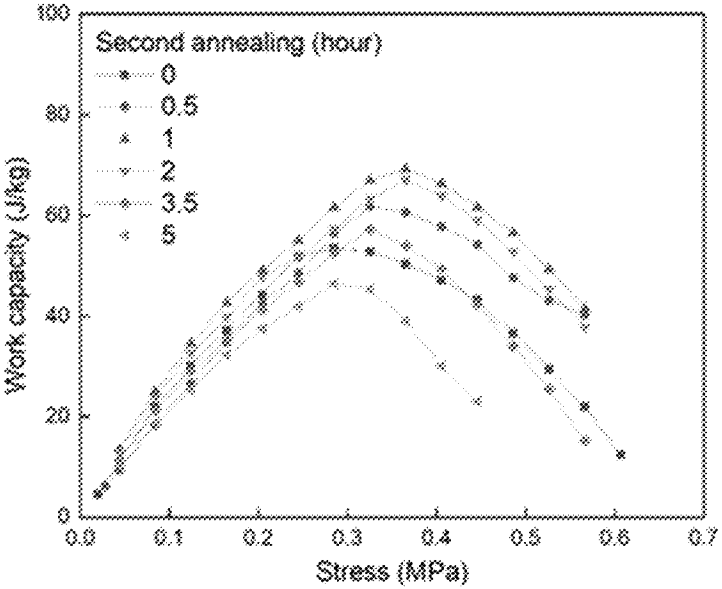
Figure 21D:
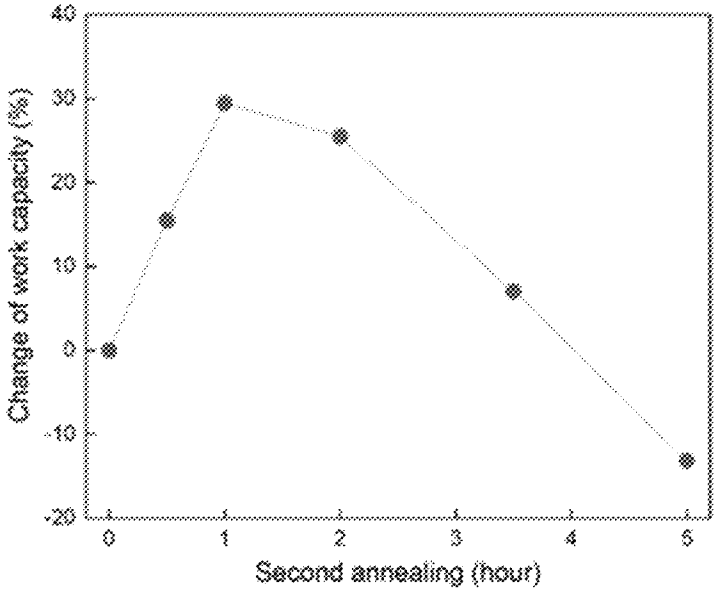
Figure 21C:
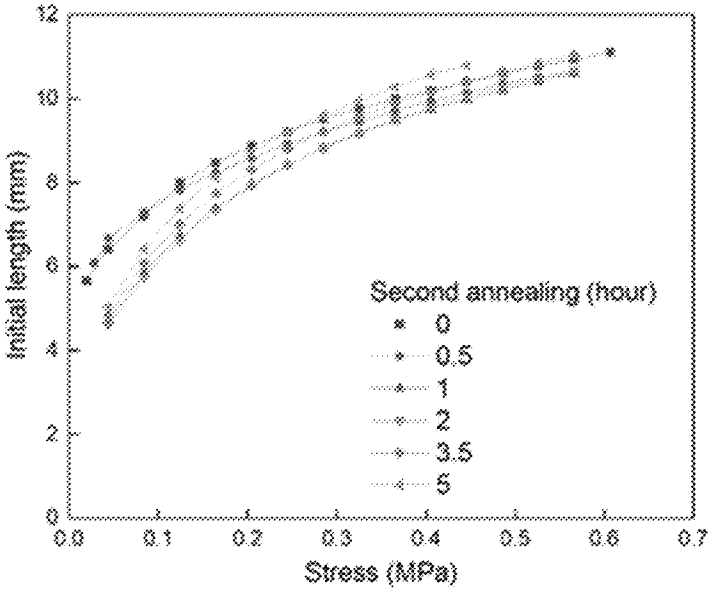

EXAMPLE 25 shows the dependence of actuation, for a temperature change from 25 to −30° C., on the length of the second high-temperature thermal annealing time. Both tensile stroke and work capacity were maximized by applying 1 hour of anneal at ~160° C. to the ply-extracted fibers (FIGS. 21A-21B). However, as shown, there was little change in either tensile stroke or work capacity when the anneal time at ~160° C. was increased from 1.5 hours to 2 hours. The second annealing decreased the initial length of the polymer yarn (FIG. 21C), resulting in improved actuation performance. Compared to the polymer yarn before the second annealing, the work capacity increased by about 30% (FIG. 21D).

Example 26

EXAMPLE 26 describes the effect of varying the second annealing temperature on the performance of a two-ply extracted coiled nylon-6 fiber. The diameter of each individual polymer fiber before twisting was 0.28 mm. For initial pre-plying twist insertion, each individual polymer fiber was twisted to a twist density of 5.0 turns/cm under a tensile load of 73.9 MPa. Then, these twisted polymer fibers were plied to a plying twist density of 5.4 turns/cm under a plying tensile load of 64.6 MPa. After the first thermal annealing in vacuum at ~110° C. for 1.5 hours, the tethering was completely removed, and the individual coiled fibers were extracted from the stabilized 2-ply polymer yarn. Then, the non-tethered ply-extracted fibers were divided into seven parts, which were thermally annealed in air for 20 seconds at 115° C., 132° C., 150° C., 166° C., 182° C., 193° C. and 205° C., respectively.

Example 27

Figure 22:
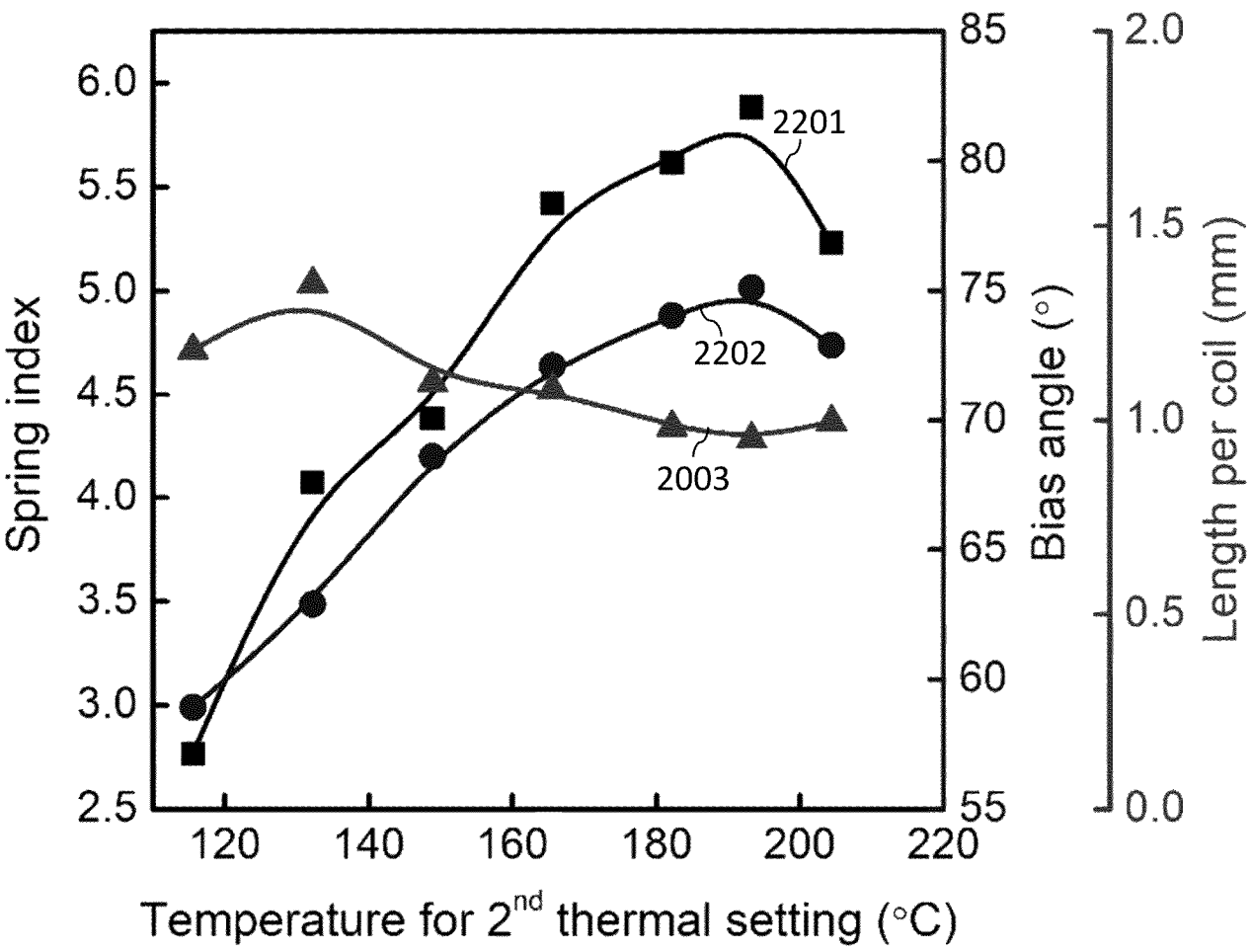
FIG. 22 shows the dependencies of spring index, coil bias angle, and length per coil of two-ply ply-extracted coiled nylon fibers on the temperature during the second thermal annealing.

EXAMPLE 27 shows the dependencies of spring index, coil bias angle, and length per coil of ply-extracted coiled fibers of EXAMPLE 26 on the second annealing temperature. Here, the length per coil is defined as the fiber length between neighboring coils. When the second annealing temperature was increased from 115 to 193° C., both the spring index (plot 2201) and the coil bias angle (plot 2202) of the ply-extracted coiled fibers increased and reached the following peaks (spring index: 5.89; coiled bias angle: 75.1°) for an annealing temperature of 193° C. (FIG. 22). A higher annealing temperature of 205° C. decreased the spring index and the coiled bias angle. In contrast, the coil-to-coil separation distance of these ply-extracted coiled fiber (plot 2203) showed only small variations within the above annealing temperature range.

Example 28

Figure 23:
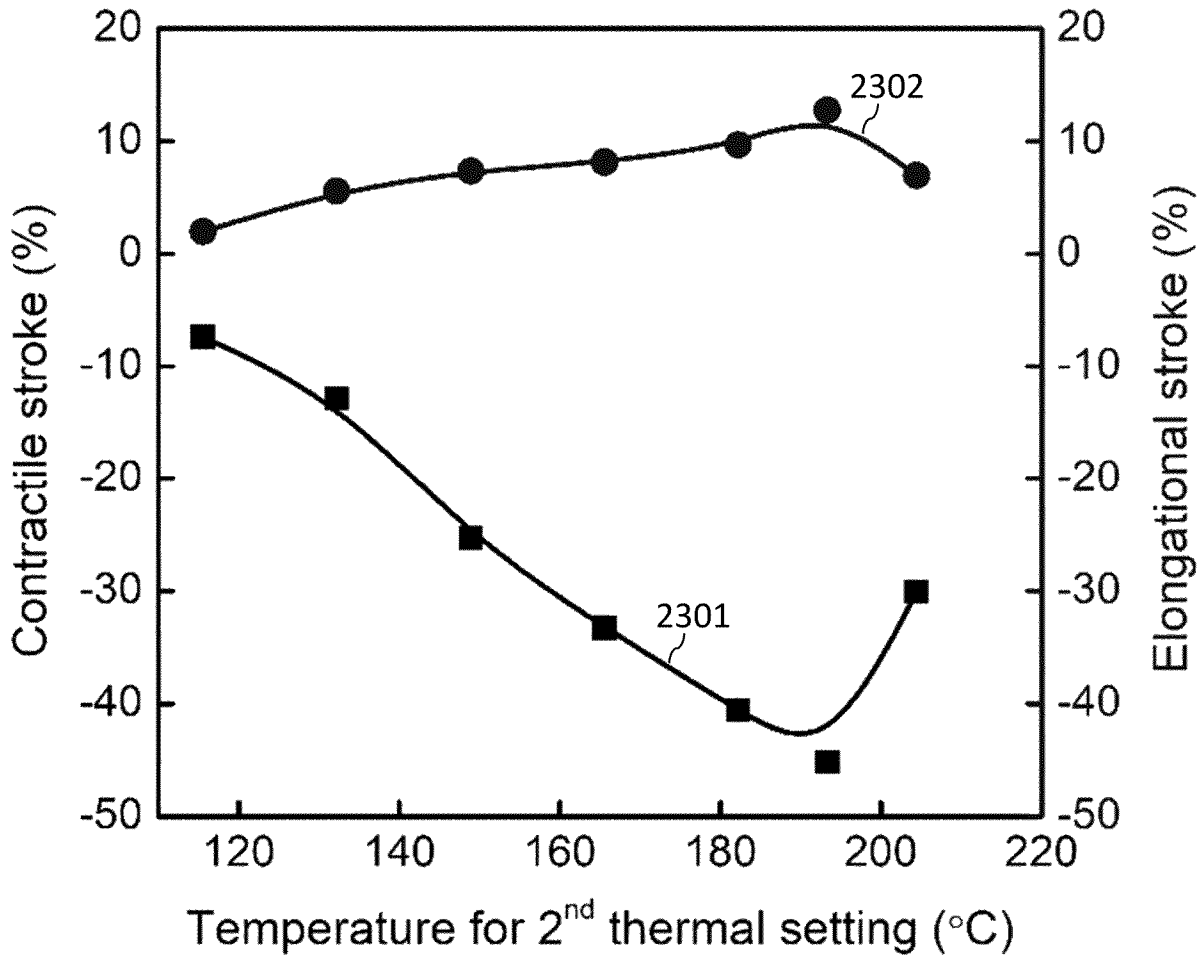
FIG. 23 shows the magnitudes of actuation stroke (contraction and elongation) for ply-extracted high-spring-index polymer fibers for different second anneal temperatures.

EXAMPLE 28 shows the magnitudes of actuation stroke for the ply-extracted high-spring-index polymer fibers of EXAMPLE 26 when the temperature was increased from room temperature (22° C.) to 105° C. to provide a contraction and decreased from room temperature (22° C.) to −15° C. to provide an elongation. The ply-extracted coiled fiber that underwent a second anneal at 193° C. provided a maximum reversible contractile stroke of 45.2% for a temperature increase from 22° C. to 105° C., which was larger than that for other second annealing temperatures and was over 6 times that of ply-extracted coiled fibers that underwent a second anneal at 115° C. (FIG. 23, plot 2301). In addition, the maximum elongational stroke of the ply-extracted coiled fiber undergoing a second anneal at 193° C. was 12.8% for a temperature decrease from 22° C. to −15° C., while the maximum elongational stroke of the ply-extracted coiled fiber undergoing a second anneal at 115° C. was 1.9%, and all other second annealing temperatures provided a smaller stroke than did the sample having a second annealing temperature of 193° C. (FIG. 23, plot 2302). Hence, the sample having a second annealing temperature of 193° C. provided both a larger magnitude stroke than for samples having a different second annealing temperature for both temperature increases from room temperature (22° C.) to 105° C. and for temperature decreases from room temperature (22° C.) to −15° C. As shown in FIG. 23, the stroke magnitude increases in going from a second annealing temperature of 115° C. to 193° C. is quite large (a factor of about 6.1 increase in muscle length in going from 22 to ~15° C. (plot 2302) and a factor of about 6.5 decrease in muscle length in going from 22 to 105° C. (plot 2301)). Furthermore, increase of the annealing times (from 1 min. to 10 min.) at the second anneal temperature had little effect on the actuation strokes for these two temperature ranges.

Example 29

Figure 24:
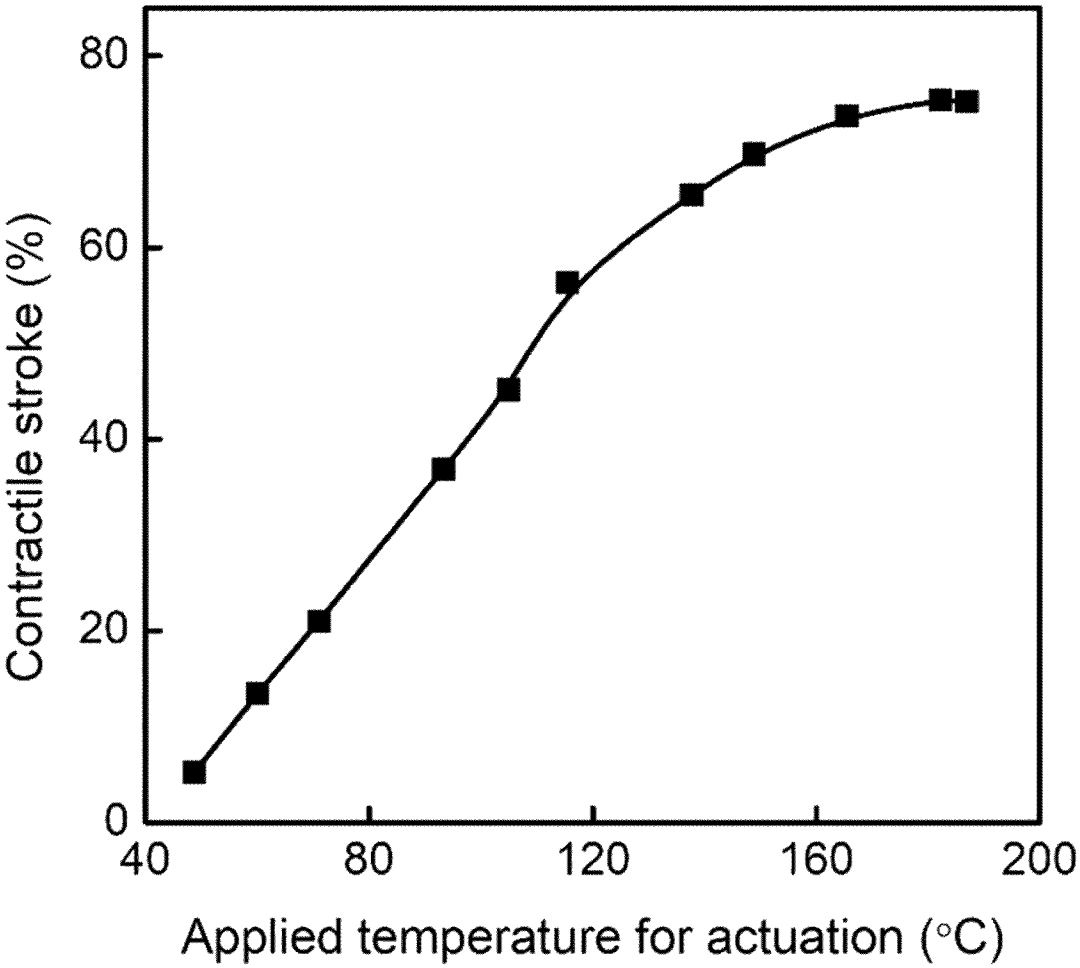
FIG. 24 shows the temperature dependence of the second-anneal-temperature-optimized contractile stroke for a high-spring-index polymer fiber.

EXAMPLE 29 shows in FIG. 24 the temperature dependence second-anneal-temperature-optimized contractile stroke of a high-spring-index polymer fiber of EXAMPLE 26. The second annealing temperature for this 2-ply extracted polymer fiber was 193° C. FIG. 24 shows that the contractile stroke of the thermally-annealed, ply-extracted fiber increases with increasing actuation temperature, and approaches a plateau when the actuation temperature exceeds 166° C. This plateau is due to inter-coil contact.

Example 30

Figure 25:
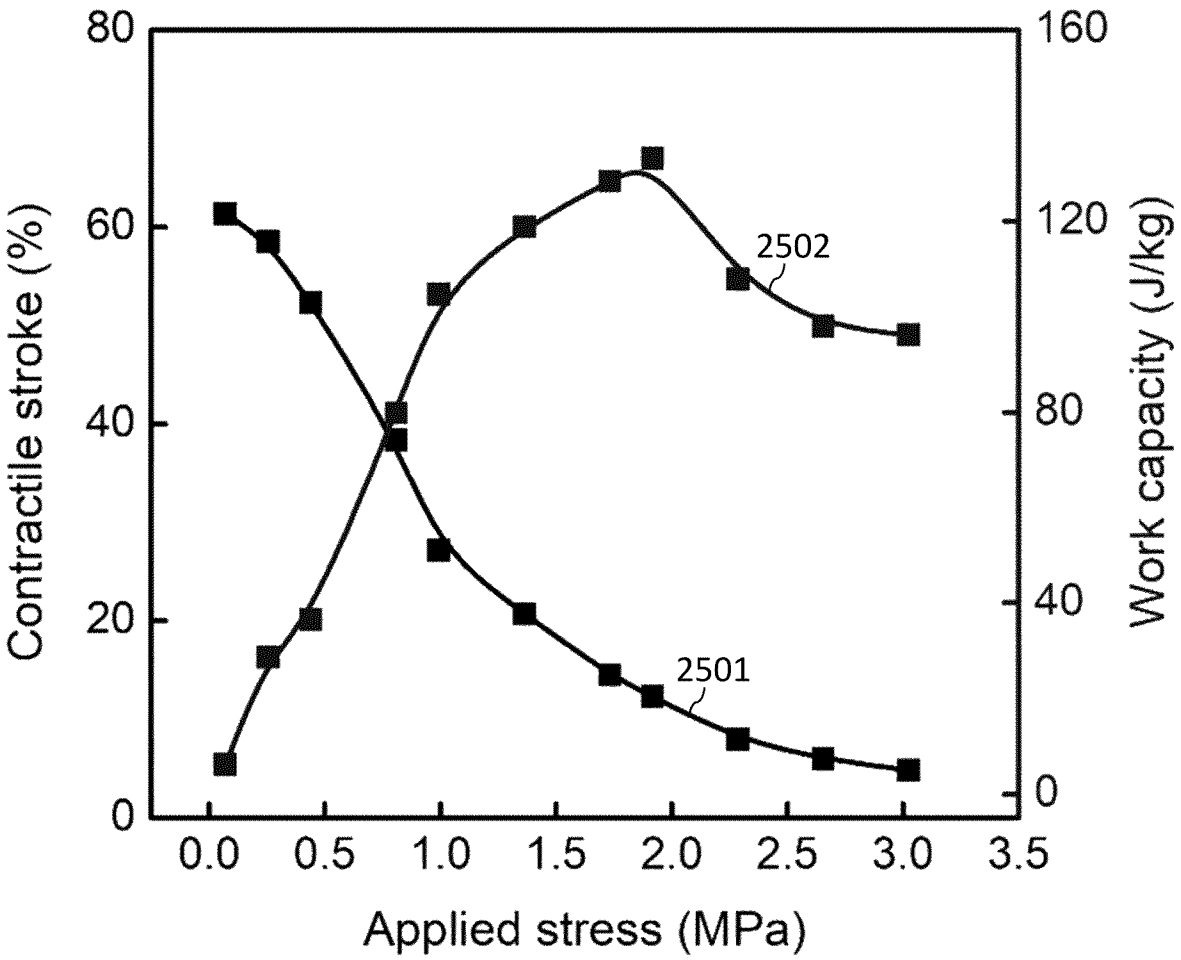
FIG. 25 shows the performance of a high-spring-index polymer fiber as a thermally driven artificial muscle.

EXAMPLE 30 describes the performance of a high-spring-index polymer fiber of EXAMPLE 26 as a thermally driven artificial muscle. The performance-optimized second annealing temperature for this ply-extracted polymer fiber is 193° C. FIG. 25 shows the dependence of the contractile stroke (plot 2501) and gravimetric work capacity (plot 2502) on the tensile stress when the temperature was increased from 22 to 182° C. While the contractile stroke of the high-spring-index polymer fiber monotonically decreases with increasing tensile stress, the contractile work capacity reached a peak of 133.2 J/kg when a tensile stress of 1.92 MPa was applied during actuation.

Example 31

Figure 26B:
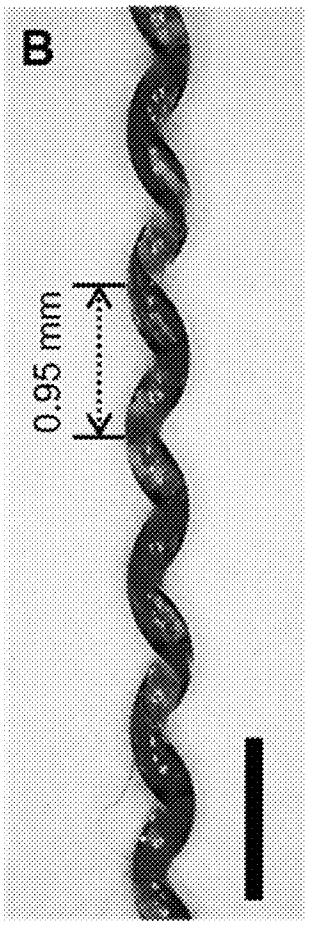
FIGS. 26A-26B show, respectively, each of the two individual polymer fibers that was extracted from a fabricated 2-ply heterochiral polymer yarn.
Figure 26A:
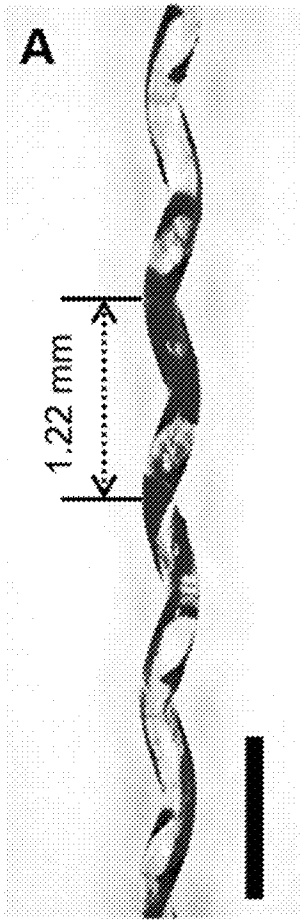

EXAMPLE 31 describes the fabrication of two-ply heterochiral polymer yarns in which two fibers have the same diameter and the same chirality. The initial diameter for these two polymer fibers was 0.28 mm. Initially, each individual polymer fiber was twisted to a twist density of 5.0 turns/cm under a tensile load of 73.9 MPa. These fibers were then plied together to a twist density of 7.1 and 10.0 turns/cm, respectively, in the opposite twist direction as the initial twist to make 2-ply heterochiral yarns by using a tensile load of 64.6 MPa during plying. To stabilize the plied configuration, these two-end-tethered, 2-ply heterochiral polymer yarns were thermally annealed at ~120° C. in vacuum for 2 hours while fully tethered (positionally and torsionally). Then, each individual polymer fiber was extracted from the 2-ply heterochiral polymer yarns (FIGS. 26A-26B). The ply-extracted coiled fiber made by inserting a plying twist density of 10.0 turns/cm provided a maximum reversible elongational stroke of 3.4% for a temperature increase from 22° C. to 105° C., which was over 4 times that of ply-extracted coiled fibers made by inserting a plying twist density of 7.1 turns/cm. However, the maximum contractile stroke for these ply-extracted coiled polymer fibers was below 1% for a temperature decrease from 22° C. to −15° C., for any value of the plying twist density between 7.1 and 10.0 turns/cm.

Example 32

EXAMPLE 33 describes the fabrication of two-ply polymer yarns by applying different tensile loads for the initial twist. The diameter for each individual polymer fiber before twisting was 0.28 mm. Here, tensile loads of 18.5, 36.9, 55.4, 73.9, 110.8 and 129.3 MPa were applied on the polymer fiber during this initial twist. All these polymer fibers had the same twist density of 5.0 turns/cm and the same chirality before plying. During plying, the twist density and twist load were 5.4 turns/cm and 64.6 MPa. After the first thermal annealing in vacuum at ~110° C. for 1.5 hours, the tethering was completely removed, and the individual coiled fibers were extracted from the stabilized 2-ply polymer yarns. Then, the non-tethered ply-extracted fibers derived from different twist loads were thermally annealed in air for 20 seconds at 115° C. and 193° C., respectively.

Example 33

Figure 27:
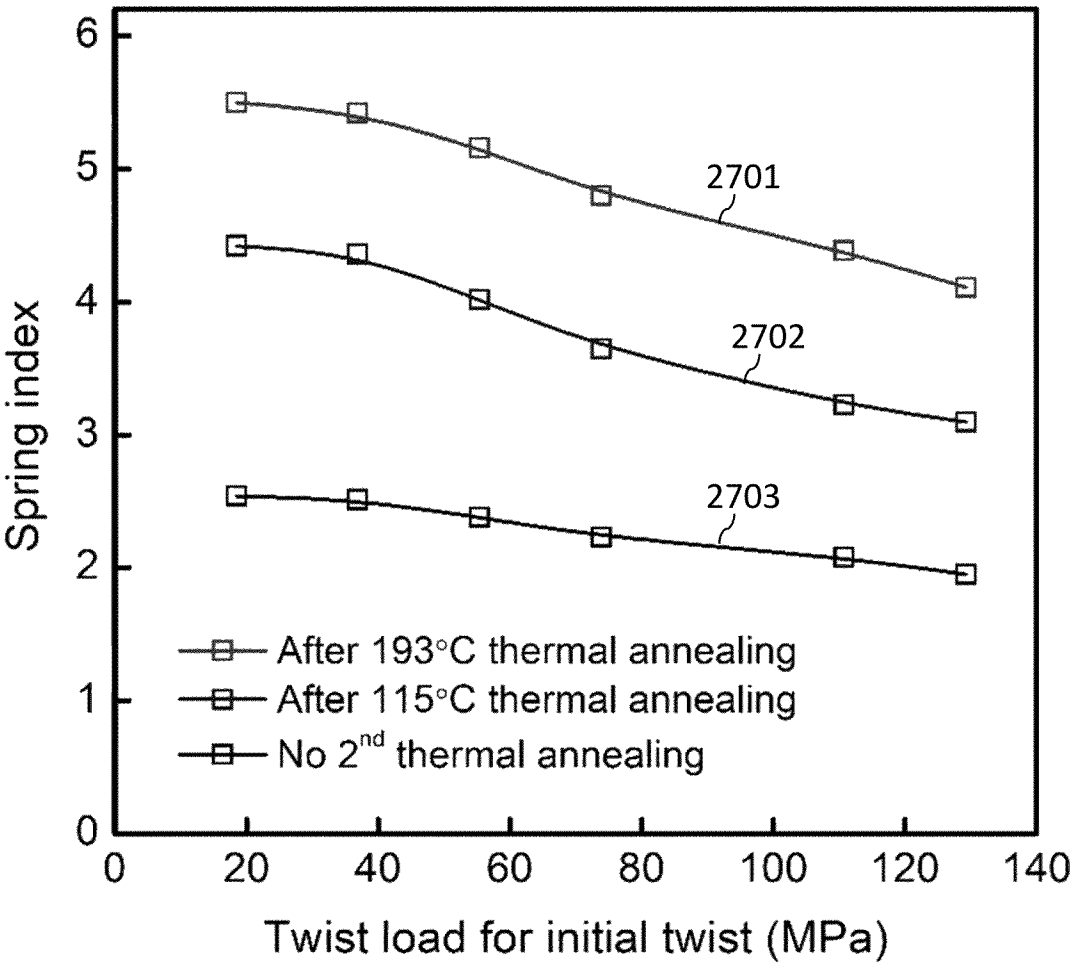
FIG. 27 shows the dependence of spring index of ply-extracted coiled fibers on the twist load for the initial twist.

EXAMPLE 33 shows the dependence of spring index of ply-extracted coiled fibers of EXAMPLE 32 on the twist load for the initial twist. For the ply-extracted coiled fibers treated by either second thermal annealing (plots 2701-2702 for, respectively, 193° C. and 115° C. thermal annealing) or not (plot 2703), the spring index of these ply-extracted coiled fibers monotonically decreased when the twist load increased from 18.5 to 129.3 MPa (FIG. 27). By applying the lowest twist load of 18.5 MPa during initial twist, the ply-extracted coiled fiber provided a maximum spring index of 5.5 after thermal annealing at 193° C. for 20 seconds.

Example 34

EXAMPLE 34 describes the fabrication of two-ply polymer yarns by applying different tensile loads for plying twist. The diameter for each individual polymer fiber before twisting was 0.28 mm. Before plying, the individual fibers were inserted twist to a twist density of 5.0 turns/cm under a tensile load of 18.5 MPa. All these polymer fibers had the same chirality. Then, these fibers were plied to a twist density of 5.4 turns/cm under tensile loads of 18.5, 27.7, 36.9, 46.2, 55.4 and 64.6 MPa, respectively. After the first thermal annealing in vacuum at ~110° C. for 1.5 hours, the tethering was completely removed, and the individual coiled fibers were extracted from the stabilized 2-ply polymer yarns. Then, the non-tethered ply-extracted fibers derived from different twist loads were thermally annealed in air for 20 seconds at 115° C. Similarly, a tensile load of 73.8 MPa for initial twist was applied to the individual fibers for making two-ply polymer yarns by using the same parameters shown above.

Example 35

Figure 28A:
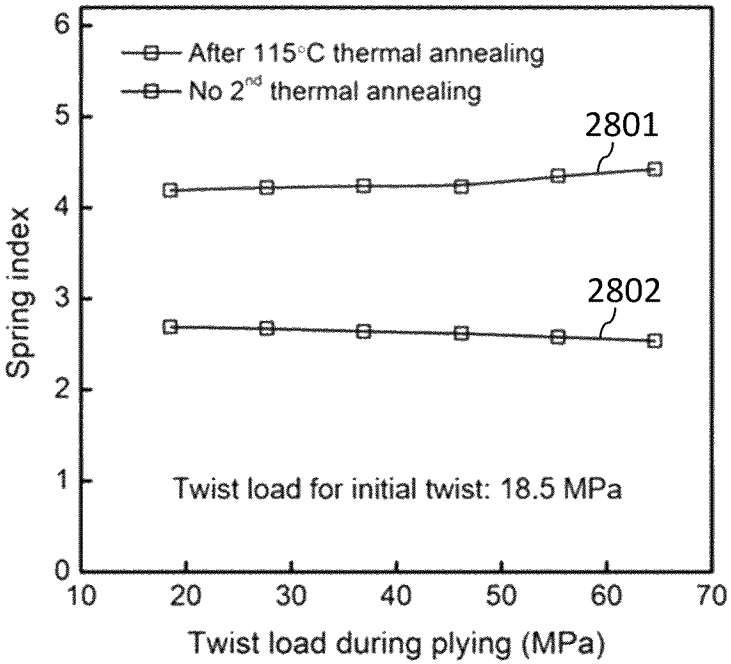
FIGS. 28A-28B shows the dependence of spring index of ply-extracted coiled fibers on the twist load for the plying twist (with twist loads of 18.5 MPa and 73.8 MPa, for FIGS. 28A-28B, respectively).
Figure 28B:
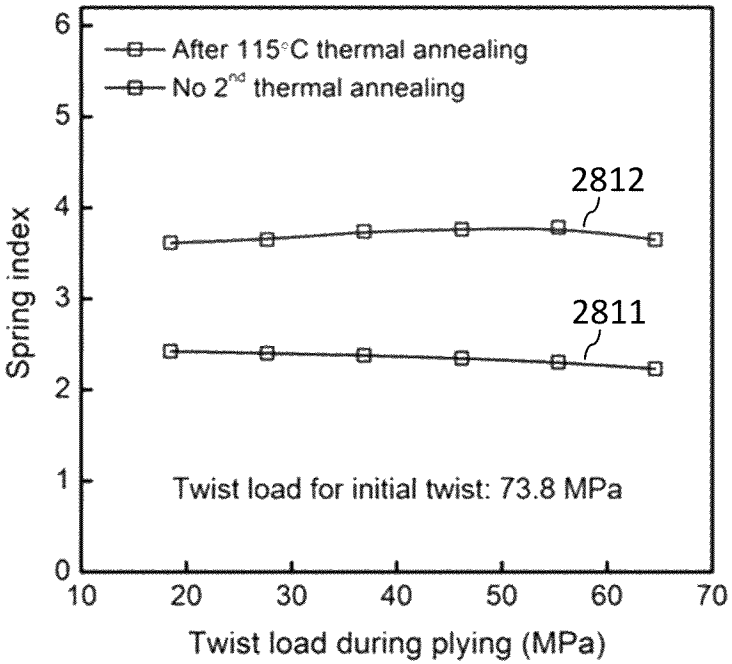

EXAMPLE 35 shows the dependence of spring index of ply-extracted coiled fibers of EXAMPLE 34 on the twist load for the plying twist. For the twist loads of 18.5 (FIG. 28A with plots 2801-2802 for after 115° C. thermal annealing and no second thermal annealing, respectively) and 73.8 MPa (FIG. 28B with plots 2811-2812 for after 115° C. thermal annealing and no second thermal annealing, respectively) for initial twist, the spring index of the ply-extracted coiled fibers was little affected by varying the plying tensile load within the investigated range. These results indicated that the spring index of the ply-extracted coiled fibers is mainly dominated by the twist load for initial twist rather than the twist load for plying twist.

Example 36

Figure 29:
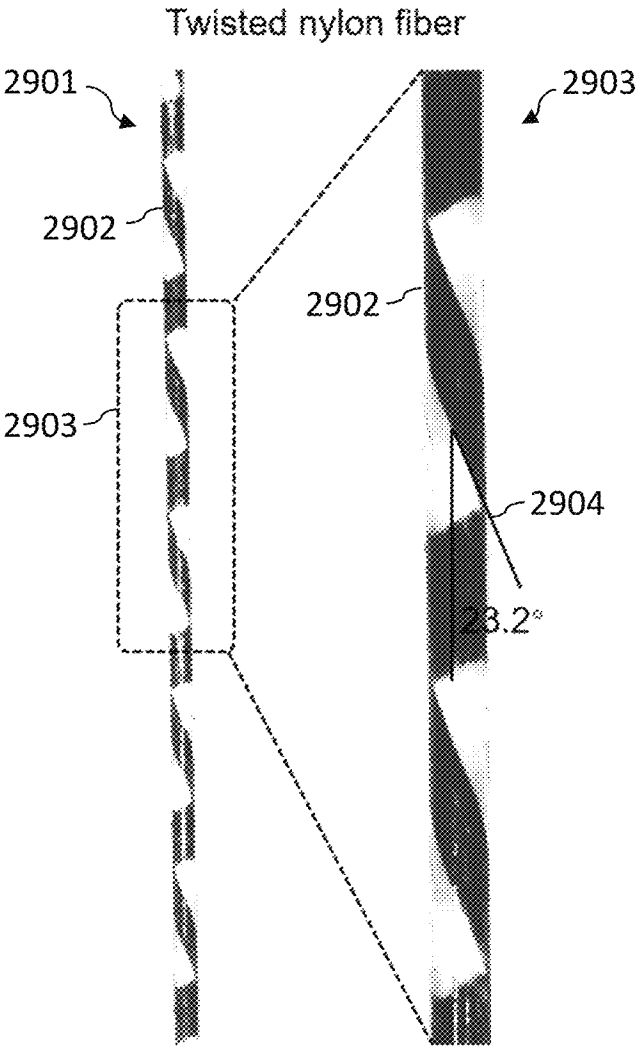
FIG. 29 shows the measurement of the bias angle of a twisted nylon fiber.

EXAMPLE 36 shows the measurement of the bias angle of a twisted nylon fiber. Before twist insertion, a nylon fiber 2901 was marked by a red line (shaded line) 2902 along the fiber direction. (FIG. 29). Segment 2903 of a nylon fiber 2901 is shown in magnified view. For a given twist, the red line (shaded line) 2902 on the nylon fiber 2901 would reflect the bias angle 2904 change. By inserting twist to a twist density of 5.0 turns/cm under a tensile load of 73.8 MPa, the nylon fiber provided a bias angle of 23.2° (FIG. 29).

Example 37

Figure 30:
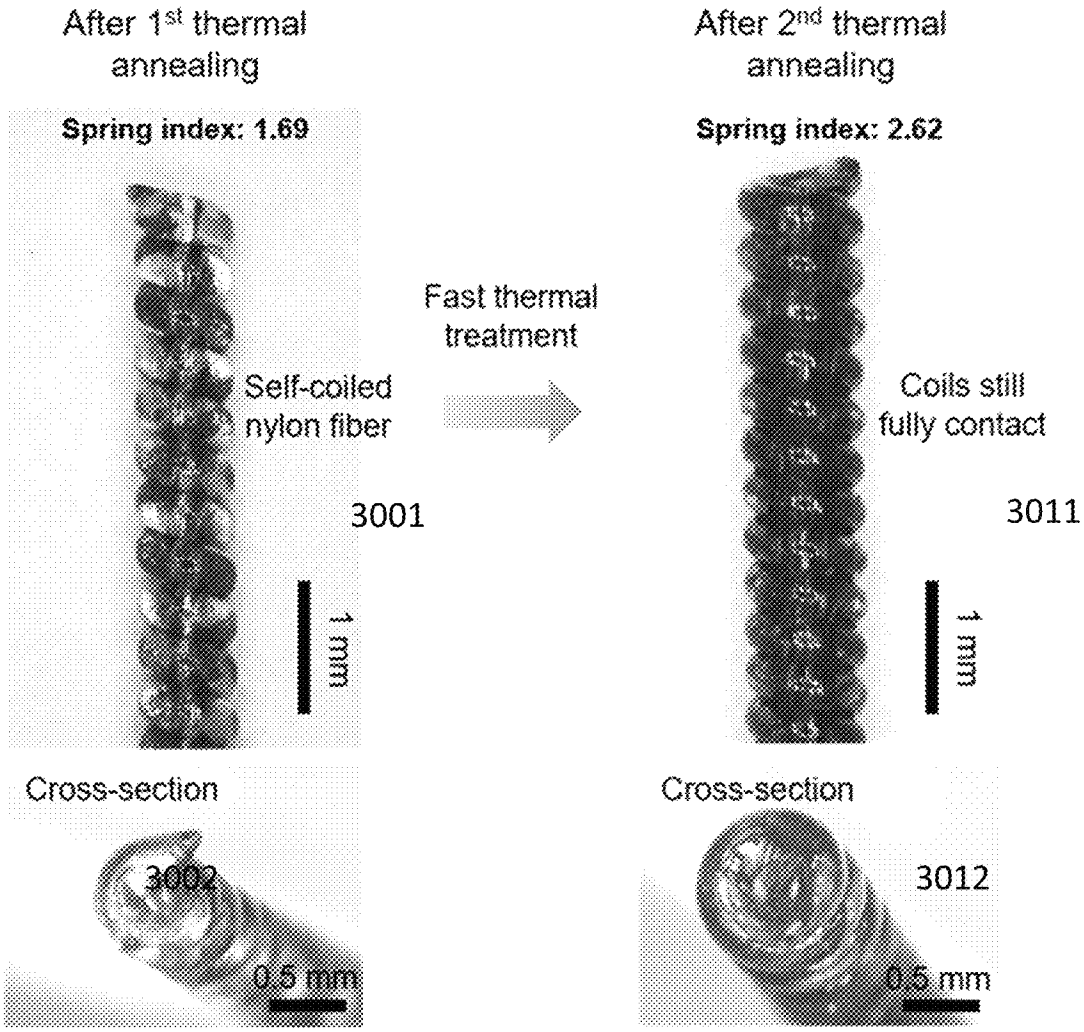
FIG. 30 shows the effect of the second thermal annealing on the spring index of a self-coiled nylon fiber.

EXAMPLE 37 describes the effect of the second thermal annealing on the spring index of a self-coiled nylon fiber. The diameter for the individual polymer fiber before twisting was 0.28 mm. The single fiber was inserted twist to a twist density of 13.3 turns/cm under a tensile load of 18.5 MPa to obtain a fully self-coiled fiber. After the first thermal annealing in vacuum at ~110° C. for 1.5 hours, the tethering for this self-coiled fiber was completely removed. This free-standing self-coiled nylon fiber 3001 (with cross-section 3002) provided a small spring index of 1.69 (FIG. 30). By applying a second thermal annealing at 193° C. for 20 seconds, the spring index of this coiled fiber 3011 (with cross-section 3012) increased to 2.62, and each coil still fully contacted the neighboring coils (FIG. 30).

Example 37

EXAMPLE 38 shows the dependence of spring index, bias angle and length per coil of the thermal-annealed self-coiled fibers on the temperature during second thermal annealing. Here, the length per coil is the fiber length between neighboring coils, which is calculated from Eq. (1):

$$L_{coil}=\pi d(SI)/\sin(\alpha) \quad (1)$$

where d is the fiber diameter, SI is the coil spring index, and the a is the coiled bias angle.

Figure 31:
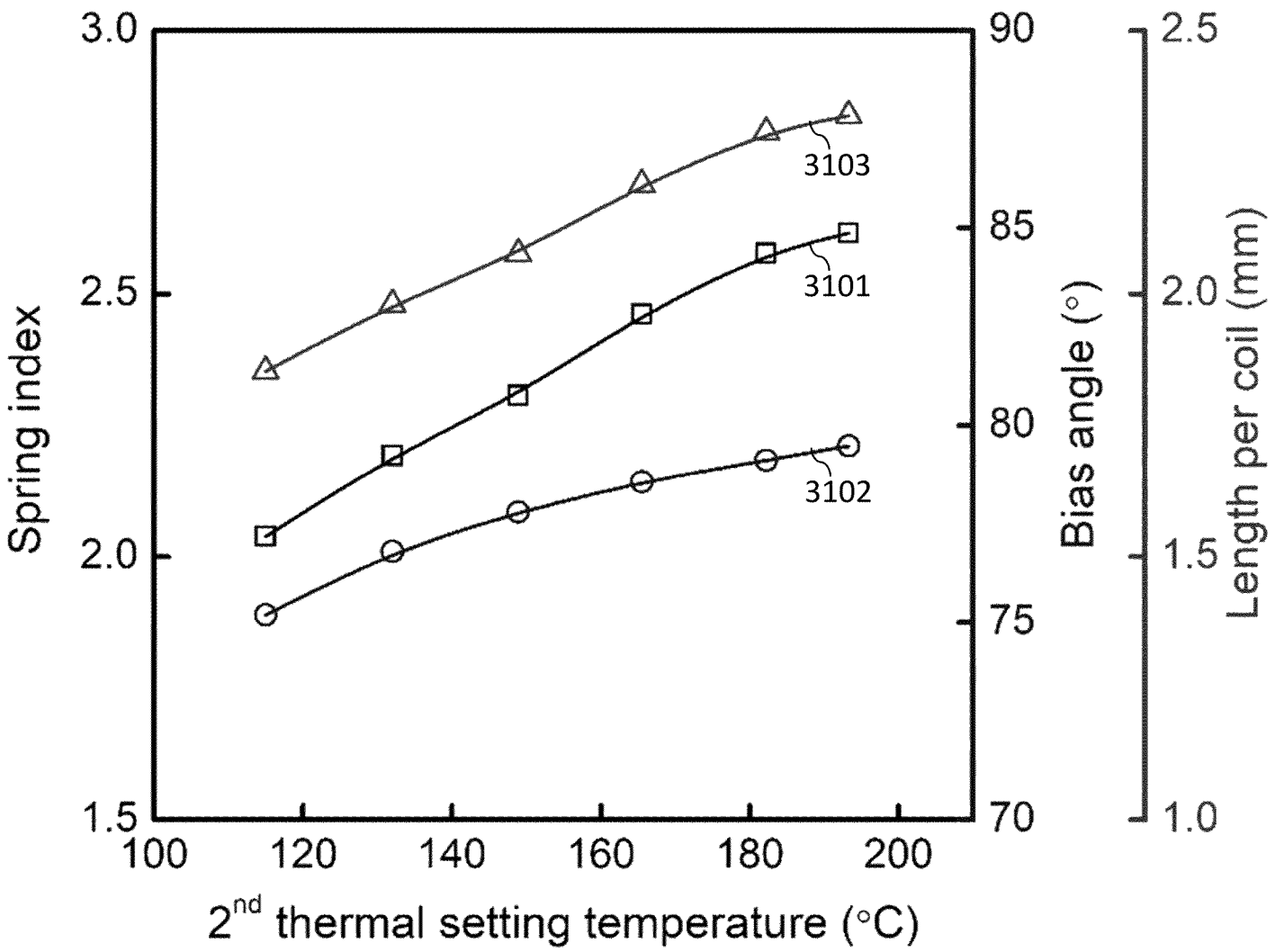
FIG. 31 shows the dependencies of spring index, bias angle, and length per coil of thermally-annealed self-coiled fibers on the temperature during the second thermal annealing.

With increasing the temperature, the spring index (plot 3101), bias angle (plot 3102), and length per coil (plot 3103) monotonically increased and reached a maximum at the temperature at 193° C. (FIG. 31). This result indicates that additional thermal treatment also can be used to increase the spring index for a self-coiled fiber.

Example 39

EXAMPLE 39 shows the dependence of contractile stroke and work capacity of coiled fibers on the applied tensile stress during actuation. Here, the temperature was increased from room temperature (22° C.) to 105° C. to provide a contraction for these coiled nylon fibers. From the results shown in FIGS. 32A-32B, the fully self-coiled fiber with the smallest spring index of 1.69 provided a maximum work capacity of 588.1 J/kg when a tensile stress of 29.6 MPa was applied, which produce a contractile stroke of 10.4%. The maximum contractile stroke of 12.9% for this self-coiled fiber was obtained at a tensile stress of 18.5 MPa. In contrast, the ply-extracted fiber with a spring index of 8.02 provided a maximum non-loaded stroke of 81.1% and a large load stroke of 69.1% for a very small tensile stress of 0.07 MPa. While this high-spring index coiled fiber provided a maximum tensile stress-optimized work capacity of 16.4 J/kg when a tensile stress of 0.44 MPa was applied. This work capacity is much smaller than for the self-coiled fiber. As indicated from the curves, larger spring index would decrease the work capacity but dramatically increase the contractile stroke that is very important for the applications that need large strokes.

Example 40

Figure 33:
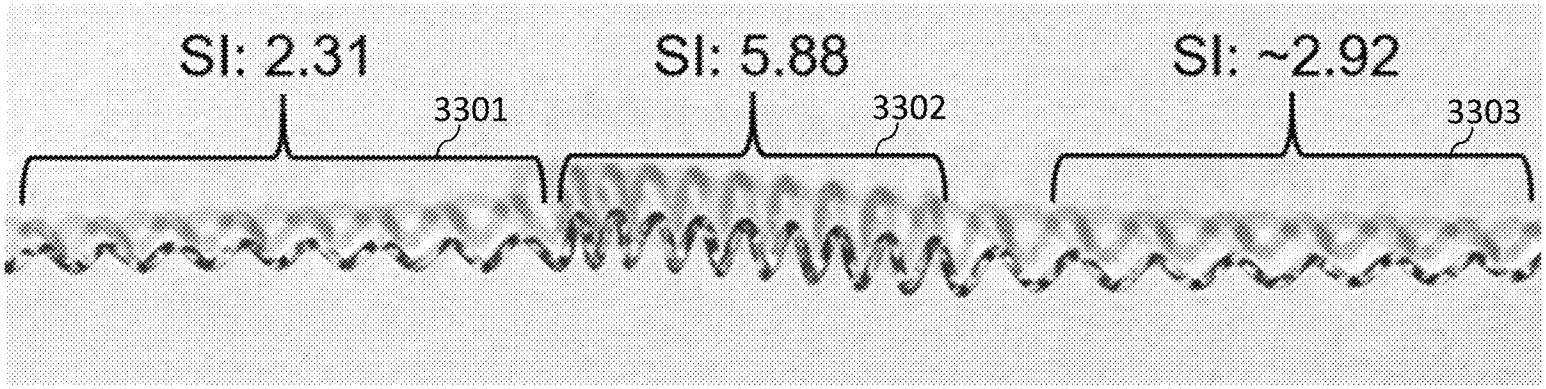
FIG. 33 shows a multi-spring index coiled fiber fabricated by utilizing a region-selected thermal treatment method.

EXAMPLE 40 describes the fabrication of a multi-spring index coiled fiber by utilizing a region-selected thermal treatment method. The diameter for each individual polymer fiber is 0.28 mm. Initially, individual fiber was twist inserted to a twist density of 5.0 turns/cm under a tensile load of 73.8 MPa. Then, these individual polymer fibers were plied to a twist density of 5.4 turns/cm under a tensile load of 64.6 MPa for making a two-ply polymer fiber. After the first thermal annealing in vacuum at ~110° C. for 1.5 hours, the tethering was completely removed, and the individual coiled fibers were extracted from the stabilized two-ply polymer yarns. Then, three different temperatures of 115° C., 193° C. and 127° C. were used to thermally treat the different regions in the coiled fiber direction, respectively, which results in multi-spring indices of 2.31, 5.88, and 2.92 in this coiled fiber at regions (or segments) 3301-3303, respectively (FIG. 33). During thermal treatment on a selected region, the other regions of the coiled fiber were torsionally and positionally tethered.

Example 41

EXAMPLE 41 describes the application of the ply-extracted high-spring-index coiled muscles of the present invention in bilayer textiles that are used for comfort-adjusting jackets, which become increasingly insulating when the temperature decreases, but do not morph to change the insulation when it becomes hot. Such bilayer comfort-adjusting textile can also be used for many other applications, such as quilts, sleeping bags, tent fabrics, and trousers. This increased insulation results in the simplest case since the large spring index muscles are sewn in the outer faces of a two-layer textile, so the expansion of these artificial muscles during cooling causes these two layers to separate and thereby open up insulating air voids in the textile.

As used herein, in a two-layer textile, each of the layers has a face that is facing the other layer (which are referred to as the "inner faces" of the two layers) and each of the layers has an opposite face that is facing away from the other layer (which are referred to as the "outer faces" of the two layers). Being on or between the inner faces of the two layers is referred to as being on or between the two layers. Being on or outside the outer faces of the two layers is referred to as being on or outside the two layers. Again, in this EXAMPLE 41, the large spring index muscles are sewn in the outer faces of a two-layer textile such that the large spring index muscles are on or outside the two layers.

Figure 34B:
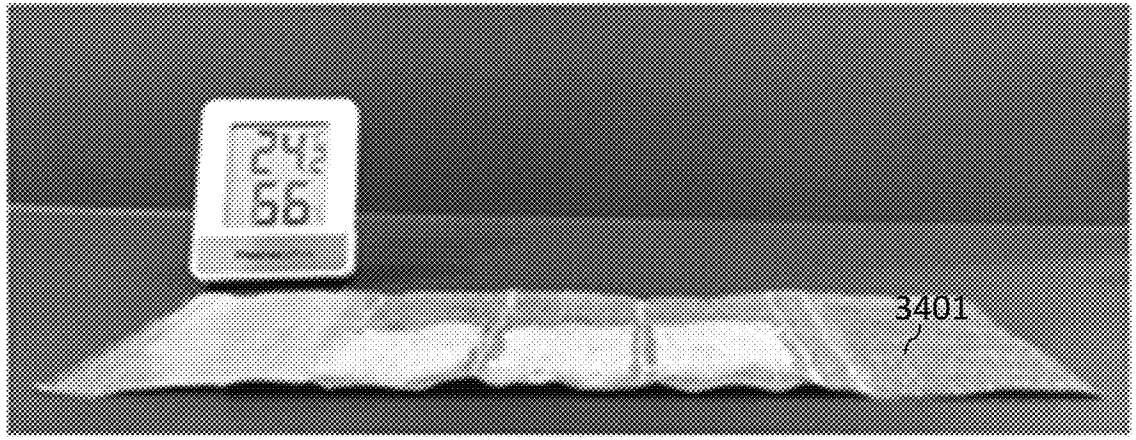
FIGS. 34A-34E show application of ply-extracted high-spring-index coiled muscles in bilayer textiles.
Figure 34C:
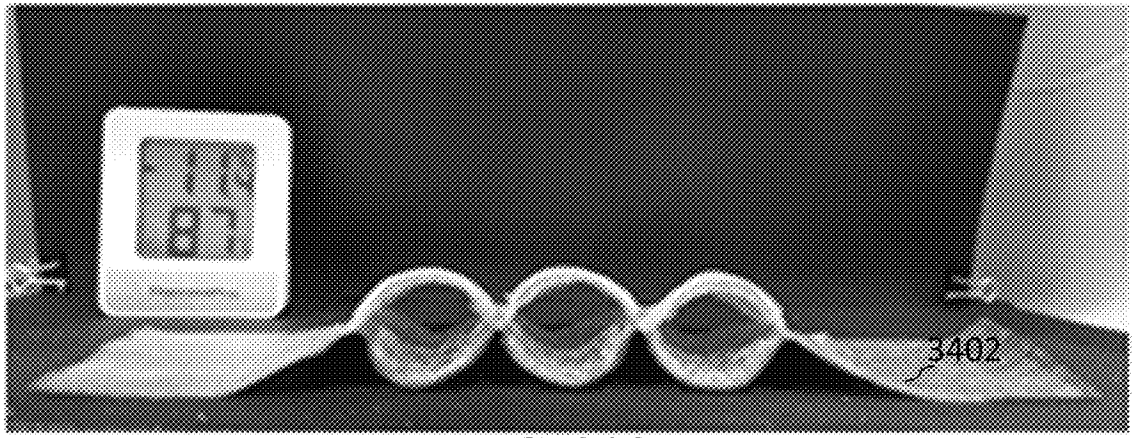
Figure 34A:
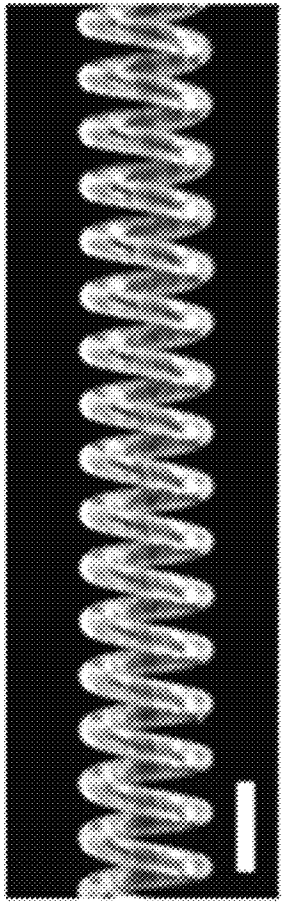
Figure 34D:
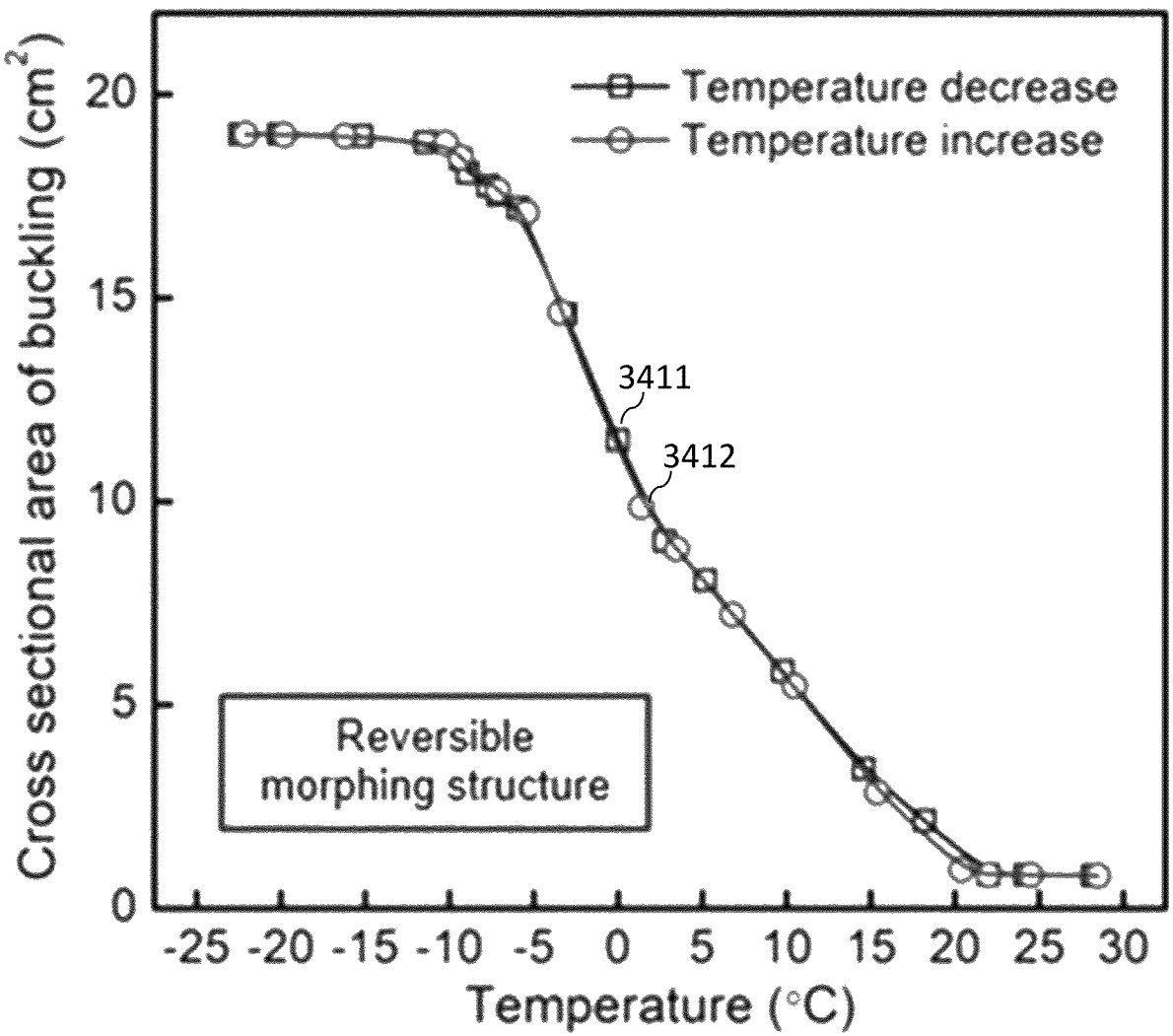
Figure 34E:
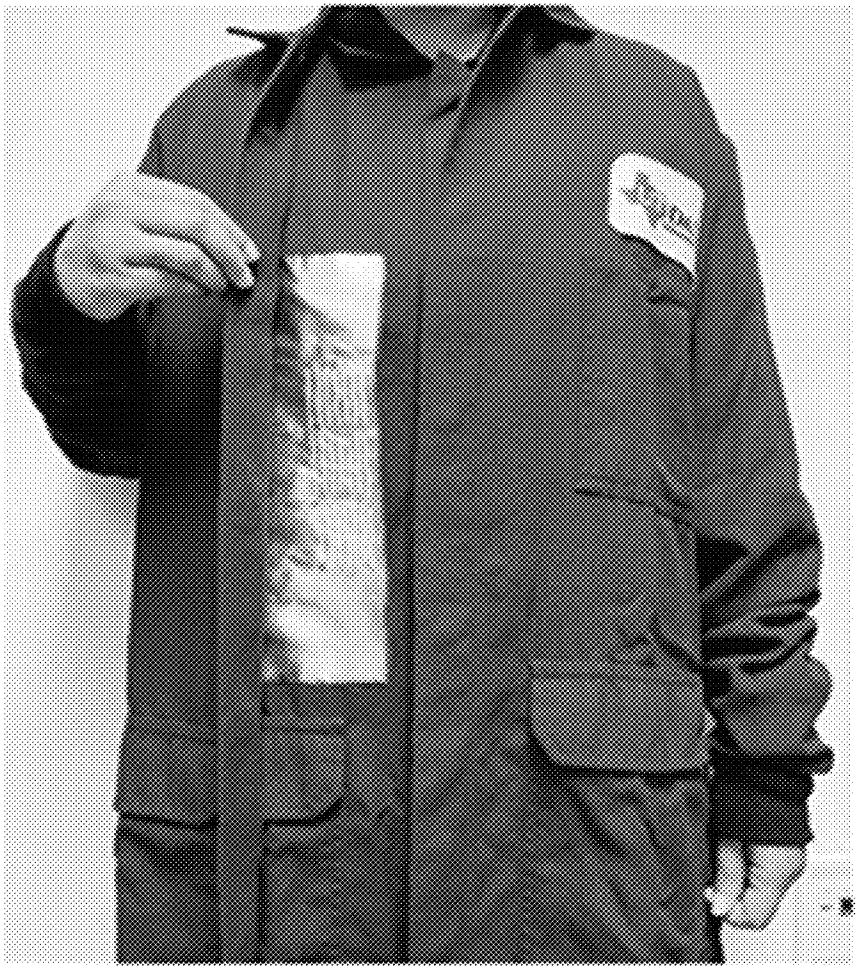

The actuation of this textile that deploys the ply-extracted high-spring-index coiled muscles is shown in FIGS. 34A-34D. FIG. 34A shows one of the used homochiral ply-extracted polymer muscles. FIGS. 34B-34C show planar textile 3401 and the morphing to morphed textile 3402 to increase insulation as the temperature decreases from 24 to ~11° C. FIG. 34D shows the cross-sectional area of the buckling (which opens the insulating air voids, such as in morphing textile 3402) as a function of temperature. The specific geometry that has been previously used for jackets that deploy mandrel-coiled polymer muscles [Ridley '979 Patent] is described in a Ridley '188 Application. This homochiral geometry can be used for the less-expensive produced mandrel-free-fabricated ply-extracted coiled muscles of the present invention to make a textile that become more thermally insulating when temperature decreases. Also, the mandrel-free-fabricated ply-extracted coiled heterochiral muscles (such as shown in EXAMPLE 31) can be deployed in the previously used weave of Ridley '188 Application to make an actuating textile that becomes more insulating when heated.

As used herein, unless otherwise indicated, insulation is referring to thermal insulation, i.e., the resistance to conductive heat flow, which is measured in terms of thermal resistance or R-value. R-value is the temperature difference per unit of heat flux needed to sustain one unit of heat flux between the warmer surface and colder surface of a barrier (such as a bi-layer textile) under steady-state conditions. The higher the R-value, the greater the insulating effectiveness. A change of the R-value is a change of insulation. I.e., an increase of the R-value is an increase of insulation, and a decrease of the R-value is a decrease of insulation. In some embodiments, the change of insulation is a change of at least 5% of the R-value. In further embodiments, the change of insulation is a change of at least 10% of the R-value.

Example 42

Figure 35:
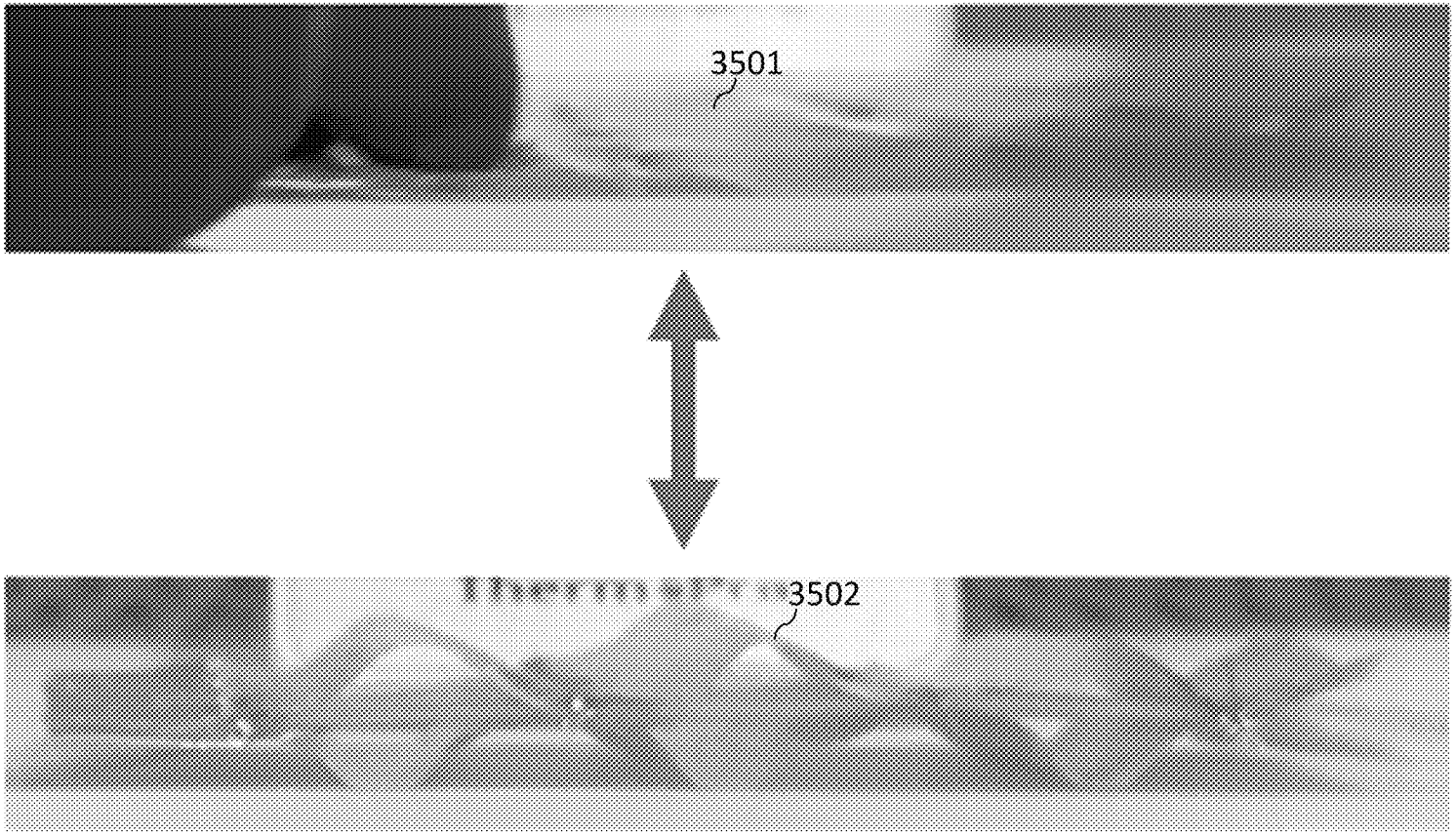
FIG. 35 shows a two-layer intelligent textile that increases insulation when ply-extracted coiled muscles are used between the two textile layers.

EXAMPLE 42 describes the configuration of the present invention for a two-layer intelligent textile that increases insulation during heating when homochiral ply-extracted coiled muscles are used on and between these two layers and increases insulation during cooling when heterochiral ply-extracted coiled muscles are used between these two layers. FIG. 35 provides images taken of the planar sheet structure 3501 at room temperature and the highly morphed sheet structure 3502 at −7° C. Stacks of these new configurations containing alternating two-layer textiles having these different chiral structures can provide a stack that could be used to provide intelligent insulation for a building by increasing insulation when either it becomes too hot or it becomes too cold outside.

Mandrel-Free Fabrication of High-Spring-Index Homochiral Polymer Fibers or Yarns The following mandrel-free process was developed for fabricating high-spring-index polymer fibers. The final product high-spring-index coiled structure can optionally include either a single fiber or a single yarn, although many of these could be simultaneously made by the mandrel-free process described herein. Unless otherwise indicated, the mentioned term yarn or fiber can be extended to either yarns or fibers or their combination in a plied structure. The term yarn or fiber length means the length within the coiled structure. The mandrel-free method includes inserting twist into the individual fibers at below the twist level needed for coiling, plying these twisted fibers to create coils for each ply, thermally annealing the torsionally and positionally tethered plied fiber at a temperature that is sufficiently high to largely freeze the coils of the plied fibers, but not so high that these plied fibers weld together. During plying, each fiber serves as a mandrel for other fibers, which indicates that mandrel-coiling is not needed.

A second thermal anneal is then applied to non-tethered ply-extracted fibers in order for them to achieve a uniformly coiled, mechanically-equilibrated structure that has an increased spring index and a correspondingly reduced inter-coil separation. These ply-extracted coiled fibers before and after the second thermal anneal are called pre-PEC fibers and PEC fibers, respectively. These pre-PEC fibers are called frozen-coil, since the first thermal anneal stabilizes the coiled structure, so that it largely retains its length and coil bias angle when the positional and torsional tethering is removed at room temperature. However, this term does not mean that the fiber does not untwist and change length when undergoing the second thermal anneal, during which torsional and positional tethering is removed.

Figure 36A:
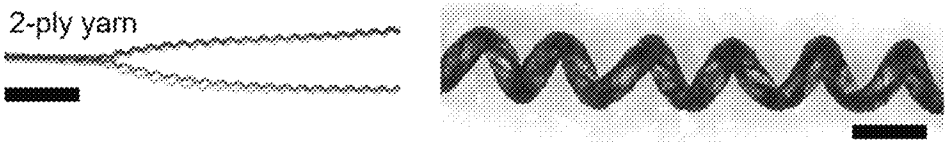
Figure 36B:
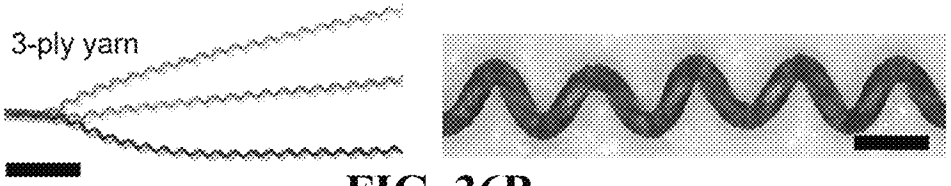
Figure 36C:
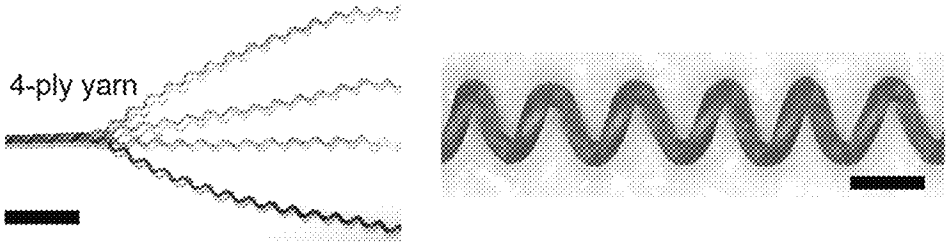
Figure 36D:
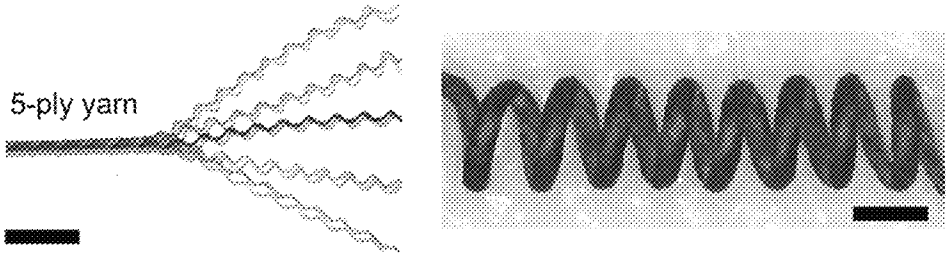
Figure 36E:
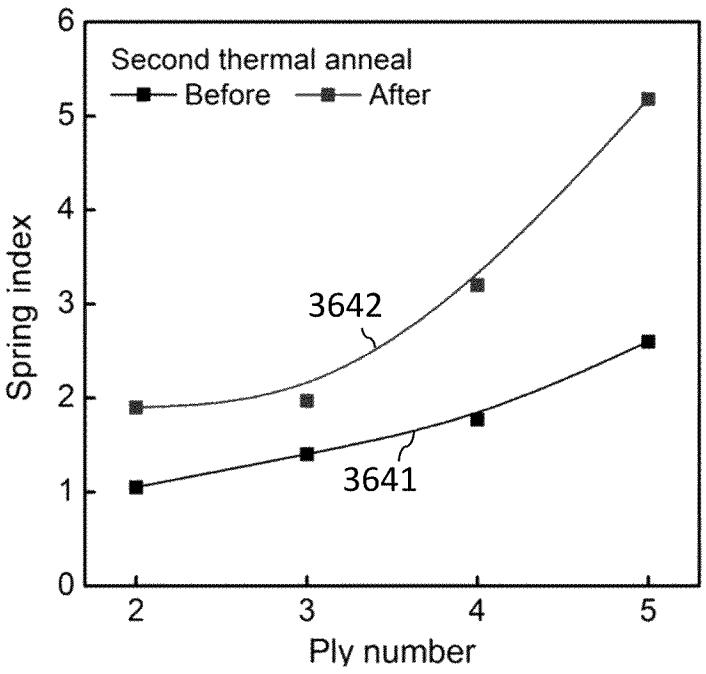
Figure 36F:
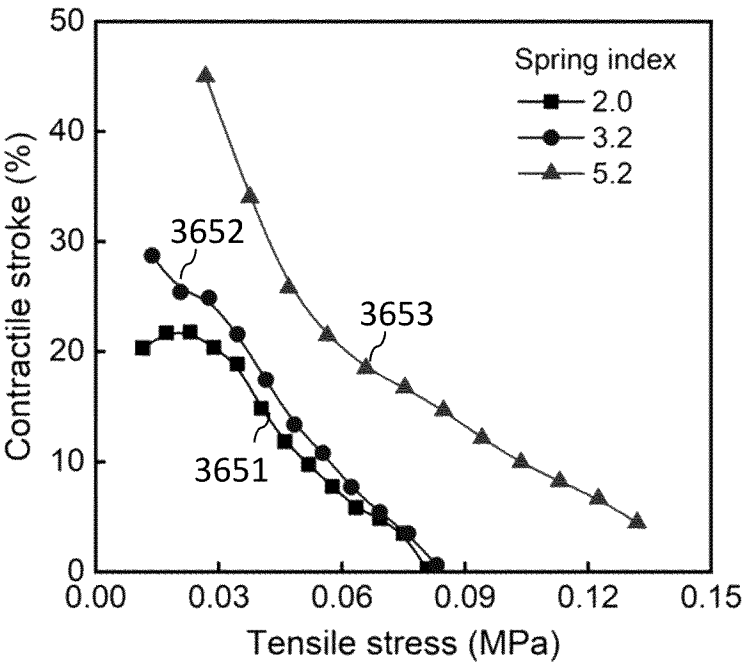

Such mandrel-free process can be used for various precursor polymer fibers and is shown for nylon-6 and polyurethane fibers. See FIGS. 36A-36D (showing, on their left, photographs of partially unplied yarns having different ply numbers (2-ply, 3-ply, 4, ply, and 5-ply, respectively) after first thermal annealing at 160° C. for 90 minutes and, on their right, photographs of the corresponding derived ply-extracted polyurethane fibers after the second thermal annealing at 200° C. for 5 minutes); FIG. 36E (plots 3641-3642, respectively, for before and after annealing, for spring index by ply number); FIG. 36F (plots 3651-3653 for, respectively, fibers having spring indexes of 2.0, 3.2, and 5.2 (derived from 3-ply, 4-ply, and 5-ply polyurethane yarns, respectively) for contractile stroke on the applied tensile stress).

Figure 37A:
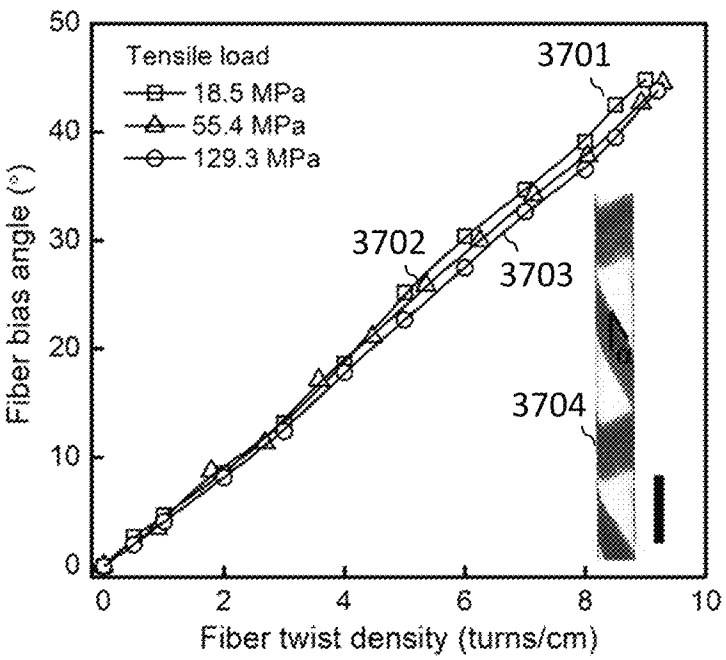
FIGS. 37A-37D show the effects of twist density and twist load on PEC fiber geometry.
Figure 37B:
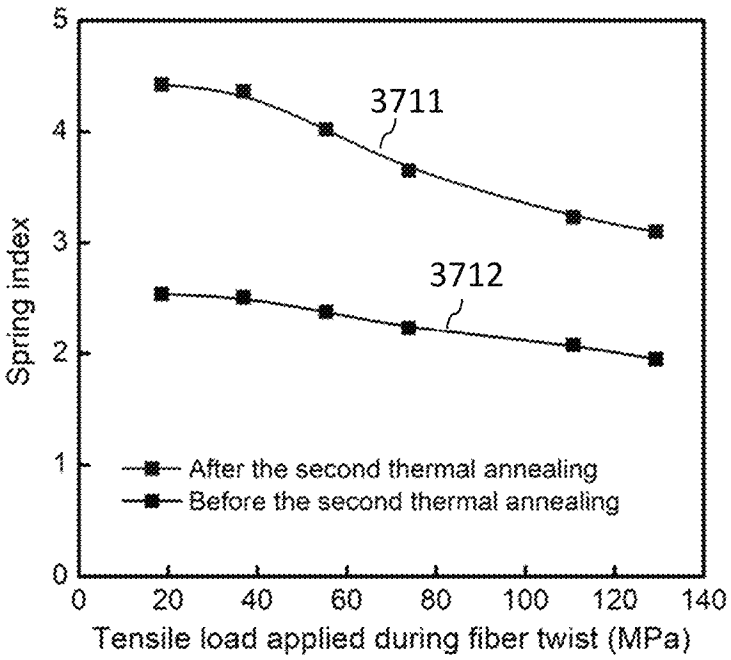
Figure 37C:
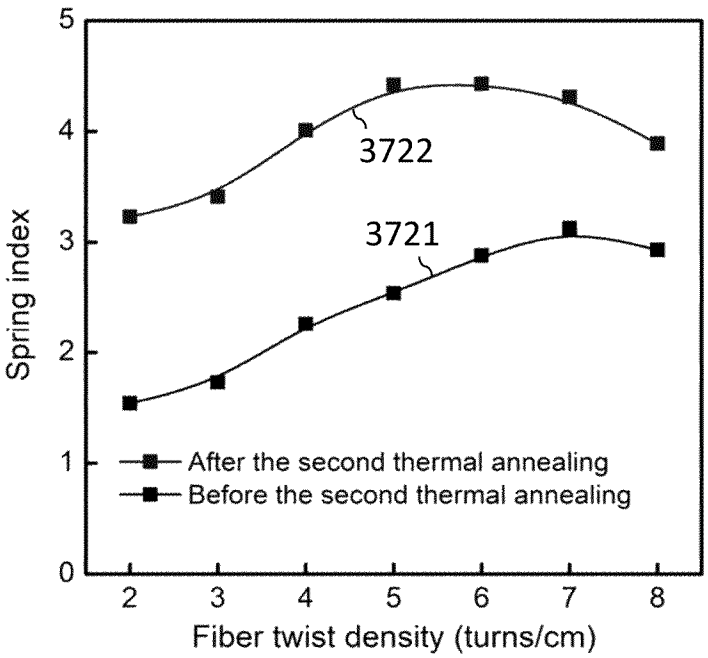
Figure 37D:
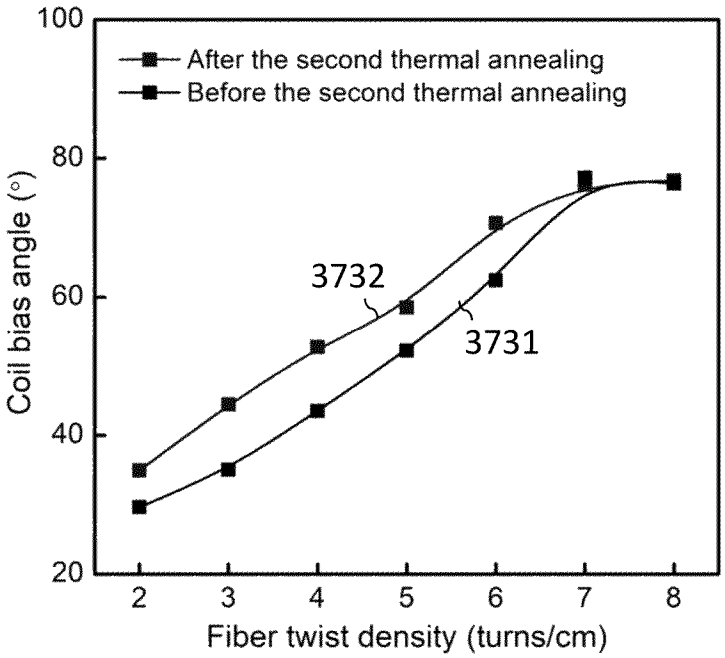

Unless otherwise mentioned, the described experiments used nylon-6 fishing line fibers. When these plied nylon-6 fibers were first thermally annealed, they were in vacuum at 120° C. for 2.5 hours while the plied fibers were positionally and torsionally tethered. Applying a high twist density to the precursor fiber under a small load before plying can increase the fiber bias angle, which results in a large spring index for PEC fibers. See FIGS. 37A-37D. FIG. 37A shows dependence of fiber bias angle on fiber twist density for a 0.28-mm-diameter nylon fiber 3704 that was twisted until just before the onset of coiling. The different curves 3701-3703 are for when tensile loads of 18.5, 55.4, or 129.3 MPa, respectively, were used for fiber twist insertion. Note that these different tensile loads do not significantly affect the twist density at which coiling initiates, since the maximum indicated pre-coiling twist density is ~9.0 turns/cm for all of these tensile loads. Inset of FIG. 37A is an optical microscope image (scale bar: 0.5 mm) of twisted fiber 3704 having a twist density of 6.0 turns/cm and a fiber bias angle ($\alpha$) of 27.5° for a tensile stress of 129.3 MPa. FIG. 37B shows dependence of the spring index of 2-ply extracted fibers on the tensile load applied during fiber twist, when measured before and after the second thermal anneal (plots 3711-3712, respectively). Before applying a 4.5 turns/cm twist under 18.5 MPa load during plying, the individual fibers were twist inserted to 5.0 turns/cm. FIGS. 37C-37D show, respectively, dependencies of the spring index (FIG. 37C, plots 3721-3722, respectively, for before and after second thermal annealing) and the coil bias angle (FIG. 37D, plots 3731-3732, respectively, for before and after second thermal annealing) of pre-PEC and corresponding PEC fibers on the fiber twist density. The twist loads during fiber twist and yarn plying were the same (18.5 MPa), and the plying twist density was ~4.5 turns/cm. The second thermal anneal temperature for the above two-ply-extracted fiber was ~120° C. for 20 seconds. Unless otherwise mentioned, a twist density of 5.0 turns/cm under an 18.5 MPa load was used for nylon fiber twist to maximize the spring index of PEC fibers. Also, they were plied under this tensile stress until just below the onset of coiling or snarling. Tensile stresses were normalized to the fiber's cross-sectional area after fiber twist and before plying, or to n times this area when n fibers are plied.

Within the limits needed to provide uniformly coiled component fibers, the spring index can be increased by increasing the number of plies. For 0.28-mm-diameter precursor nylon-6 fibers, increasing the ply number from 2 to 5 increased the spring index of PEC fibers from 4.4 to 7.0. However, when the ply number exceeded 5, close packing of these fibers in the plied structure requires one fiber (or possibly alternating segments of all plies) to be in the center, so uniform coiling of all fibers did not generally occur.

The temperature used for the second thermal anneal was between the first thermal anneal temperature and the fiber's melting point. It was found that an optimized second thermal anneal temperature can further increase the spring index of PEC fibers. This spring index increase and more uniform coiling result, since relaxation to a lower energy high-spring-index coiled structure was no longer constrained by neighboring plies. This second thermal anneal was also used to fabricate a multi-spring-index coiled fiber by using region-selected thermal treatment. For example, three different second anneal temperatures of 120, 193, and 135° C. were used to thermally treat different adjacent fiber segments in a two-ply-extracted pre-PEC fiber, which resulted in spring indexes of 2.3, 5.9, and 2.9, respectively. See FIG. 33.

Additionally, this second thermal anneal was used to increase the spring index of a self-coiled fiber. However, even though these thermal annealing processes were quite similar to those used to increase the spring indexes of pre-PEC fibers, the spring index increases were much smaller for self-coiled fibers.

It was found that an effective method for dramatically increasing the spring index of PEC fibers was to reduce the twist density during plying. It is our belief that this is because a low plying twist density causes a long fiber length per coil and such long fiber length per coil is needed if the transformed fiber is to have a high spring index.

Example 43

EXAMPLE 43 describes the dependence of spring index of nylon-6 PEC fibers on the plying twist density. For precursor fibers having diameters from 0.13 mm to 0.56 mm, FIG. 38A (plots 3801-3805 for precursor fibers having diameters of 0.13 mm, 0.20 mm, 0.28 mm, 0.42 mm, and 0.56 mm, respectively) shows that the spring index of 2-ply-extracted PEC fibers increases with decreasing plying twist density. For example, a very small plying twist density of 0.69 turns/cm provided a very high spring index of 56.5 for a PEC fiber made from a 0.56-mm-diameter precursor fiber.

While the dependence of the spring index on plying twist density strongly depends on the precursor fiber diameter, it was found that the spring index of a PEC fiber was the same as long as the product of plying twist density and precursor fiber diameter was kept constant. See FIG. 38B (plots 3811-3815 for precursor fibers having diameters of 0.13 mm, 0.20 mm, 0.28 mm, 0.42 mm, and 0.56 mm, respectively).

For these different diameter PEC fibers, the fiber bias angle, the load during fiber twist and yarn plying, and the first and second thermal anneal processes were kept the same. Hence, as long as these fabrication conditions were kept constant, one can predict and control the spring index of PEC fibers having any diameter between 0.13 and 0.56 mm from results for one fiber having a diameter in this range.

Figure 38A:
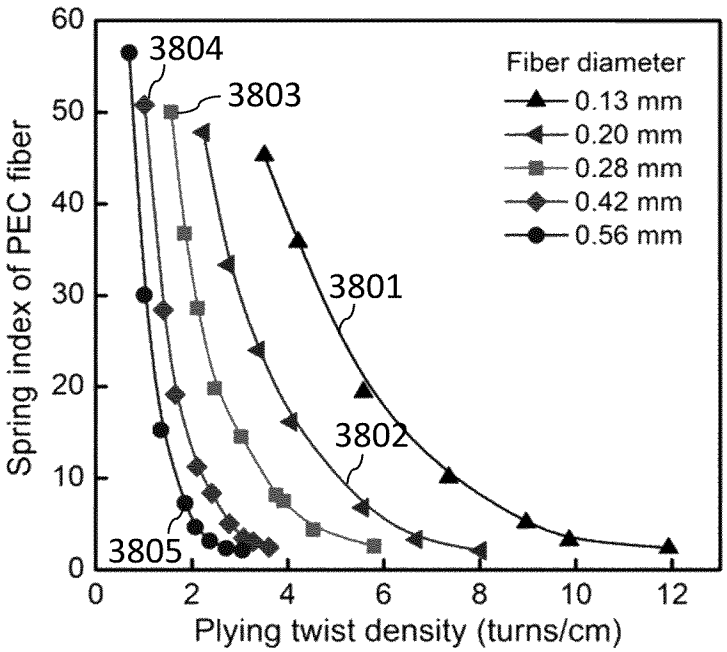
FIGS. 38A-38D shows spring index of nylon-6 PEC fibers of various precursor fiber diameters on the plying twist density.
Figure 38B:
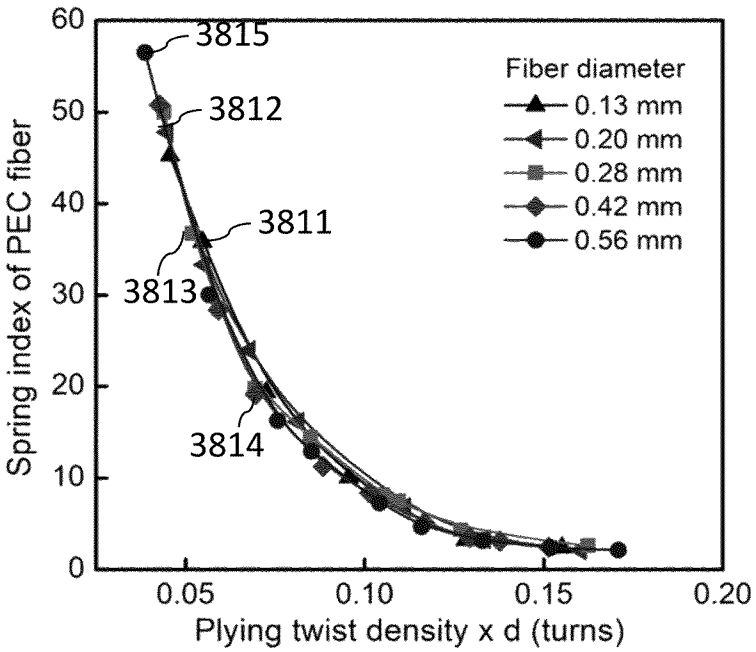

For precursor fibers having diameters from 0.13 mm to 0.56 mm, FIG. 38A shows that the spring index of 2-ply-extracted PEC fibers increases with decreasing plying twist density. For example, a very small plying twist density of 0.69 turns/cm provided a very high spring index of 56.5 for a PEC fiber made from a 0.56-mm-diameter precursor fiber. While the dependence of the spring index on plying twist density strongly depends on the precursor fiber diameter, it was found that the spring index of a PEC fiber was the same as long as the product of plying twist density and precursor fiber diameter was kept constant (FIG. 38B).

For these different diameter PEC fibers, the fiber bias angle, the load during fiber twist and yarn plying, and the first and second thermal anneal processes were kept the same. Hence, as long as these fabrication conditions were kept constant, the spring index of PEC fibers having any diameter between 0.13 and 0.56 mm can be predicted and controlled from results for one fiber having a diameter in this range.

When the tensile load during plying was increased in the range from 18.5 to 64.6 MPa, the spring index of the PEC fibers negligibly changed. The described coincidence of torsional-deformation-related processes for different diameter fibers (spring index in FIG. 38B and tensile stroke in FIG. 32E) result, since the torsional deformation during plying depends upon the product of plying twist density and fiber diameter, which is like the dependence of a twisted fiber bias angle on the product of twist density and fiber diameter during fiber twist.

The coil bias angle and the length per coil (normalized to fiber diameter) strongly depended on the precursor fiber diameter (FIG. 38A). However, these parameters were approximately constant when the product of plying twist density and fiber diameter was constant (FIG. 38B) if the thermal treatments, fiber bias angle, and the mechanical load during fiber twist and yarn plying were kept constant. This length per coil is $L_{coil}=\pi d(SI)(1/\sin \alpha)$, where SI is the spring index and a is the coil bias angle.

Figure 39D:
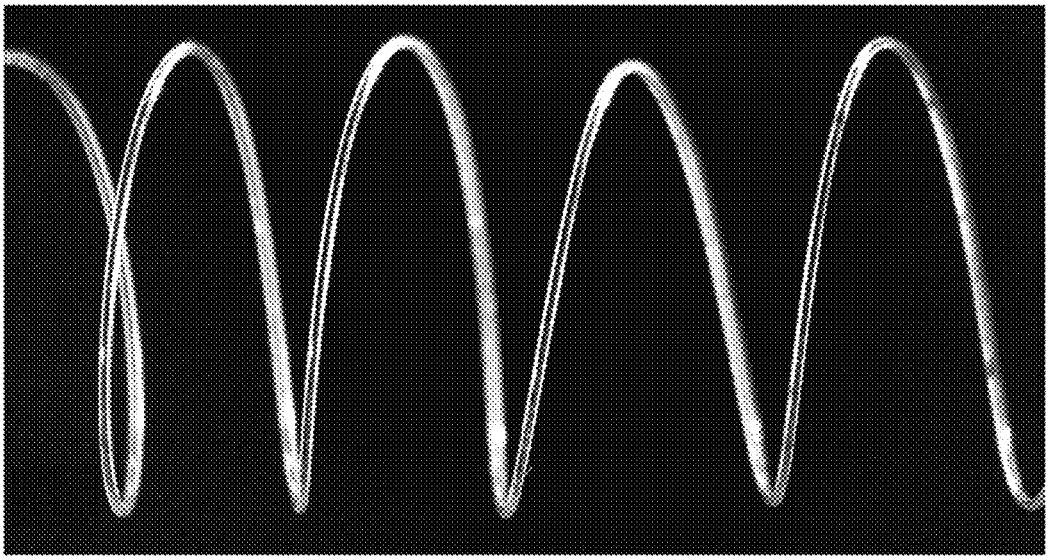
FIGS. 39A-39F show optical microscope images of plied and PEC fibers made from nylon-6 fibers fabricated using the mandrel-free processes.
Figure 39C:
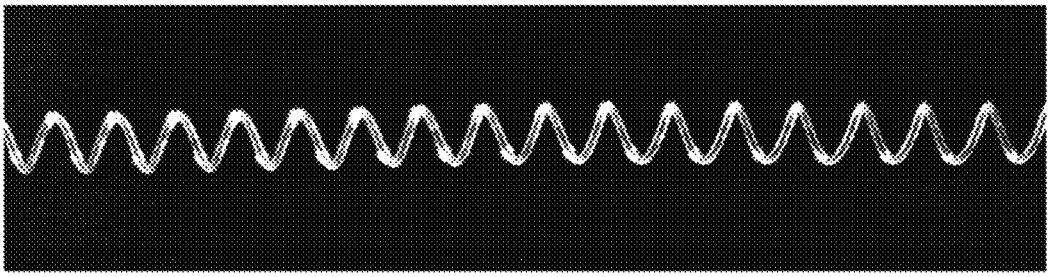
Figure 39B:
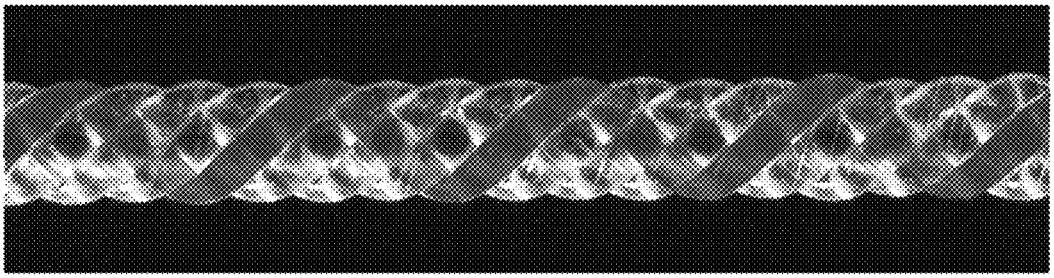
Figure 39A:
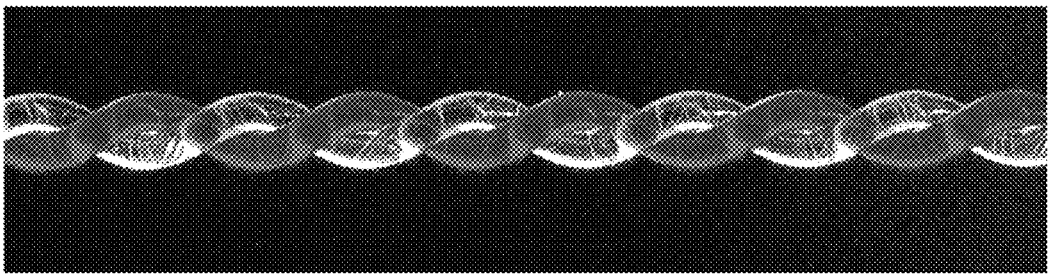
Figure 39F:
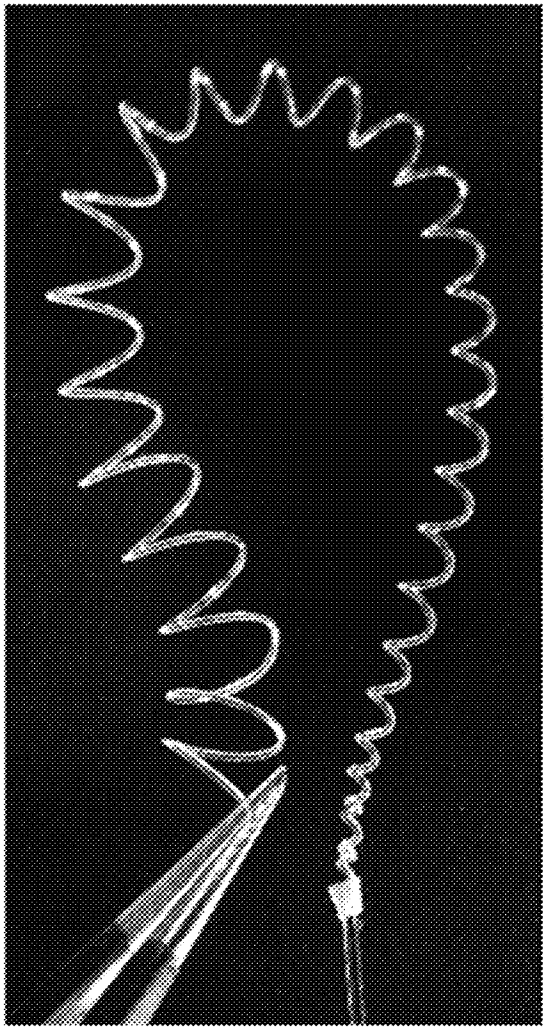
Figure 39E:
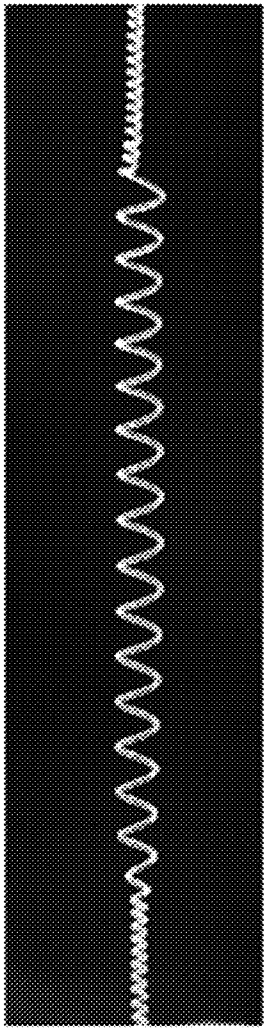

A Single Fiber or Yarn with Multiple Twist Levels and Corresponding Spring Indexes For conventional fiber or yarn twist, twist was inserted into a fiber or yarn by twisting one end and torsionally tethering the opposite end. See, e.g. As a result, the same twist density was obtained for any position along the fiber's length (FIGS. 39A-39D). To make a fiber having twist densities that vary along its length (such as shown in FIGS. 39E-39F), a fiber-region-separated twist method was used, which included inserting an initial twist into the entire fiber, torsionally tethering separated regions, and then inserting or removing a given twist from fiber regions that are not torsionally tethered (as illustrated in FIG. 40A and described in EXAMPLE 44).

Example 44

EXAMPLE 44 describes the fabrication of a single nylon-6 fiber or yarn with multiple twist levels and corresponding spring indexes. For conventional fiber or yarn twist, twist was inserted into a fiber or yarn by twisting one end and torsionally tethering the opposite end. As a result, the same twist density was obtained for any position along the fiber's length.

Figure 40A:
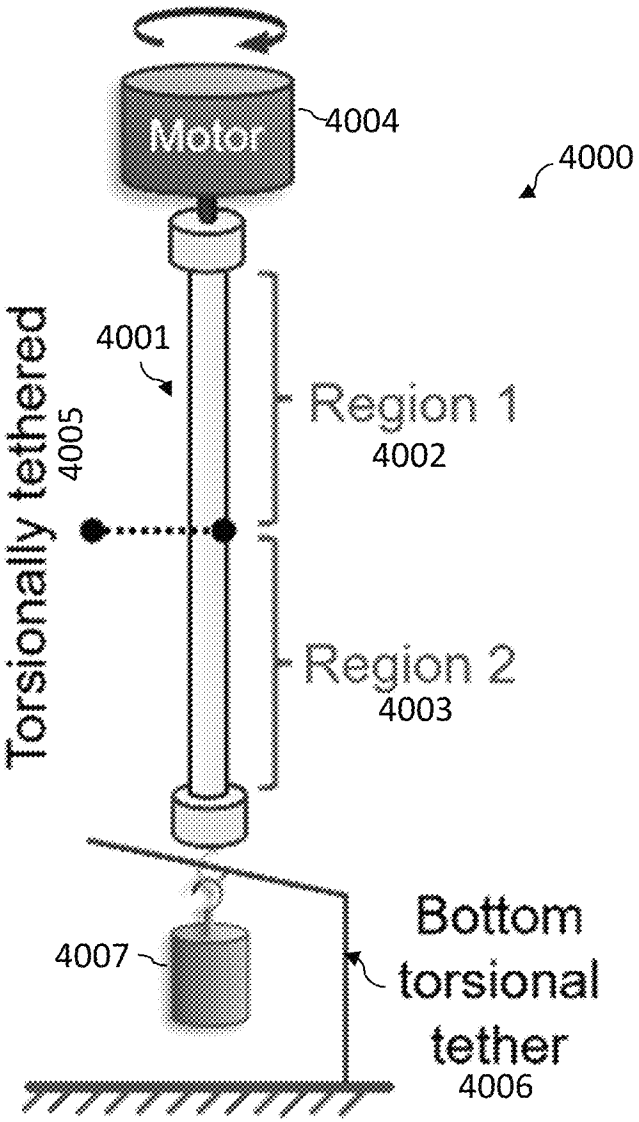
FIGS. 40A-40C show fabrication of a single nylon-6 fiber or yarn with multiple twist levels and corresponding spring indexes.

To make a fiber 4001 having twist densities that vary along its length (first region 4002 and second region 4003 of fiber 4001), a fiber-region-separated twist method 4000 shown in FIG. 40A was used, which method 4000 included:

(a) Inserting an initial twist into the entire fiber by utilizing weight 4007 and a bottom torsional tether 4006 at bottom of the fiber 4001 (bottom end of second region 4003) and then rotating at the top end of fiber 4001 (top end of first region 4002) using motor 4004.

(b) Torsionally tethering 4005 at the point of fiber 4001 (which is at the transition from first region 4002 and second region 4003). Such torsional tethering 4005 is also referred to herein as the "midpoint torsional tether" even if the first region 4002 and second region 4003 are not the same length).

(c) Inserting or removing a given twist to only first region 4002 using motor 4004.

Figure 40B:
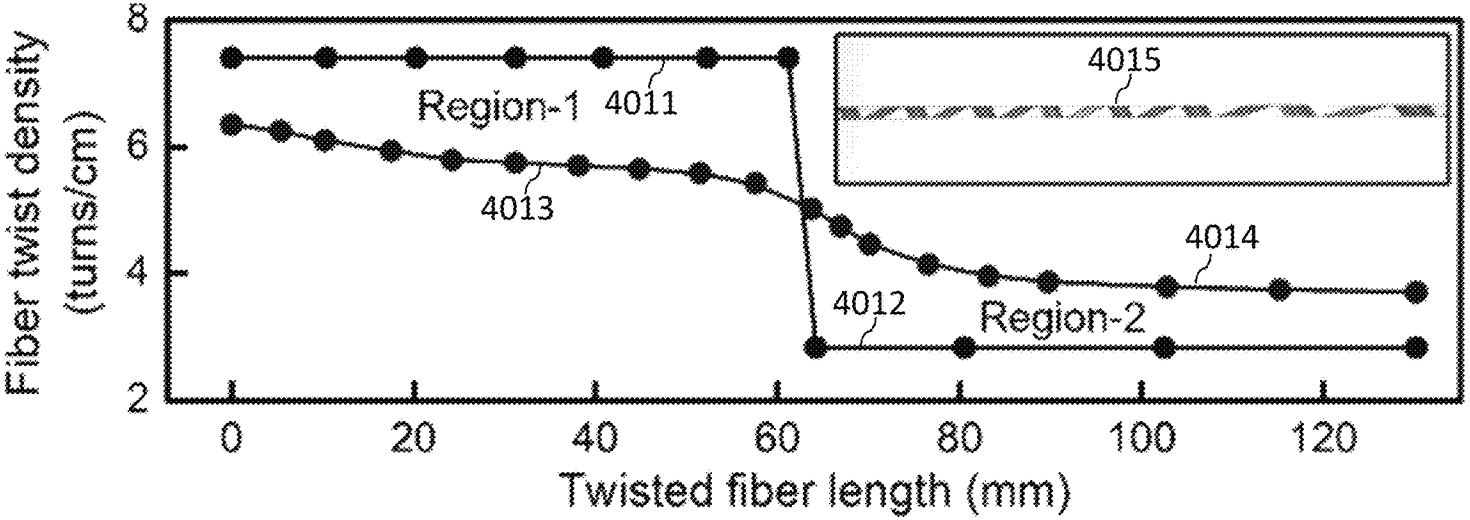

The use of the fiber-region-separated twist method 4000 has demonstrated a method that provides a quite simple structure 4015, in which a single fiber has different twist densities in two different fiber regions. See FIG. 40B. Initially, 2.83 turns/cm of twist was inserted into a 0.28-mm-diameter, 130-mm-long fiber, and then the midpoint of this fiber was torsionally tethered and an additional twist of 4.57 turns/cm was inserted between the fiber's non-tethered end and its midpoint. (The first region 4002 and second region 4003 are also referred to herein as "region-1" and "region-2," respectively). Since both ends of region-2 are torsionally tethered, the twist inserted in region-1 cannot be transferred to region-2 until the midpoint torsional tether is removed. Plots 4011-4012 show the fiber twist density of the fiber before the midpoint torsional tether was removed. Consequently, the twist densities in region-1 and region-2 are 7.40 and 2.83 turns/cm, respectively. FIG. 40B (plots 4011-4012 show the fiber twist density of the fiber the midpoint torsional tether was removed). After removing the midpoint torsional tether, part of the twist in the highly twisted region was transferred to the low twist region. FIG. 40B (plots 4013-4014 show the fiber twist density of the fiber after the midpoint torsional tether was removed).

Figure 40C:
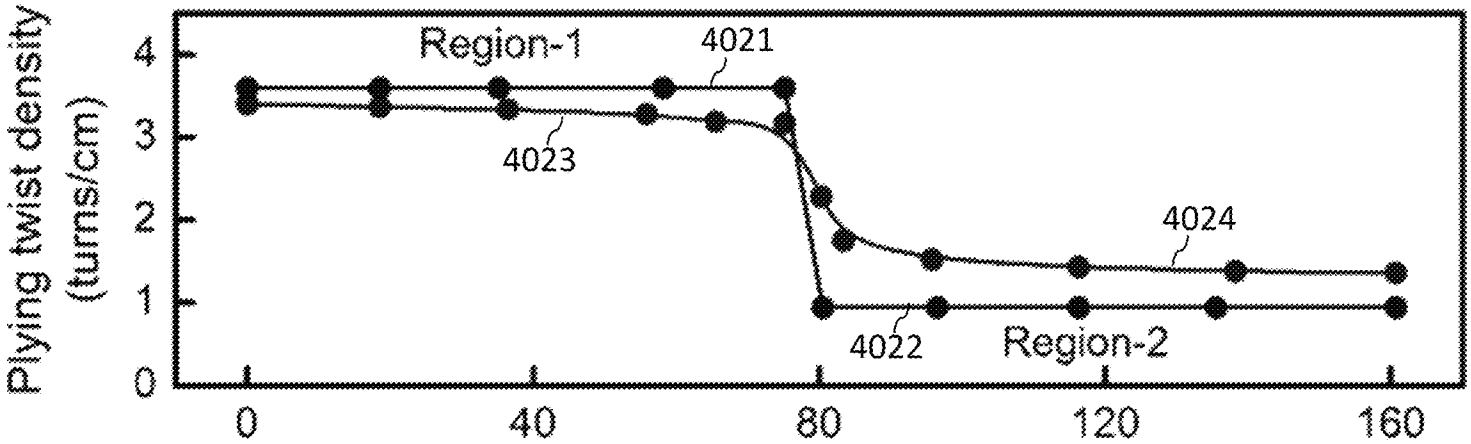

Much more complicated distributions of fiber twist can be introduced by using multiple tethering points during twist insertion, or twist insertion and twist removal, for different fiber regions and then removing all of these internal tethers. The above fiber twist method was also used for profiling plying twist in FIG. 40C, where different plying twists were introduced in different regions of a 2-ply yarn. After applying plying twists of 0.94 and 3.60 turns/cm, respectively, to region-2 and region-1, the midpoint torsional tether was removed, enabling some of the plying twist to transfer from the highly twisted plied segment to the less twisted plied segment. FIG. 40C (plots 4021-4022 show the fiber twist density of the fiber the midpoint torsional tether was removed, and plots 4023-4024 show the fiber twist density of the fiber after the midpoint torsional tether was removed). Since plying twist density importantly affects the spring index (FIG. 38B), the resulting PEC fiber has a wide distribution of spring indexes along its length.

Using the same type of process but applying it to more than two segments of a plied yarn, PEC fibers having various coil geometries were made. For example, FIG. 39E shows a PEC fiber in which both ends have the same small spring-index (2.6), while the middle segment has a large spring-index (9.6). FIG. 39F shows an intentionally-bent PEC fiber having gradually-increased spring indexes from one end (spring index: 2.4) to the opposite end (spring index: 18.1). It is difficult to make the above coiled structures by using the conventional mandrel-coiling method, since the needed variable mandrel diameter would make it impossible to remove the mandrel-coiled fiber from the mandrel unless the mandrel is dissolved. This ability to profile the spring index of a muscle fiber in diverse ways will enable quite different actuation for various segments of the muscle's length, which can be usefully deployed when needed for robotic applications. This method for continuously profiling spring indexes can be used to produce record muscle strokes, so that muscle contraction is not limited by inter-coil contact.

The use of this fiber-region-separated twist method to provide a quite simple structure has been demonstrated in which a single fiber has different twist densities in two different fiber regions. As discussed in EXAMPLE 44, initially, 2.83 turns/cm of twist were inserted into a 0.28-mm-diameter, 130-mm-long fiber, and then the midpoint of this fiber was torsionally tethered and an additional twist of 4.57 turns/cm was inserted between the fiber's non-tethered end and its midpoint. The top and bottom regions of this fiber are called region-1 and region-2, respectively. FIG. 40B. Since both ends of region-2 were torsionally tethered, the twist inserted in region-1 cannot be transferred to region-2 until the midpoint torsional tether is removed. Consequently, the twist densities in region-1 and region-2 are 7.40 and 2.83 turns/cm, respectively. FIG. 40B. After removing the midpoint torsional tether, part of the twist in the highly twisted region was transferred to the low twist region. FIG. 40B. The twist density was indicated by the observed fiber bias angle (FIG. 40B), since these two parameters are approximately linearly correlated (FIG. 37A).

As further discussed in EXAMPLE 44, much more complicated distributions of fiber twist can be introduced by using multiple tethering points during twist insertion, or twist insertion and twist removal, for different fiber regions and then removing all of these internal tethers. The above fiber twist method was also used for profiling plying twist in FIG. 40C, where different plying twists were introduced in different regions of a 2-ply yarn. After applying plying twists of 0.94 and 3.60 turns/cm, respectively, to region-2 and region-1, the midpoint torsional tether was removed, enabling some of the plying twist to transfer from the highly twisted plied segment to the less twisted plied segment. FIG. 40C. Since plying twist density importantly affected the spring index (FIG. 38B), the resulting PEC fiber had a wide distribution of spring indexes along its length.

Using the same type of process but applying it to more than two segments of a plied yarn, PEC fibers were made having various coil geometries. For example, FIG. 39E shows a PEC fiber in which both ends have the same small spring-index (2.6), while the middle segment has a large spring-index (9.6). FIG. 39F shows an intentionally-bent PEC fiber having gradually-increased spring indexes from one end (SI: 2.4) to the opposite end (SI: 18.1). It is difficult to make the above coiled structures by using the conventional mandrel-coiling method, since the needed variable mandrel diameter would make it impossible to remove the mandrel-coiled fiber from the mandrel unless the mandrel is dissolved. This ability to profile the spring index of a muscle fiber in diverse ways will enable quite different actuation for various segments of the muscle's length, which can be usefully deployed when needed for robotic applications. This method for continuously profiling spring indexes can be used to produce record muscle strokes, so that muscle contraction is not limited by inter-coil contact.

An interesting case is when the spring indexes are large and the variation in spring index between neighboring coils is sufficient large that successive coils can interpenetrate, so that the contracted muscle has essentially a length equal to the fiber diameter. By annealing a short polymer fiber in the helical corridor of a flat plate, it was previously demonstrated that polymer muscles having this interpenetration capability can provide a contraction from full muscle length to a muscle length approximately equal to the fiber diameter. Further heating inverts muscle chirality, so that the muscle then expands to about its initial length. This demonstration, which required formation of the muscle within the helical corridor of a flat plate, is expensive and not practically applicable for a segment of a long fiber.

The actuation of a short spring-index-profiled PEC muscle segment that has a continuous gradient in spring index has been shown such that inter-coil contact is largely avoided. When heated from 25° C. to ~105° C. by using a hot-air-gun, the muscle first contracts to a near-zero-length state from its expanded state-1 and then inverts its coiled structure so that it then expands in the opposite direction to reach state-2, which at 105° C. has approximately the same length as state-1. During cooling, this muscle then contracts its state-2 structure to return to the near-zero-length state and then expands in the opposite direction to again realize state-1 at 25° C.

This demonstrated a PEC muscle that provides another type of novel behavior, since it provides a structure that has two tensile muscle states having about the same length, state-1 that is stable at 25° C. and state-2 that is stable at ~105° C. State-1 initially contracts upon heating, since it is homochiral. Then its actuation during heating inverts the coil's chirality, so the muscle becomes heterochiral, making the heated muscle expand. On muscle cooling, these processes reverse (including coil chirality inversion), thereby bringing the muscle back to its original cold-state.

Mandrel-Free Fabrication and Performance of High-Spring-Index Homochiral CNT Yarns The mandrel-free processes of the present invention can also be used for making high-spring-index CNT yarns for diverse applications. However, instead of using low temperature anneals for setting the plied polymer structure, incandescent tension annealing processes (ITAP) can be used to set the plied CNT yarn structure without causing inter-yarn covalent bonding. Like for polymer fibers, each CNT yarn was twisted to a twist density that was just below coil initiation for the applied tensile stress. These twisted CNT yarns were plied together under a tensile load until just below the plying twist at which the plied yarns begin to coil. Afterwards, they were set by ITAP in an inert environment at ~3000° C. for 1 minute by electric pulse heating. The ITAP is only used for setting the plied structure, since this heating already provides well-separated coils and additional thermal treatment will not change the structure of the ply-extracted CNT yarn. After the ITAP, individual CNT yarns were extracted from the plied structure.

For example, fabrication of ply-extracted CNT yarns can involve inserting twist into the individual CNT yarns under a tensile load of 39.0 MPa to a twist density that is just below coil initiation, plying these twisted CNT yarns in the same twist direction as used for yarn twist under a 39.0 MPa tensile load until before the plied yarns began to coil, setting the torsionally and positionally tethered plied CNT yarns using our incandescent tension annealing process (ITAP) or solvent treatment method (ethanol adsorption and evaporation at room temperature). Then, individual CNT yarns can be extracted from the plied yarns.

Figure 41B:
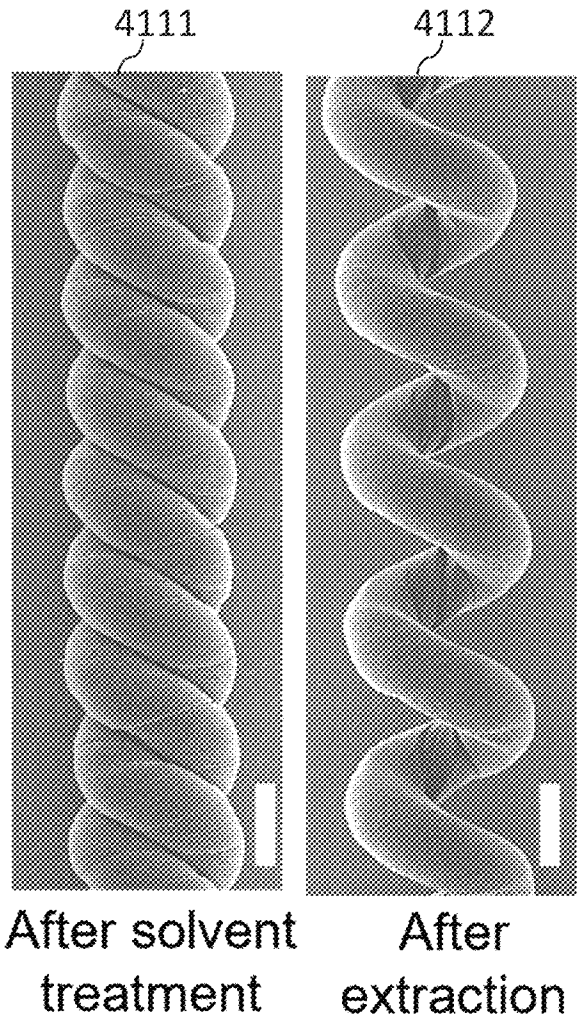
FIGS. 41A-41B show mandrel-free fabrication and performance of high-spring-index CNT yarns.
Figure 41A:
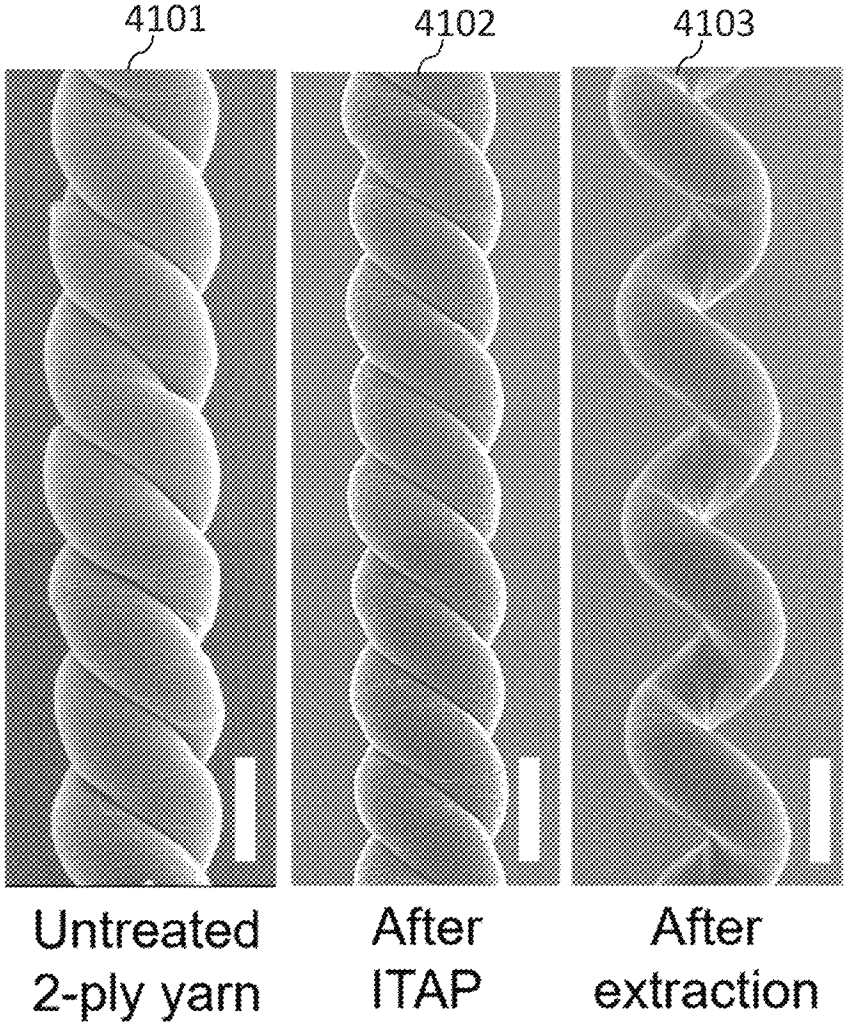

FIG. 41A shows scanning electron microscope (SEM) images 4101-4103 of, respectively, (a) the untreated 2-ply CNT yarn, (b) the plied yarn after ITAP, and (c) one of the yarns extracted from the ITAP-treated plied yarn.

Alternatively, one solvent treatment, instead of one ITAP, can be used to set the tethered plied structure. There is no need for further solvent treatment of the ply-extracted yarn, since this yarn already has uniform coiling. As for ITAP treatment, the solvent treatment (by ethanol adsorption and evaporation) eliminates the internal torque within CNT yarn that causes major yarn untwist when tethering is removed. FIG. 41B shows SEM images 4111-4112 of, respectively, (a) the solvent treated 2-ply yarn and (b) a single-ply yarn extracted from this plied yarn. For a ply-extracted CNT yarn derived from the same untreated 2-ply yarn, the spring index and the coil bias angle of the ITAP-treated yarn were smaller than for the solvent-treated yarn. This is because the ITAP treatment more completely freezes this plied structure than does solvent treatment.

Figure 42A:
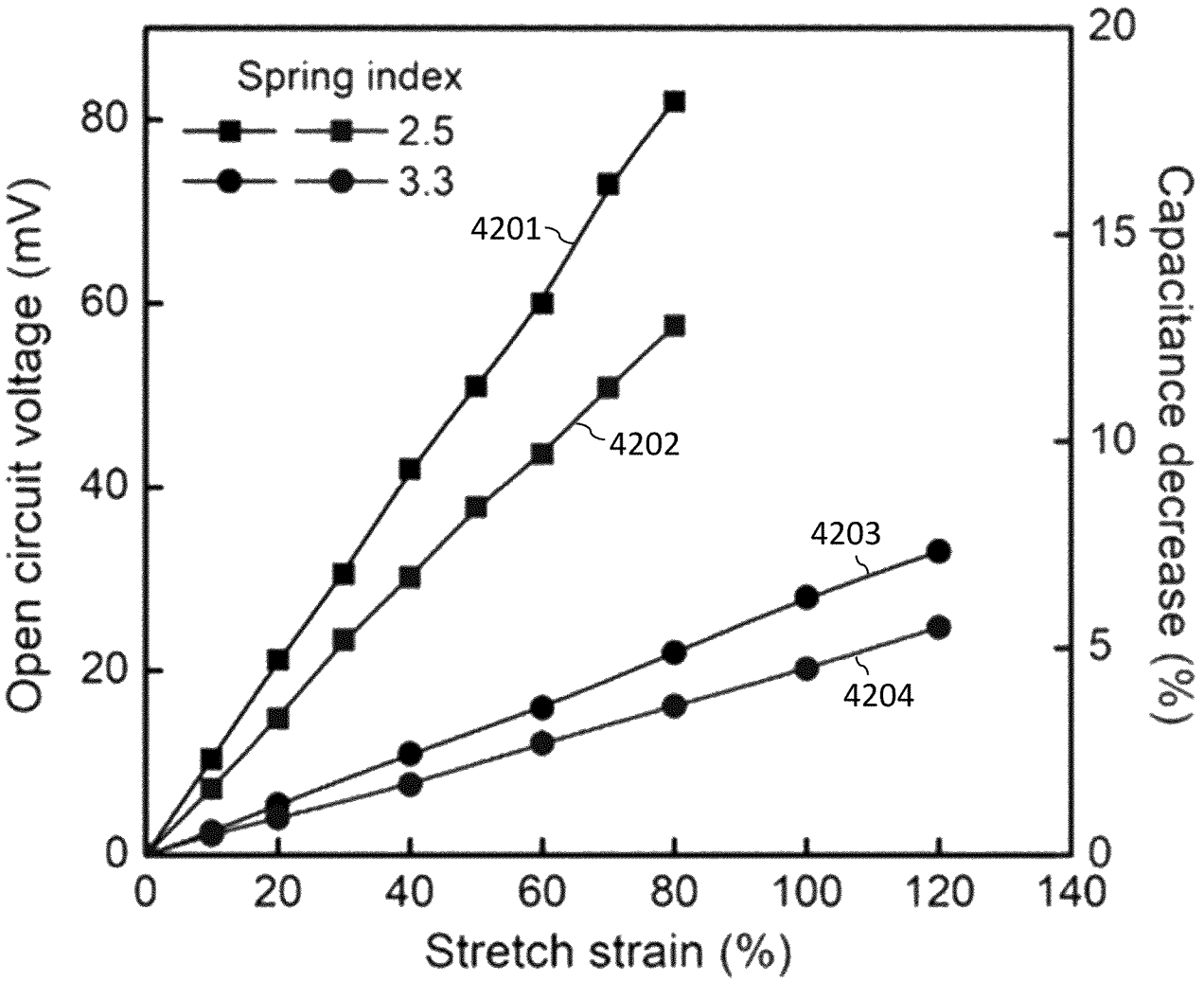
FIGS. 42A-42C show performance of high-spring-index CNT yarns applications of high-spring-index ply extracted yarns.

The use of the above solvent-treated CNT yarn was evaluated as self-powered strain sensors or energy harvesters for robotic applications, which has been previously investigated only for small spring index yarns that are self-coiled or plied. Neither of these prior small spring index yarns enable mechanical energy harvesting or sensing for giant applied strains, and both require torsional tethering during operation. (Before the high-spring-index CNT yarns were extracted from plied yarns, ethanol adsorption and evaporation was used to set their plied structures. The spring indexes for the 2-ply-extracted and the 4-ply-extracted CNT yarns were 2.5 and 3.3, respectively. Both the ply-extracted CNT yarn and the Pt-mesh-wrapped buckypaper counter electrode were in 0.1 M LiCl/10 wt % poly (vinyl alcohol) gel electrolyte, which prevented inter-electrode shorting.) As a result of large spring indexes before tensile deformation (up to 3.3, compared to typically below 1.0 for self-coiled CNT yarns), FIG. 42A shows that the open circuit voltage (plots 4201-4202) and capacitance decrease (plots 4203-4204) for these coiled springs (spring index 2.5 and 3.3, respectively) are both large and approximately linearly depend on percent elongation for both 2-ply and 4-ply extracted CNT yarns, which sense strains up to 80% and 120%, respectively.

Additionally, the spring index for the solvent-treated ply-extracted yarns can be increased to much higher values, which would enable sensing over a much higher strain range, although the voltage change per strain change would be reduced. Hence, these mandrel-free fabricated high-spring-index yarns are useful for sensing large-stroke actuation in robotic structures, which have previously used other methods.

Figure 42C:
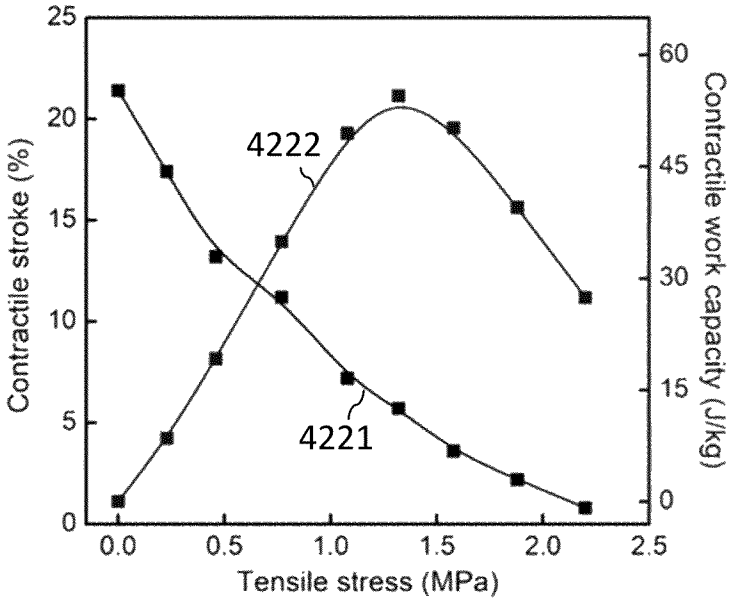
Figure 42B:
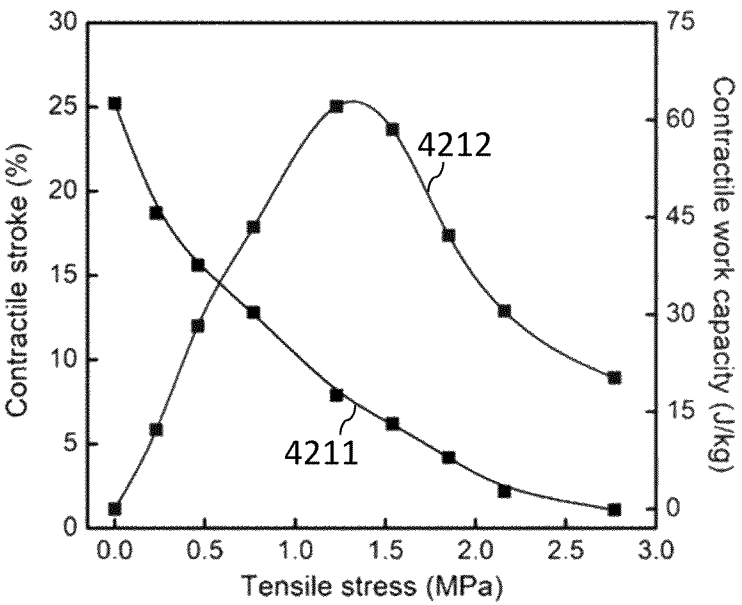

In view of the fact that ITAP provides stronger yarns than does solvent treatment, and because ITAP welds together a portion of the yarn's nanotubes, actuation for this ITAP-produced CNT yarn was characterized. In order to provide the yarn volume change that drives actuation, liquid adsorption and desorption were initially used. FIG. 42B shows dependence of contractile stroke (plot 4211) and gravimetric work capacity (plot 4212) on the applied tensile stress for methanol-adsorption-driven actuation of a 2-ply-extracted high-spring-index (SI: 1.3) CNT yarn. (5 μL/cm of methanol liquid was dropped on the CNT yarn muscle for each contraction and then evaporated for muscle elongation.) When the tensile stress decreased from 2.8 MPa to zero, the contractile stroke monotonically increased from 1.1% to 25.2%. The contractile work capacity reached a peak of 62.1 J/kg for a 1.2 MPa tensile load.

Figure 43:
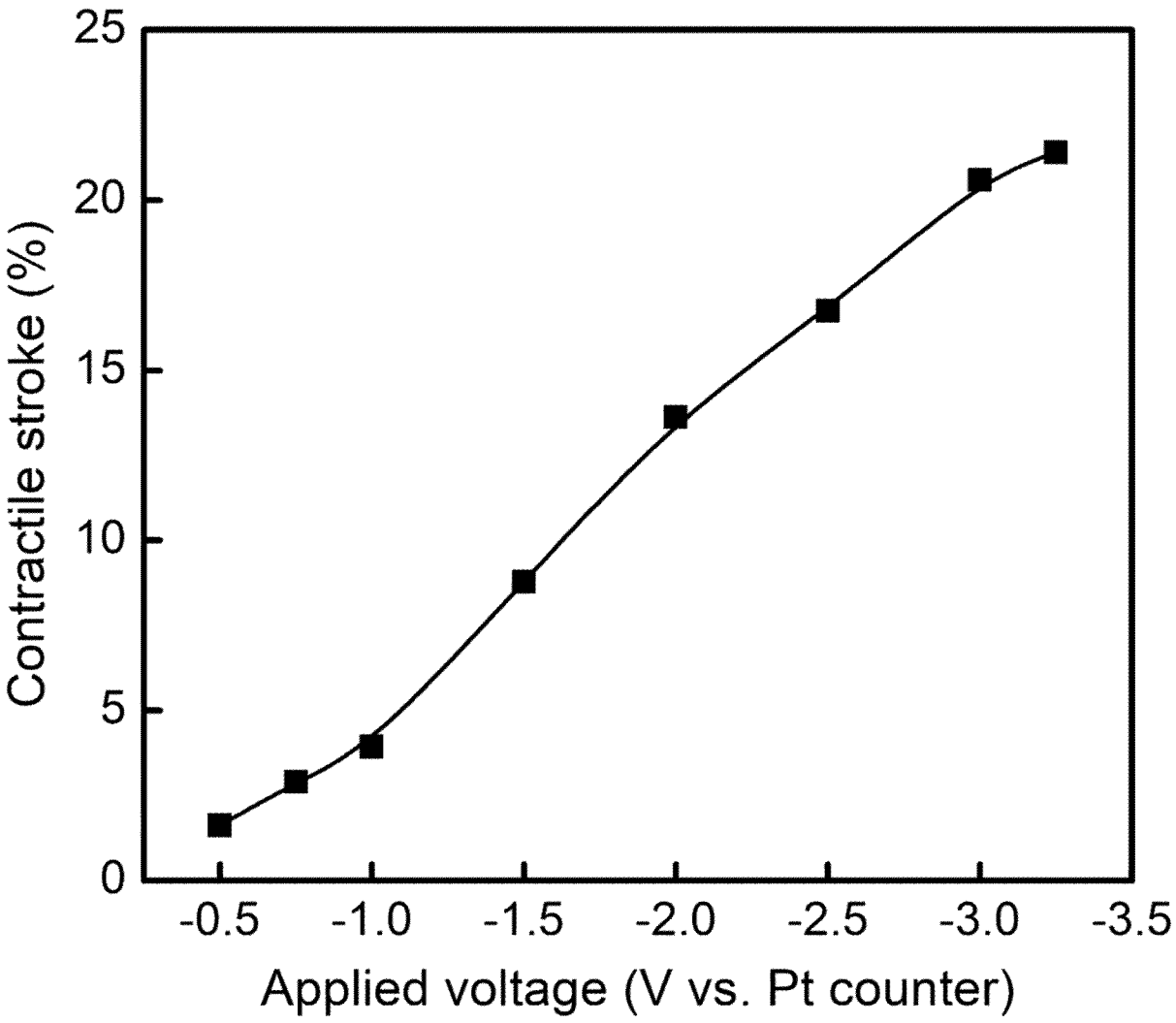
FIG. 43 shows the dependence of non-loaded contractile stroke of high-spring-index CNT yarn on the applied voltage for electrochemically-driven actuation in 0.2 M tetrabutylammonium hexafluorophosphate ($TBA{\cdot}PF_6$) in propylene carbonate.

Performance of the above ITAP-produced CNT yarn was further demonstrated when it was electrochemically-driven in an electrolyte of 0.2 M tetrabutylammonium hexafluorophosphate (TBA·PF6) in propylene carbonate (PC). As shown in FIG. 43 the non-loaded contractile stroke of the ply-extracted CNT yarn muscle increased with increasing applied inter-electrode voltage, and reached a maximum of 21.4% for an applied voltage of −3.25 V. (The 2-ply-extracted CNT yarn used in FIG. 43 was fabricated by using the ITAP method for setting the 2-ply yarn). Here and elsewhere, the term "non-loaded" means that the applied load was so small that didn't affect muscle stroke and was only present to ensure that the muscle was straight. FIG. 42C shows the dependence of the contractile stroke (plot 4221) and gravimetric work capacity (plot 4222) on the tensile stress when the applied square-wave inter-electrode voltage was −3.25 V. While the contractile stroke monotonically decreased with increasing tensile stress, the contractile work capacity reached a peak of 54.5 J/kg for a 1.3 MPa tensile load.

Furthermore, the spring index for these solvent-treated ply-extracted yarns can be increased to much higher values by increasing the number of CNT yarns are plied, which would enable sensing over a much higher strain range, although the voltage change per strain change would be reduced. Hence, these mandrel-free fabricated high-spring-index yarns are useful for sensing large-stroke actuation in robotic structures, which have previously used other methods that typically require a power source.

Muscle Performance for PEC Polymer Fibers, Compared to Thermally Annealed Self-Coiled Fibers A high tensile load is needed for a self-coiled fiber in order to separate the fully-contacted neighboring coils so that there is sufficient space for enabling contraction, which will limit their use for important practical applications, especially those requiring large strokes and small loads. These self-coiled fibers that have contacted coils were also made frozen-coil by thermal annealing while torsionally and positionally tethered under a load that is just sufficiently large to prevent yarn snarling. A higher load for these self-coiled fibers during thermal anneal cannot be used to set them into a structure that has non-contacted periodic coils, since the regular coiled structure disappears when this higher load is applied during thermal anneal.

For example, PEC polymer muscle fabrication can involve inserting twist into the individual fibers at below the twist density needed for coiling, plying these twisted fibers to make a plied yarn, thermal annealing the torsionally and positionally tethered plied yarn in vacuum at 120° C. for 2.5 hours. A second thermal anneal can then be applied to non-tethered ply-extracted fibers in order for them to achieve a uniformly coiled, mechanically-equilibrated structure that has an increased spring index. The second thermal anneal temperature used for pre-PEC fibers can be, for example, 148° C. for 20 seconds.

Since the precursor plied structure has a large inter-coil separation for each component fiber, a large muscle stroke can be obtained for PEC fibers without applying a tensile load. Hence, two-ply-extracted (SI: 4.4) and four-ply-extracted (SI: 8.0) PEC fibers provided reversible non-loaded contractile strokes of 30.2% and 81.0%, respectively, for an actuation temperature change from 25 to 105° C., when the corresponding pre-PEC fibers had been thermally annealed at 148° C. for 20 s. For a temperature decrease from 25 to ~15° C., the above two-ply and four-ply-extracted PEC fibers provided non-loaded reversible elongations of 7.4% and 16.2%, respectively.

In contrast, a self-coiled fiber (with or without the second thermal anneal) provided negligible non-loaded muscle strokes (<1.0%) for the above temperature increases or decreases. For actuation between 25° C. and a wide range of maximum actuation temperatures (between 49 and 182° C.), the non-loaded reversible contractile stroke of a two-ply-extracted PEC fiber (which had a second thermal anneal temperature of 193° C.) approximately linearly increased with temperature change. It then reached a plateau at ~74% stroke because of inter-coil contact, when the maximum temperature reached 165° C. Also, this muscle provided a maximum work capacity of 133.2 J/kg for a 1.92 MPa load (corresponding to a 12.3% stroke). Additionally, we found that the twist load and twist density during fiber twist insertion can be used to optimize muscle actuation at both high and low temperatures.

Figure 38D:
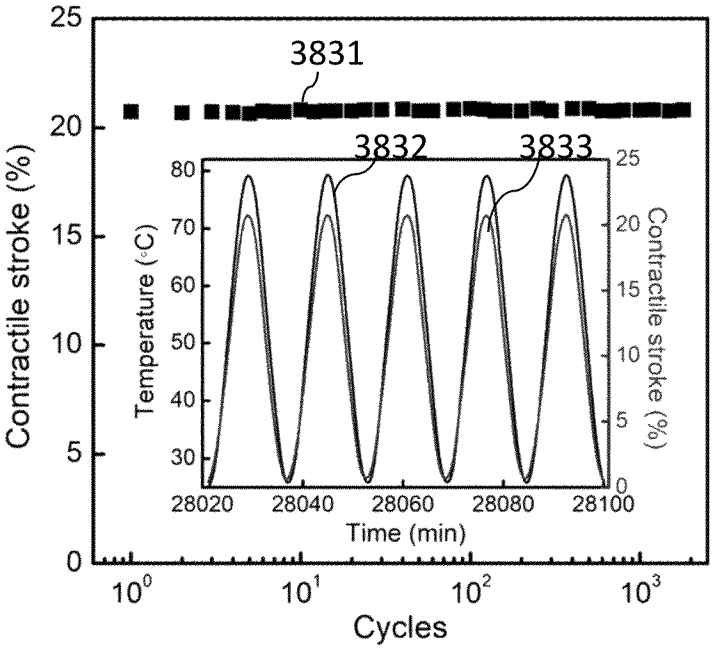
Figure 38C:
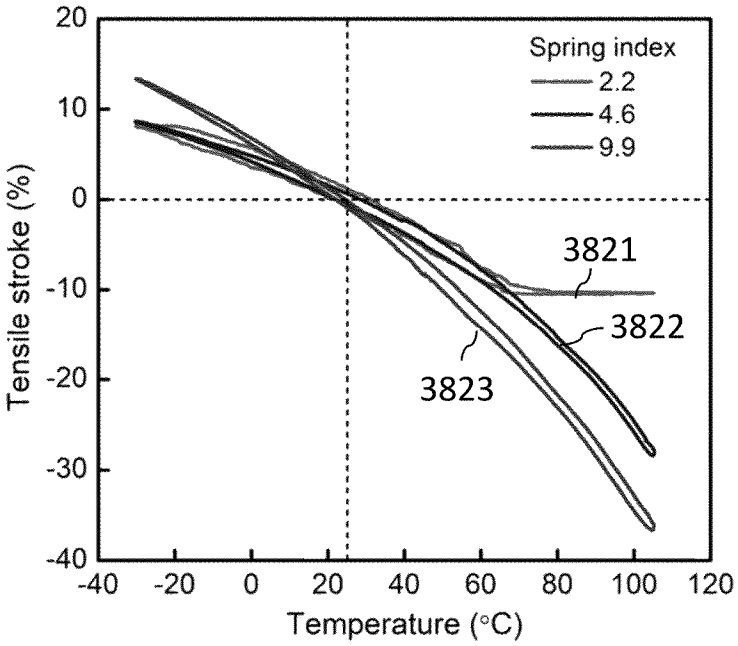

FIG. 38C shows that the tensile actuation of PEC muscles having different spring indexes is fully reversible for an investigated wide temperature range from −30 to 105° C. FIG. 38C (plots 3821-3823 for spring indexes of 2.2, 4.6, and 9.9, respectively). Since these muscles are homochiral, they elongate when the temperature change was to below room temperature and contract when the temperature change was to above room temperature. For a temperature change from 25 to 80° C., the ~20.7% contraction of a ~5.2 spring index PEC muscle (lifting a load providing a 0.5 MPa tensile stress) was maintained for over 1800 heating-and-cooling cycles, which occurred during a nearly 20 day period. FIG. 38D (plot 3831 showing tensile stroke of a 2-ply-extracted PEC muscle having a spring index of ~5.2 during 1800 heating-cooling cycles when under a 0.5 MPa load in which a temperature change rate of 10° C./min was used and the investigated temperature range was between 25 and 80° C.); see also inset of FIG. 38D with plots 3832-3833 showing time dependence of, respectively, temperature and contractile stroke during the last five heating-cooling cycles.

Figure 44:
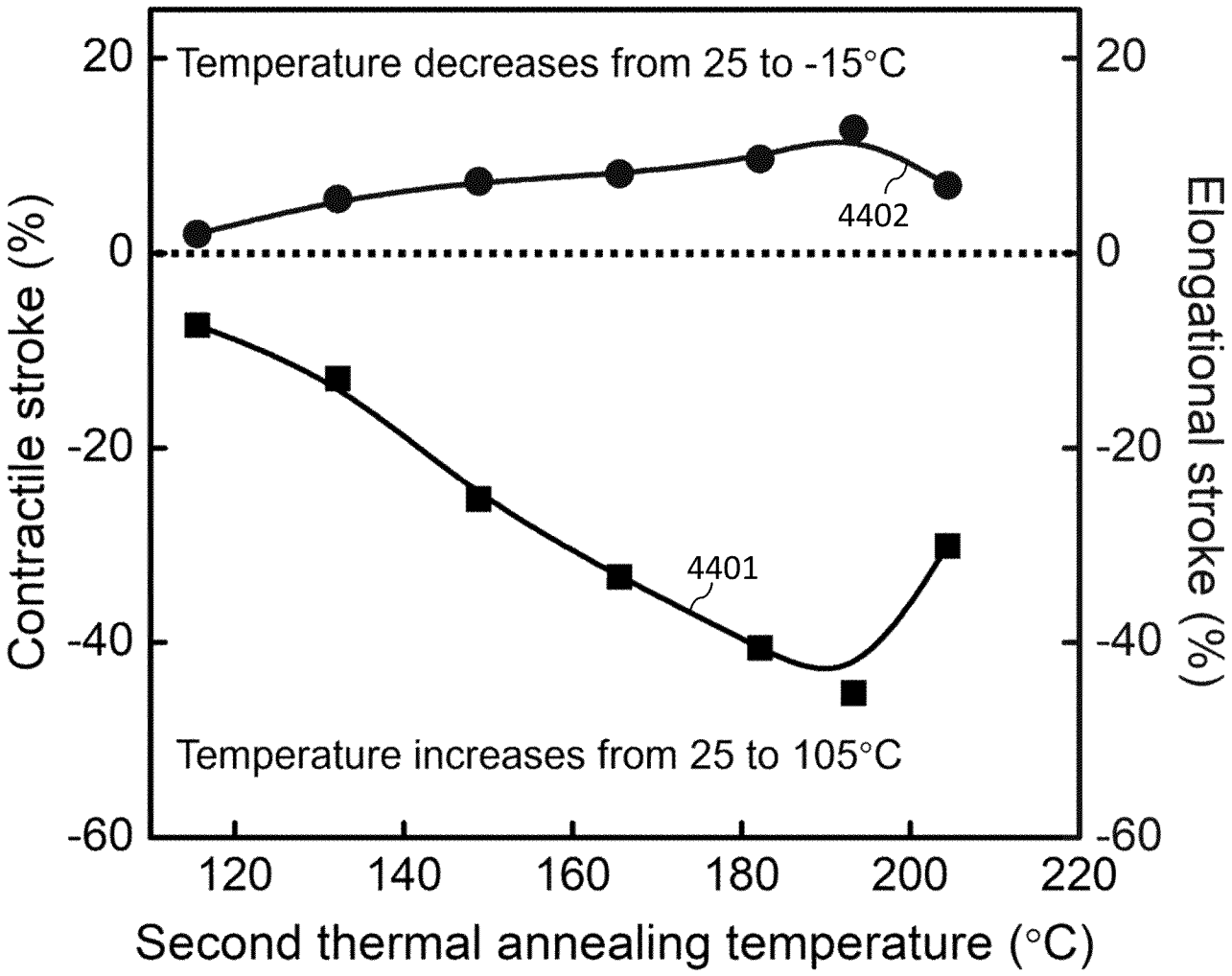
FIG. 44 shows dependencies of non-loaded contractile stroke and elongational stroke of PEC fibers on the second thermal anneal temperature applied to the corresponding pre-PEC fibers.

The effect of the second anneal temperature on the actuation of PEC fibers was investigated in order to maximize the strokes for given actuation temperature changes. When the second anneal temperature was 193° C. (FIG. 44), the highly reversible non-loaded strokes (plots 4401-4402 for, respectively, non-loaded contractile stroke and elongational stroke) of two-ply-extracted PEC fibers reached peaks (45.2% for contraction during heating from 25 to 105° C. and 12.8% for elongation during cooling from 25 to ~15° C.). (In FIG. 44, the actuation temperatures for muscle contraction and expansion were from 25 to 105° C. and from 25 to ~15° C., respectively.)

However, since a very high second thermal anneal temperature causes much permanent fiber untwist, it dramatically decreases the muscle's contractile work capacity. Hence, unless otherwise mentioned, the second anneal temperature was 148° C. However, a different second thermal anneal temperature can be used to optimize the stroke and delivered work for specific application needs.

Figure 32A:
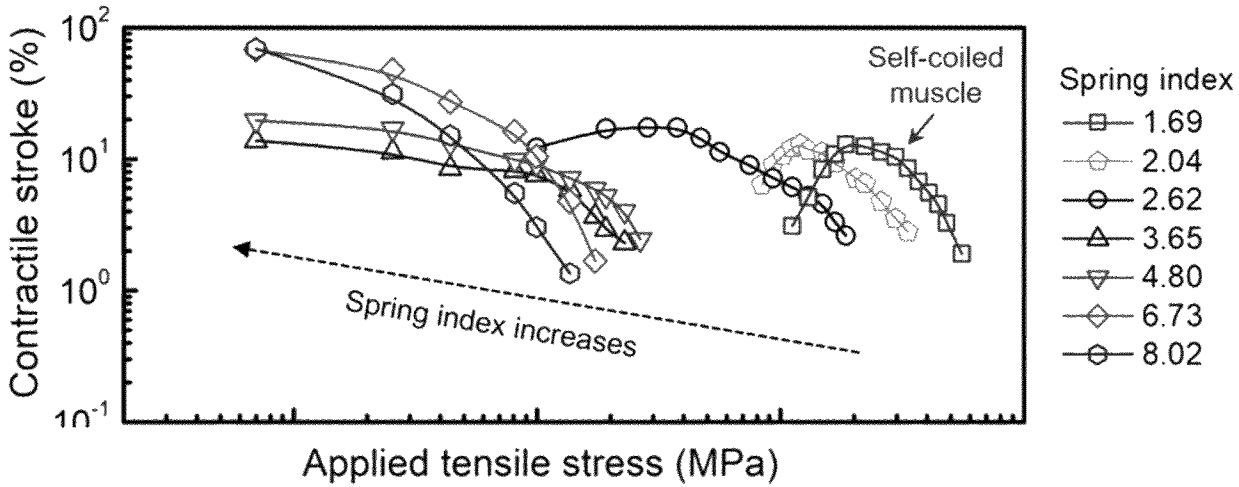
FIGS. 32A-32G show muscle performance of 2-ply-extracted high-spring-index PEC nylon-6 fibers.
Figure 32B:
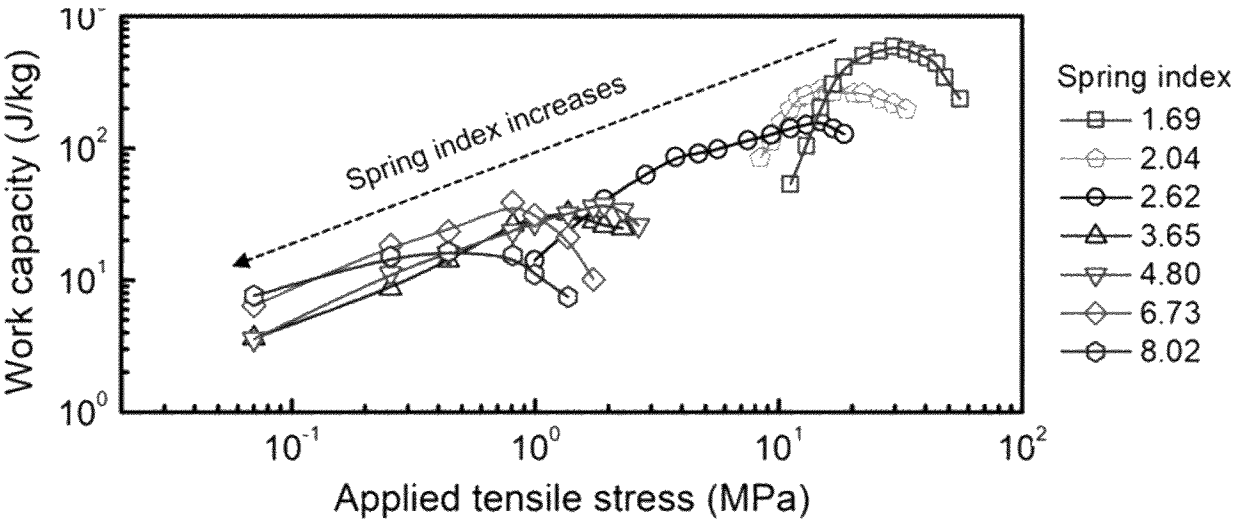
Figure 32C:
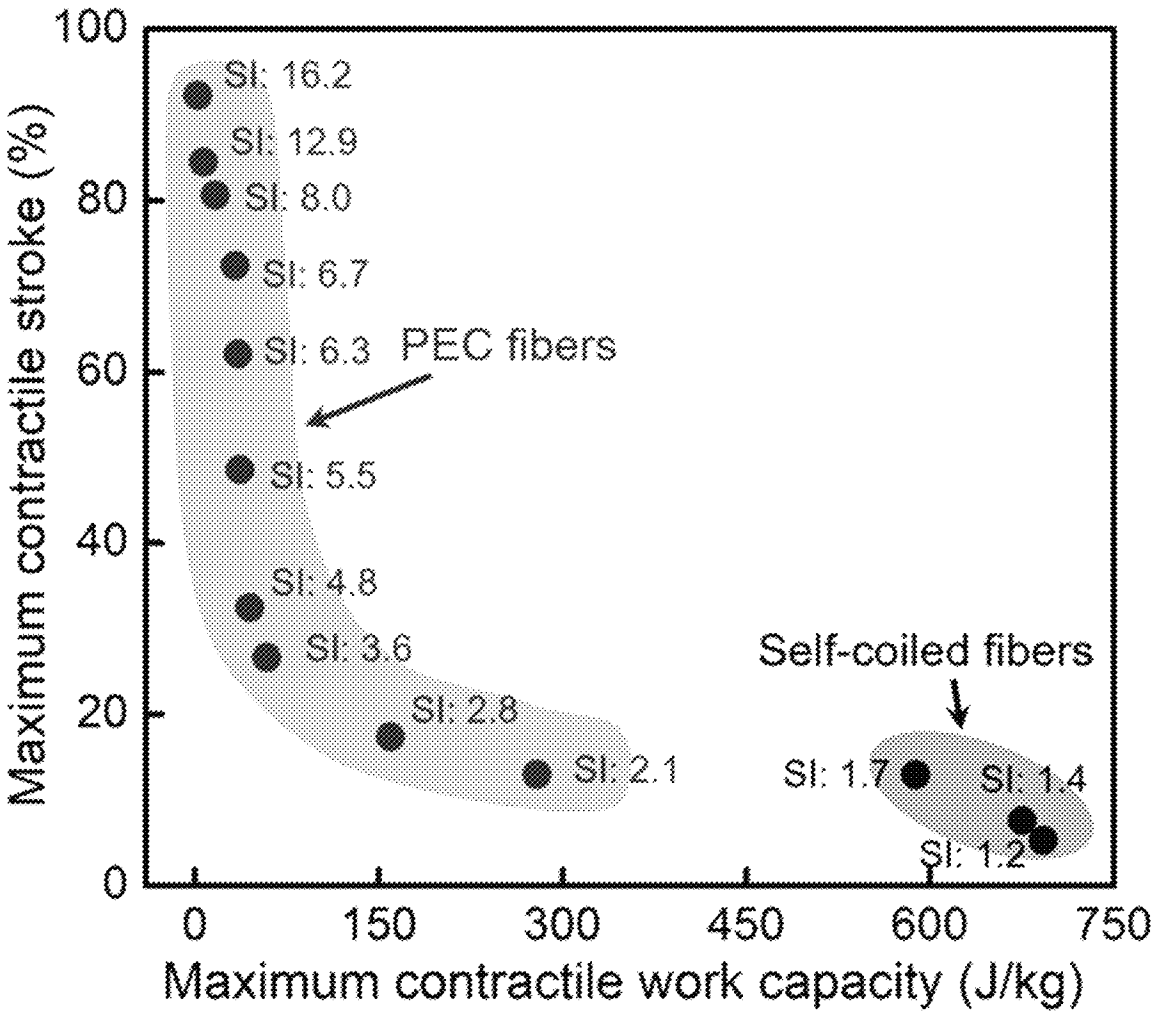

FIGS. 32A-32B show the dependencies of contractile stroke and work capacity, respectively, of self-coiled and PEC fibers on applied tensile stress for actuation between 25 and 93° C. FIG. 32C uses these results to contrast the relationship between the maximum contractile stroke and the maximum contractile work capacity for PEC muscles and self-coiled muscles. These results indicate that the gravimetric work capacities of the self-coiled muscles are much larger than for PEC fibers, while the self-coiled muscles have much smaller strokes. However, for applications (like comfort adjusting clothing) in which the needed work capacity is small, but large muscle strokes are required for small temperature changes, this data shows that PEC muscles have major advantages. The spring index of PEC fibers can be chosen to provide both the needed stroke and work capacity for this and other applications. Self-coiled fibers are useless in highly flexible textile structures, since the flexibility of such textiles means that high loads cannot be applied, so the muscle stroke will be near zero.

Figure 32E:
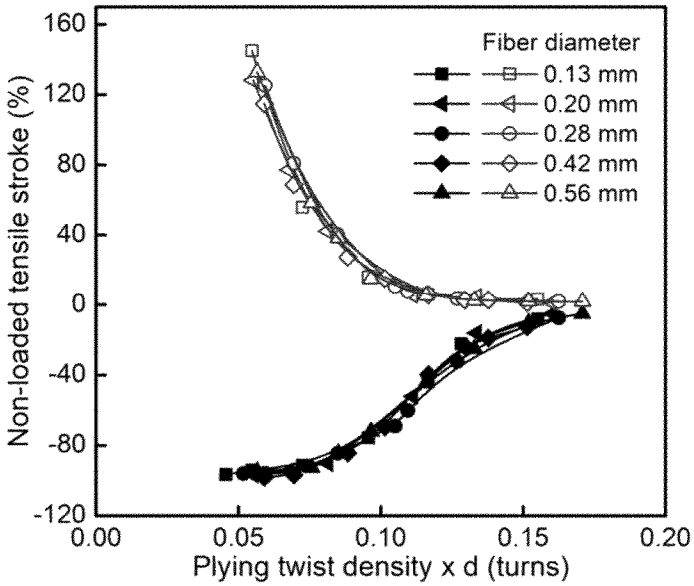
Figure 32D:
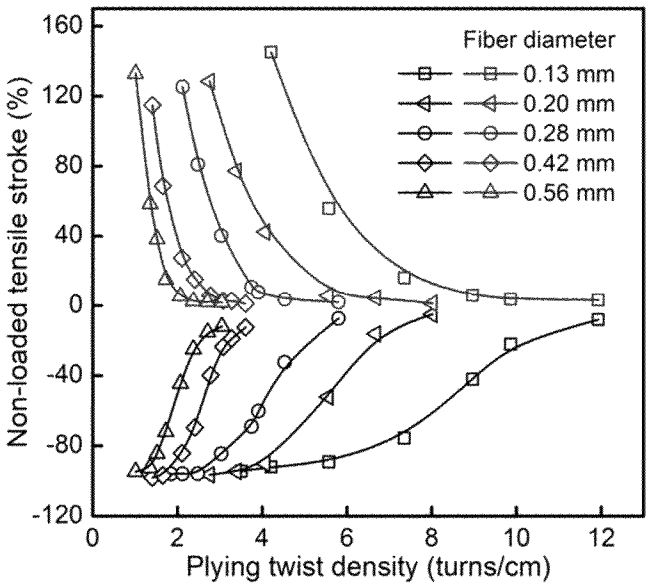

Since plying twist density mainly dominates the spring index of a PEC muscle (FIG. 38C) and the spring index strongly affects the muscle's tensile stroke, dependence was also characterized of non-loaded tensile stroke during temperature increase and decrease for PEC muscles on the plying twist density used for their fabrication from 2-ply yarns (FIG. 32D). Because a higher spring index provides a larger stroke, a lower plying twist density (corresponding to a higher spring index) provides a larger stroke for a constant-diameter precursor fiber. When the product of the plying twist density and precursor fiber diameter was kept constant, the effect of the fiber diameter on muscle tensile actuation was eliminated (FIG. 32E).

These results are very useful for muscle applications, since they provide a general guideline for relating fabrication conditions and muscle performance. For these different diameter PEC fibers, the fiber bias angle, the load during fiber twist and yarn plying, and the first and second thermal annealing processes were kept the same. Hence, as long as these fabrication conditions were kept constant, one can predict the tensile strokes of PEC fibers having any diameter between 0.13 and 0.56 mm from results for one fiber diameter in this range.

Figure 32G:
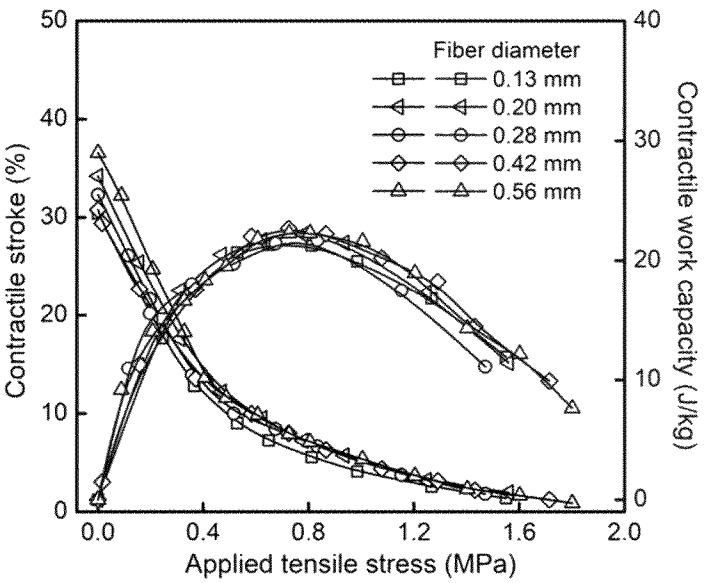
Figure 32F:
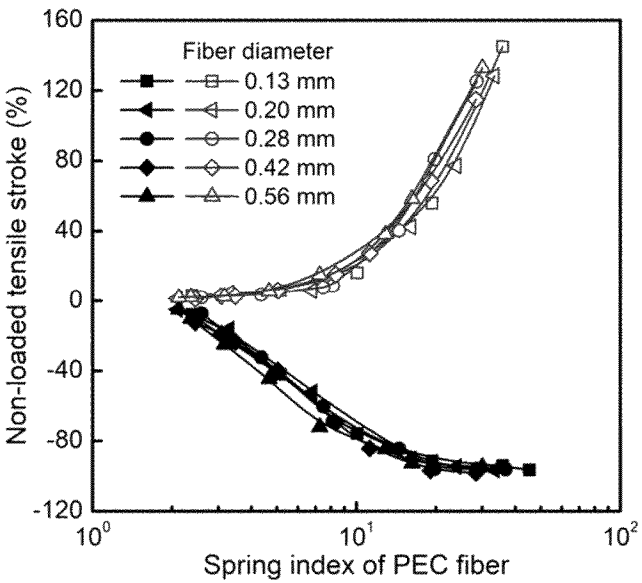

The spring indexes of PEC fibers were independent of the precursor fiber diameter as long as the product of plying twist density and precursor fiber diameter was the same. FIG. 38B. As a result, PEC fibers made from different precursor diameter fibers provided about the same tensile strokes when their spring indexes were the same. FIG. 32F. When the product of plying twist density and precursor fiber diameter was ~0.12 turns, the contractile stroke and work capacity of PEC muscles with the same spring index (~4.5) were essentially independent of the precursor fiber diameter for an applied tensile stress of 0 to 1.8 MPa. FIG. 32G (showing that, for different-fiber-diameter PEC muscles having about the same spring index (~4.5), since the product of plying twist density and precursor fiber diameter was ~0.12 turns (FIG. 38B), the dependence of PEC muscles contractile stroke and contractile work capacity on applied tensile stress was largely independent of precursor fiber diameters for actuation between 25 and 93° C. (The fibers used in FIGS. 32D-32G were twist inserted to the same fiber bias angle of ~26° under a tensile stress of 18.5 MPa. During plying twist, the applied tensile stress for these different diameter fibers were the same as used for fiber twist.)

Applications of Mandrel-Free High-Spring-Index Polymer PEC Muscles

The present invention demonstrates a mandrel-free method for making high-spring-index muscles that provides performance advantages for application in comfort adjusting textiles, as well as cost advantages discussed above. Textiles are disclosed and described that increase thermal insulation when the outside temperature is either above or below the desired temperature. This ability can have critically important when these switchable insulation textiles are used for applications other than comfort adjusting clothing, such as for thermal insulation of buildings. Such building applications require the ability to increase insulation when the outside temperature is either so hot or so cold that transmission of outside temperatures to the building increases the need for either increased building refrigeration or increased building heating.

The present inventions further demonstrates that the increased morphing provided by the high-spring-index PEC muscles enables a greatly reduced total muscle weight to be deployed per textile area. Since these muscles can be woven into the outside of the bilayer textile layers or be placed between them, this enables bilayer textiles to exhibit increased thermal insulation for either cold or hot temperatures. Hence, a stack of two bilayer textiles (or many such two bilayer textiles that provide opposite temperature responses) can be deployed to provide increased insulation when the outside temperature is either too hot or too cold. For building applications, the bilayer textile can optionally be replaced by two flexible bilayers of thermally insulating closed cell foam or a flexible thermally conducting sheet, depending upon whether the goal is to maximize or minimize the thermal insulation of the non-actuated state.

To demonstrate PEC muscle use in comfort adjusting clothing, high-spring-index PEC muscles were incorporated in the exterior of both layers of the bilayer textile. See EXAMPLE 43 above. This geometry was previously utilized in comfort adjusting jackets when using expensively produced mandrel-coiled polymer muscles. However, instead of weaving expensive mandrel-coiled muscles into the textile, as previously done, these PEC muscles were sewed on the outer fabric surface of each textile layer by using additional thread. This avoided the possible interference of the weaving process on muscle actuation and enabled the use of diverse types of bilayer textiles and localization of morphing areas in any textile region.

While the bilayer textile in the commercialized jackets used a muscle weight that was ~119% of the bilayer textile weight, the cheaper-to-manufacture PEC muscles of the present invention provided equivalent morphing in response to cold temperatures when the muscle weight is as low as 45% of the bilayer textile weight. FIGS. 34A-34C show this high morphing of a PEC-muscle-actuated bilayer textile, which is a little higher than for the much higher muscle-weight-fraction mandrel-coiled muscles in the commercialized jackets. FIG. 34D shows the giant fully-reversible increase in the cross-sectional area of three inter-sheet insulating pores (from near-zero at 25° C. to 19 $cm^2$ at −12° C.) for complete morphing of our muscle-powered textile. FIG. 34D (with plots 3411-3412 for temperature decrease and temperature increase, respectively).

Figure 45:
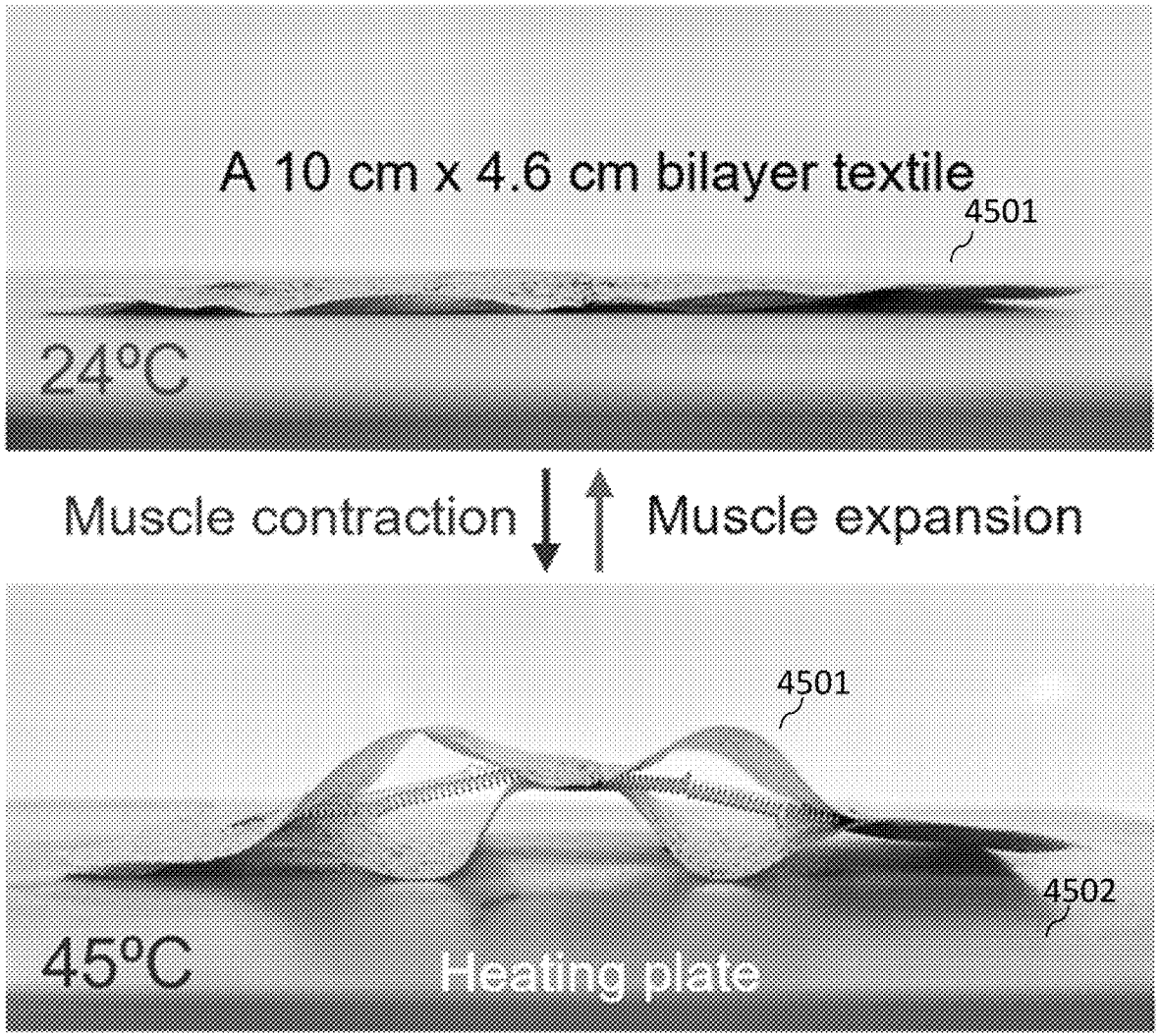
FIG. 45 shows photographs of an actuated bilayer textile in which two homochiral PEC fibers (with 3.5-cm non-actuated length) were sewn midway between textile layers of the actuated sections, when at 24° C. (top photograph) and when on a 45° C. hot plate (bottom photograph).
Figure 46A:
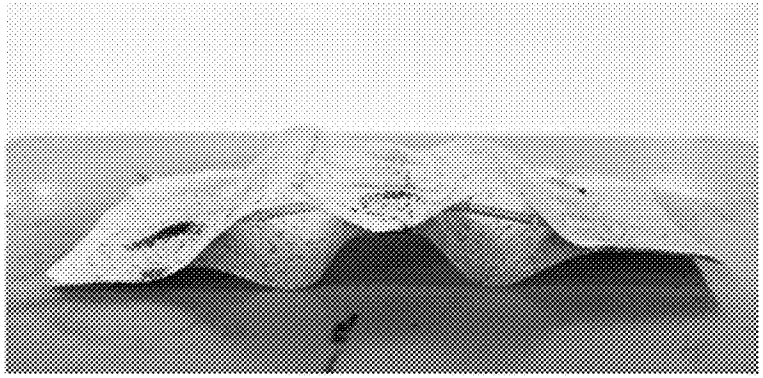
FIGS. 46A-46B show photographs, respectively, of (FIG. 46A) the bilayer textile of FIG. 45 and (FIG. 46B) a bilayer textile without PEC fibers when on a 45° C. hot plate.
Figure 46B:
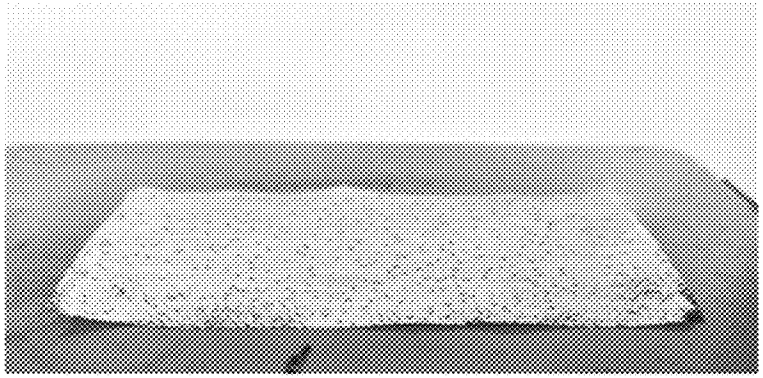
Figure 46C:
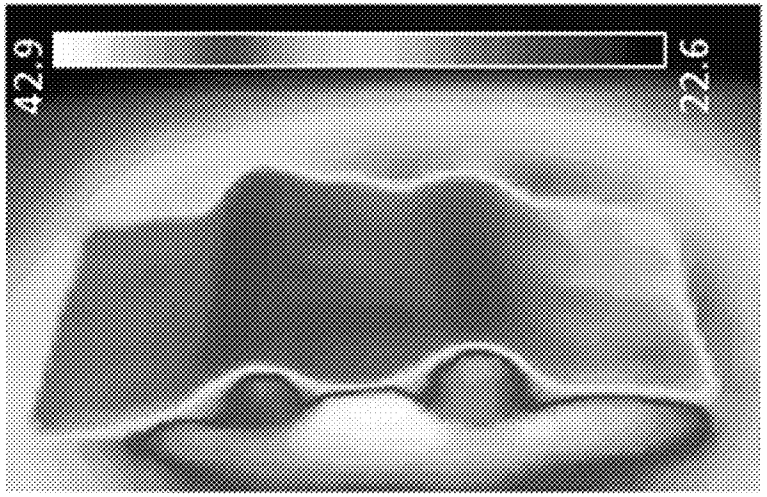
FIGS. 46C-46D show, respectively, the corresponding infrared thermal images of FIGS. 46A-46B.
Figure 46D:
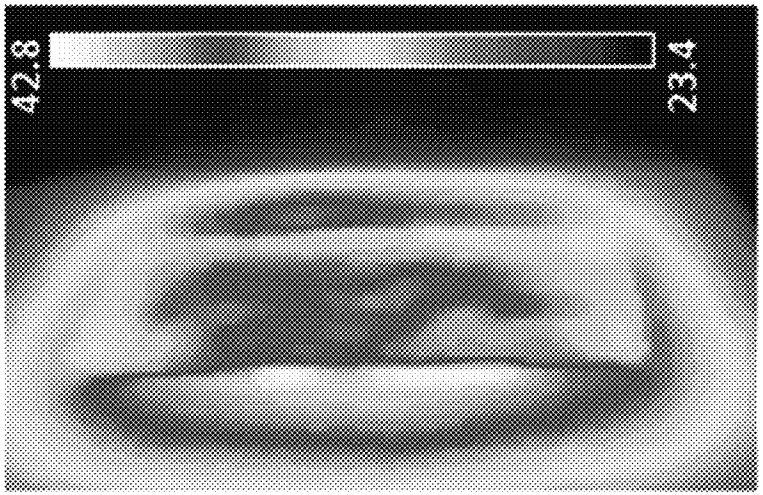

Relevant for controlling temperatures in buildings or underwater or space structures, the use of PEC muscles were demonstrated in bilayer structures that become thermally insulating when the outside temperature becomes too hot. This was done by creating a bilayer structure in which the muscles were located between the bilayer sheets, so that a temperature increase caused muscle contraction that opened thermally insulating pores. While the bilayer textile was planar and low in thermal insulation at 24° C., giant pores opened when it was placed on a 45° C. hot plate. FIG. 45 (showing photographs of an actuated bilayer textile 4501 in which two homochiral PEC fibers (with 3.5-cm non-actuated length) were sewn midway between textile layers of the actuated sections, when at 24° C. (top photograph) and when on a 45° C. hot plate 4502 (bottom photograph)). Infrared thermal images show that a flat bilayer sheet without PEC muscles conducts the hot temperature through the sheet structure (FIGS. 46B and 46D), but the bilayer sheet containing PEC muscles becomes insulating (so its top surface remains near room temperature) (FIGS. 46A and 46C). Experiments revealed that this morphing between thermally conducting and thermally insulating states is completely reversible.

Figure 47A:
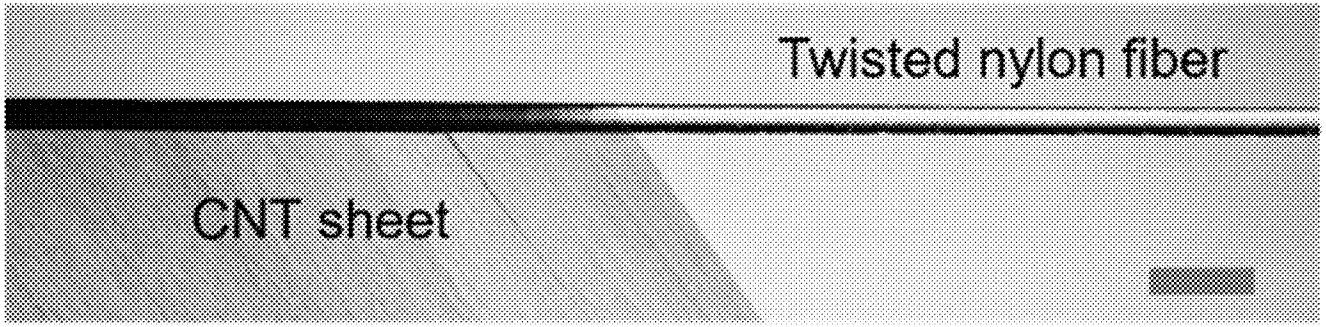
FIGS. 47A-47E shows fabrication and application of a high-spring-index sheath-core fiber muscle.

Since it is desirable for most robotic applications to electrically drive a polymer muscle by directly heating it, instead of driving it by using a heated environment, the following advance has practical import. The use was demonstrated of electrical heating to directly drive a PEC muscle that was fabricated from a twisted nylon-6 fiber that was layer-by-layer wrapped with ~15 layers of forest-drawn electrically-conducting CNT sheets before plying. FIG. 47A (a 5.0 turns/cm twisted 0.28-mm-diameter nylon fiber being wrapped with single-layer CNT sheet).

Figure 47B:
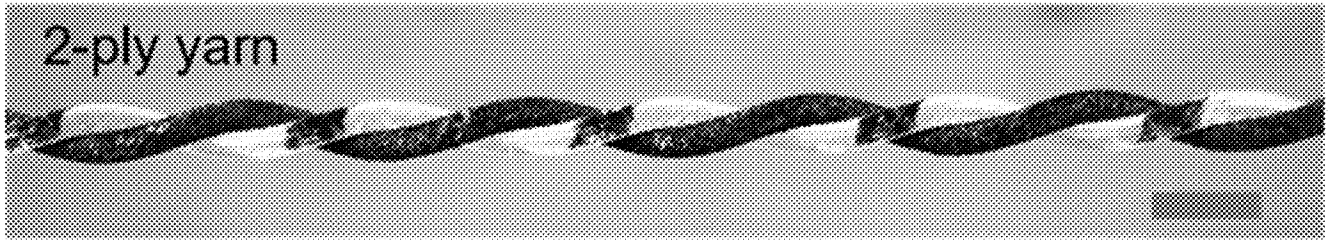
Figure 47C:
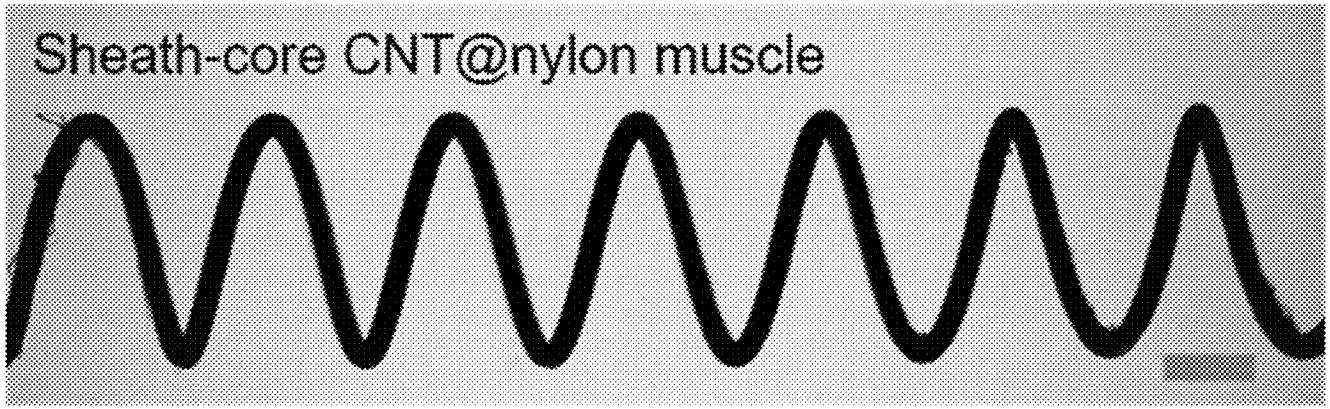

In FIG. 47B, a 2-ply yarn was used and for visual clarity, only one of the plied nylon fibers was wrapped with CNT sheet (before plying, each fiber had a 5.0 turns/cm twist). However, all plied nylon fibers in the practical examples would be individually coated with CNTs and the precursor plied yarns can be from 2 to 5 ply. A high-spring-index sheath-core CNT@nylon PEC fiber muscle (SI: 14.0) was obtained (FIG. 47C), since a low plying twist density (3.0 turns/cm) was used.

Figure 47E:
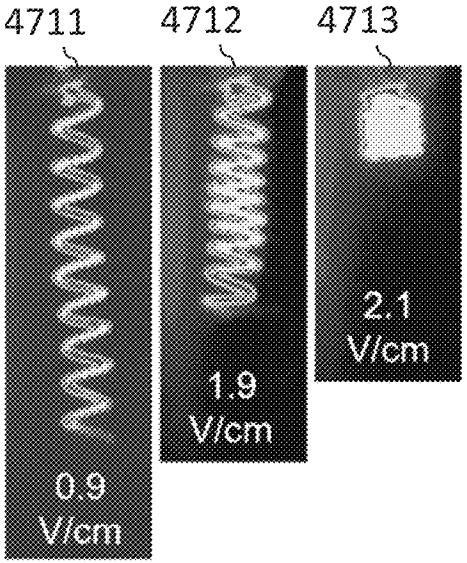
Figure 47D:
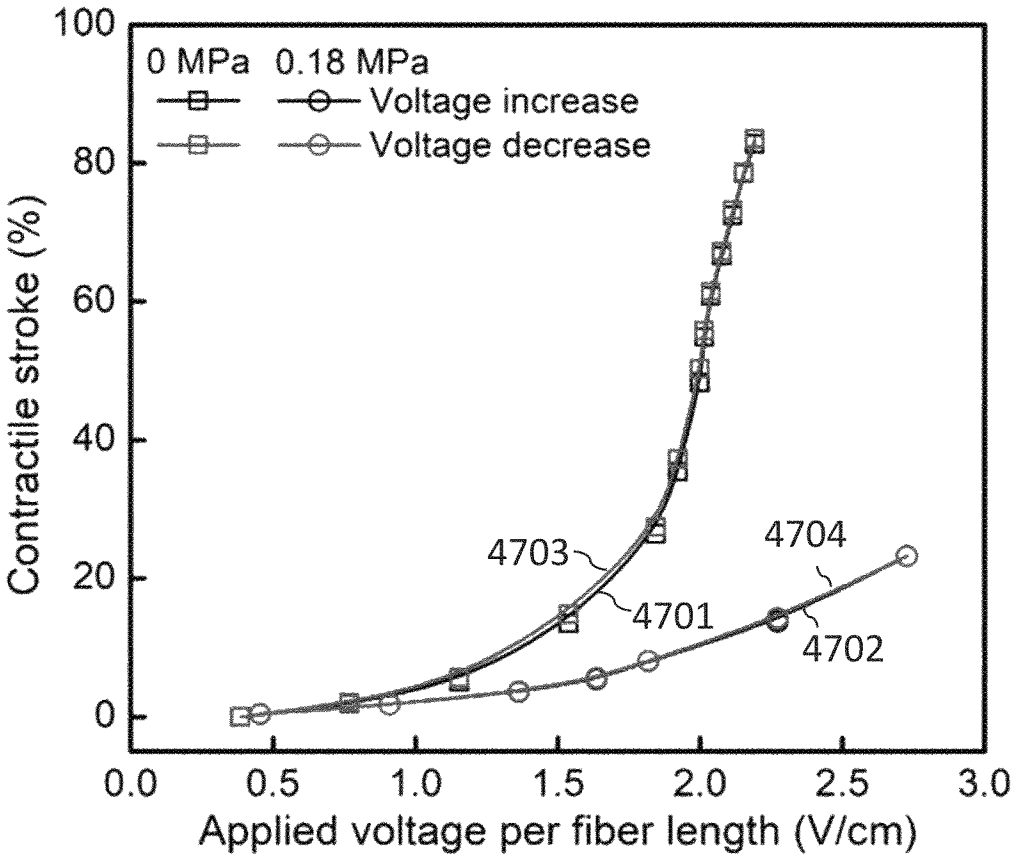

FIG. 47D shows the dependence of contractile stroke on the applied voltage per fiber length for this sheath-core CNT@nylon PEC muscle. FIG. 47D (plots 4701-4702 for voltage increase for 0 MPa and 0.18 MPa, respectively, and plots 4703-4704 for voltage decrease for 0 MPa and 0.18 MPa, respectively). Because of direct muscle heating by passing current through the CNT layer and the large air volume accessible for cooling (evidenced in FIG. 47E by infrared thermal images 4711-4713 for actuation 0.9 V/cm, 1.9 V/cm, and 2/1 V/of the sheath-core CNT@nylon PEC muscle), full-cycle actuation was much faster than for environmentally controlled actuation in air. This sheath-core structure also provides a practical strategy for precisely controlling contractile stroke for robotic applications by varying the applied electric voltage per fiber length.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above.

The disclosures of all patents, patent applications, and publications cited herein are hereby incorporated herein by reference in their entirety, to the extent that they provide exemplary, procedural, or other details supplementary to those set forth herein.

Amounts and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of approximately 1 to approximately 4.5 should be interpreted to include not only the explicitly recited limits of 1 to approximately 4.5, but also to include individual numerals such as 2, 3, 4, and sub-ranges such as 1 to 3, 2 to 4, etc. The same principle applies to ranges reciting only one numerical value, such as "less than approximately 4.5," which should be interpreted to include all of the above-recited values and ranges. Further, such an interpretation should apply regardless of the breadth of the range or the characteristic being described. The symbol "~" is the same as "approximately".

Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are now described.

Following long-standing patent law convention, the terms "a" and "an" mean "one or more" when used in this application, including the claims.

Unless otherwise indicated, all numbers expressing quantities of ingredients, reaction conditions, and so forth used in the specification are to be understood as being modified in all instances by the term "about." Accordingly, unless indicated to the contrary, the numerical parameters set forth in this specification are approximations that can vary depending upon the desired properties sought to be obtained by the presently disclosed subject matter.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

REFERENCES

U.S. Pat. No. 10,837,130, entitled "Incandescent Tension Annealing Processes For Strong, Twisted-Stable Carbon Nanotube Yarns And Muscles," issued Oct. 28, 2020, to J. Di, et al. ("Di '130 Patent")

U.S. Pat. No. 10,793,979, entitled "Coiled Actuator System And Method," issued Sep. 16, 2020, to B. Ridley, et al. ("Ridley '979 Patent")

U.S. Patent Appl. Publ. No. 2019/0269188, entitled "Thermally Adaptive Fabrics A filed Mar. 5, 2019, to B. Ridley, et al. ("Ridley '188 Application").

Bolder Creative article/advertisement, "Ralph Lauren 'Insulation' 2022 Winter Olympics, Jan. 25, 2022, available at website "www.lbbonline.com" on webpage "work/61727" ("Bolder Creative 2022").

Di, J., et al., "Strong, Twist-Stable Carbon Nanotube Yarns And Muscles By Tension Annealing At Extreme Temperatures," *Advanced Materials,* 2016, 28, 6598-6605 ("Di 2016").

Kim, S. K., et al., "Harvesting Electrical Energy From Carbon Nanotube Yarn Twist," *Science,* 2017, 357, 773-778 ("Kim 2017").

Ralph Lauren press Release, "Ralph Lauren Debuts 'Intelligent Insulation' Technology, A Pioneering Apparel Innovation Developed For Team Usa's Opening Ceremony Parade Uniform," Jan. 20, 2022, available at website "www.corporate.ralphlauren.com" on webpage "pr_220120_BeijingOlympics.html" ("Ralph Lauren January 2022").

Wang, R., et al., "Torsional Refrigeration By Twisted, Coiled, And Supercoiled Fibers," *Science,* 2019, 366, 216-221 ("Wang 2019").

What is claimed is:

1. A method comprising making a high-spring-index coiled fiber or yarn, wherein the method makes the high-spring-index coiled fiber or yarn without using a sacrificial core material whose diameter approximately defines the inner-coil diameter, and wherein the method to make the high-spring-index coiled fiber or yarn comprises:

(a) inserting twist separately into two or more individual fibers and/or yarns;

(b) plying the two or more individual fibers and/or yarns by inserting plying twist to form a multi-ply structure;

(c) setting the multi-ply structure without permanently binding together the two or more individual fibers and/or yarns of different plies in the multi-ply structure so that the multi-ply structure is substantially stable against untwist when torsionally untethered; and (d) after the step of setting, unplying the two or more individual fibers and/or yarns of different plies in the multi-ply structure to obtain the high-spring-index coiled fiber or yarn.

2. The method of claim 1, wherein (a) the two or more individual fibers and/or yarns comprises an individual fiber and an individual yarn;

(b) at least one of the individual fiber and the individual yarn is selected from the group consisting of elastomeric polymers, non-elastomeric polymers, metal wires, metal yarns, carbon fibers, carbon yarns, carbon nanotube yarns, and combinations thereof.

3. The method of claim 2, wherein the individual yarn in the plied structure is a carbon nanotube yarn.

4. The method of claim 3 further comprising using the high-spring-index coiled fiber or yarn in a use selected from the group consisting of electrochemical artificial muscles, solvent-driven artificial muscles, mechanical energy harvesters, and self-powered strain sensors.

5. The method of claim 1, wherein at least one of the two or more individual fibers and/or yarns of different plies in the multi-ply structure is a sheath-core fiber or yarn.

6. The method of claim 5, wherein the sheath-core fiber or yarn comprises a sheath that is electrically conductive.

7. The method of claim 6, wherein the sheath is selected from a group consisting of carbon nanotube sheets, wrapped metal films, and conductive powder coatings.

8. The method of claim 1, wherein plying twist density is used to vary the spring index of the high-spring-index coiled fiber or yarn.

9. The method of claim 1, wherein plying twist density is varied along length of the multi-ply structure, so that a high-spring-index coiled fiber or yarn having multiple spring indexes along its length can be obtained.

10. The method of claim 9, wherein spring index is varied so that a first coil having a first spring index can pass through adjacent second coil having a second spring index in which the first spring index is less than the second spring index.

11. The method of claim 10, wherein essentially all adjacent coils to the first coil have a spring index greater than the first spring index, such that coil chirality of an actuated muscle comprising the high-spring-index coiled fiber or yarn can transform between homochiral and heterochiral during actuation.

12. A method comprising making a high-spring-index coiled fiber or yarn, wherein the method makes the high-spring-index coiled fiber or yarn without using a sacrificial core material whose diameter approximately defines the inner-coil diameter, and wherein the method to make the high-spring-index coiled fiber or yarn comprises:

(a) inserting twist separately into two or more individual fibers and/or yarns, wherein the amount of the twist insert is below a level of twist that results in the coiling of the two or more individual fibers and/or yarns;

(b) plying the two or more individual fibers and/or yarns by inserting plying twist to form a multi-ply structure, wherein the amount of plying twist inserted creates coils in the two or more individual fibers and/or yarns of the multi-ply structure;

(c) performing a first setting process upon the multi-ply structure to set the coils in the two or more individual fibers and/or yarns of the multi-ply structure without permanently binding together the two or more individual fibers and/or yarns in the multi-ply structure so that the multi-ply structure is substantially stable against untwist when torsionally untethered;

(d) after the step of setting, unplying the two or more individual fibers and/or yarns in the multi-ply structure to obtain the high-spring-index coiled fiber or yarn; and (e) after the step of unplying, performing a second setting process in which the high-spring-index coiled fiber or yarn is set when not torsionally or positionally tethered.

13. The method of claim 12, wherein (a) the first setting process comprises a first annealing process; and (b) the second setting process comprises a second annealing process.

14. The method of claim 12, wherein the high-spring-index coiled fiber or yarn is a high-spring-index homochiral fiber or yarn.

15. The method of claim 12, wherein (a) the high-spring-index coiled fiber or yarn is a high-spring-index fiber or yarn with multiple twist levels, (b) at least one of the twist levels of the multiple twist levels has a first spring index, (c) at least a different one of the twist levels of the multiple twist levels has a second spring index, and (d) the first spring index level and the second spring index level are different spring index levels.

16. The method of claim 12, wherein the high-spring-index coiled fiber or yarn is a high-spring-index homochiral CNT fiber or yarn.

17. A method comprising:

(a) selecting a high-spring-index coiled fiber or yarn made by the method of claim 12;

(b) incorporating the high-spring-index coiled fiber or yarn in a textile.

18. The method of claim 17, wherein the textile is a comfort adjusting textile that can be used in cold temperatures, hot temperatures, or both.

19. The method of claim 18, wherein the high-spring-index coiled fiber or yarn is a high-spring-index coiled PEC fiber or yarn.

* * * * *